US008556526B2

(12) United States Patent
Noda et al.

(10) Patent No.: US 8,556,526 B2
(45) Date of Patent: Oct. 15, 2013

(54) PRINTER

(75) Inventors: Kengo Noda, Inazawa (JP); Asami Yokoe, Nagoya (JP); Shinji Kobayashi, Tokoname (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 381 days.

(21) Appl. No.: 13/028,617

(22) Filed: Feb. 16, 2011

(65) Prior Publication Data

US 2011/0293350 A1 Dec. 1, 2011

(30) Foreign Application Priority Data

May 31, 2010 (JP) ..... 2010-125262
May 31, 2010 (JP) ..... 2010-125407
Jun. 23, 2010 (JP) ..... 2010-142833
Jun. 23, 2010 (JP) ..... 2010-143157

(51) Int. Cl.
*B41J 32/00* (2006.01)
*B41J 35/36* (2006.01)
*B41J 3/36* (2006.01)

(52) U.S. Cl.
USPC ..... 400/613; 400/207; 400/208; 400/242

(58) Field of Classification Search
USPC ..... 400/613, 88, 207, 208, 611, 242
See application file for complete search history.

(56) References Cited

U.S. PATENT DOCUMENTS 6,116,796 A * 9/2000 Yamaguchi et al. ..... 400/615.2
7,503,714 B2 3/2009 Yamamoto et al.
8,360,667 B2 * 1/2013 Sago ..... 400/207
2009/0196669 A1 * 8/2009 Murata ..... 400/207

FOREIGN PATENT DOCUMENTS

EP 0 641 663 3/1995
EP 2 261 040 12/2010
JP H4-133756 5/1992
JP 7009743 1/1995
JP 3543659 4/2004
JP 2006-239912 9/2006

* cited by examiner

*Primary Examiner* — Judy Nguyen
*Assistant Examiner* — Jennifer Simmons
(74) *Attorney, Agent, or Firm* — McCarter & English, LLP

(57) ABSTRACT

A printer that includes a cassette mounting portion into which a tape cassette is mounted and from which is removed a tape cassette in an up-down direction, a printing head that performs printing on the tape, a platen roller that faces the printing head, a roller holder that rotatably supports the platen roller, a sensor that detects the type of the tape, a sensor holder that holds the sensor, and a protective portion that is provided on the roller holder and is provided above the sensor.

20 Claims, 57 Drawing Sheets

PRINTER

CROSS-REFERENCE TO RELATED APPLICATION

This application claims priority to Japanese Patent Application No. 2010-125407, filed May 31, 2010, Japanese Patent Application No. 2010-125262, filed May 31, 2010, Japanese Patent Application No. 2010-142833, filed Jun. 23, 2010, Japanese Patent Application No. 2010-143157, filed Jun. 23, 2010, the disclosure of which is incorporated herein by reference in its entirety.

BACKGROUND

The present invention relates to a printer that is configured such that a tape cassette can be freely mounted and removed and that prints on a tape that is contained in the tape cassette.

A printer is known that, using a plurality of detecting switches, detects the type of a tape (the tape width, the form of printing, and the like) that is contained in a tape cassette that is mounted in a cassette mounting portion of the printer. Specifically, a cassette detection portion is provided in a portion of the bottom face of the tape cassette, with through holes being formed in the cassette detection portion in a pattern that corresponds to the type of tape. When the tape cassette is mounted in the cassette mounting portion, the detecting switches, which are constantly urged upward, are selectively depressed in accordance with the pattern of the through holes that are formed in the cassette detection portion. The printer detects the type of the tape in the tape cassette that is mounted in the cassette mounting portion based on the combination of the detecting switches that are depressed and not depressed.

SUMMARY

In the known printer, in addition to the detecting switches that are described above, a head holder that supports a printing head, a drive shaft that feeds the tape and an ink ribbon, and the like are provided such that they face upward from the bottom face of the cassette mounting portion. Therefore, in a case where the detecting switches are provided on the bottom face of the cassette mounting portion, the number, the positions, and the like of the detecting switches may be restricted. Consequently, Many restrictions may be imposed on the design of the printer.

Various exemplary embodiments of the broad principles derived herein provide a printer that is capable of appropriately detecting a type of a tape in a tape cassette that is mounted in the cassette mounting portion, while also ensuring a degree of freedom in the design of the printer.

The exemplary embodiments provide a printer that includes a cassette mounting portion, into which is mounted and from which is removed a tape cassette in an up-down direction, the tape cassette including a box-shaped cassette case, a tape, and an indicator portion, the cassette case being provided with a top surface, a bottom surface, a front surface and a pair of side surfaces, the tape being a printing medium that is contained in the cassette case, and the indicator portion being provided on the front surface and indicating a type of the tape; a printing head that performs printing on the tape in a case where the tape cassette has been mounted in the cassette mounting portion; a platen roller that faces the printing head and that can be pressed against the printing head through the tape; a roller holder that supports the platen roller and that can rotate, around a holder shaft that is parallel to the up-down direction, between a first position that is a position where the platen roller is pressed against the printing head and a second position that is a position where the platen roller is separated from the printing head; a sensor that detects the type of the tape that the indicator portion indicates; a sensor holder that holds the sensor between the holder shaft and the platen roller and that can move between a third position that is a position where the sensor is close to the indicator portion and a fourth position that is a position where the sensor is separated from the indicator portion; and a protective portion that is provided on the roller holder and is provided above the sensor, that, in a case where the roller holder rotates to the second position, moves to a position where it is separated from the tape cassette that is mounted in the cassette mounting portion, and that, in a case where the roller holder rotates to the first position, moves to a position where it will come into contact from below with the tape cassette that is mounted in the cassette mounting portion, wherein the roller holder, in a case where the sensor holder moves to the third position, rotates to the first position before the sensor moves close to the indicator portion, and in a case where the sensor holder moves to the fourth position, rotates to the second position after the sensor has separated from the indicator portion.

BRIEF DESCRIPTION OF THE DRAWINGS

Exemplary embodiments will be described below in detail with reference to the accompanying drawings in which:

FIG. 14 is a front view of the movable mechanism 100 that is shown in

FIG. 8;

DETAILED DESCRIPTION OF EXEMPLARY EMBODIMENTS

Figure 1:
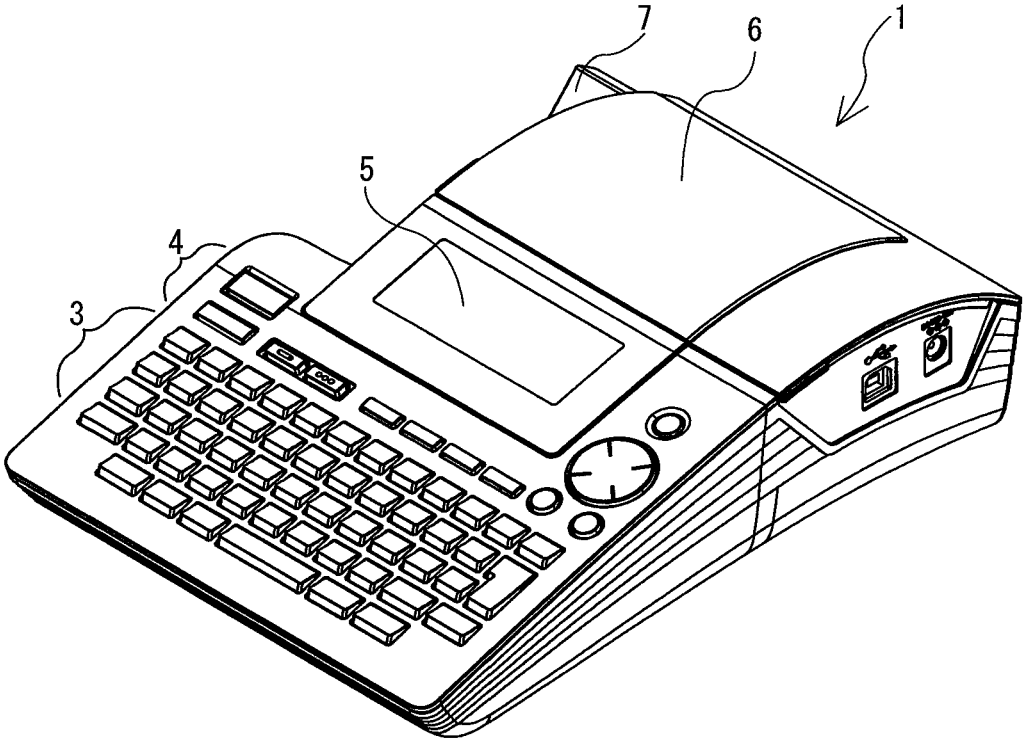
FIG. 1 is an oblique view of a printer 1 in a state in which a cover 6 is closed.

Hereinafter, embodiments of the present invention will be explained with reference to the drawings. Note that the referenced drawings are used to explain technological features that the present invention can utilize, and the device configurations and the like that are shown in the drawings are merely explanatory examples that do not limit the present invention to only those configurations and the like.

A printer 1 and a tape cassette 30 according to a first embodiment will be explained with reference to FIGS. 1 to 25. First, the overall configuration of the printer 1 will be explained with reference to FIGS. 1 and 2. In the explanation that follows, the upper right side, the lower left side, the lower right side, the upper left side, the top side, and the bottom side in FIG. 1 and FIG. 2 are respectively defined as the rear side, the front side, the right side, the left side, the top side, and the bottom side of the printer 1.

As shown in FIG. 1, a character (letters, symbols, numerals, and the like) keyboard 3 is provided on the top face of the printer 1. A power supply switch, a print key, a function key group 4, and the like are provided to the rear of the keyboard 3 (toward the upper right side of the drawing). A liquid crystal display 5 for displaying characters, symbols, and the like that are input is provided to the rear of the function key group 4. A cover 6 that can be opened and closed is provided in a rear portion of the top face of the printer 1. A tape tray 7 that receives a cut printed tape 50 (refer to FIG. 3) is provided at the left rear corner of the printer 1.

Figure 2:
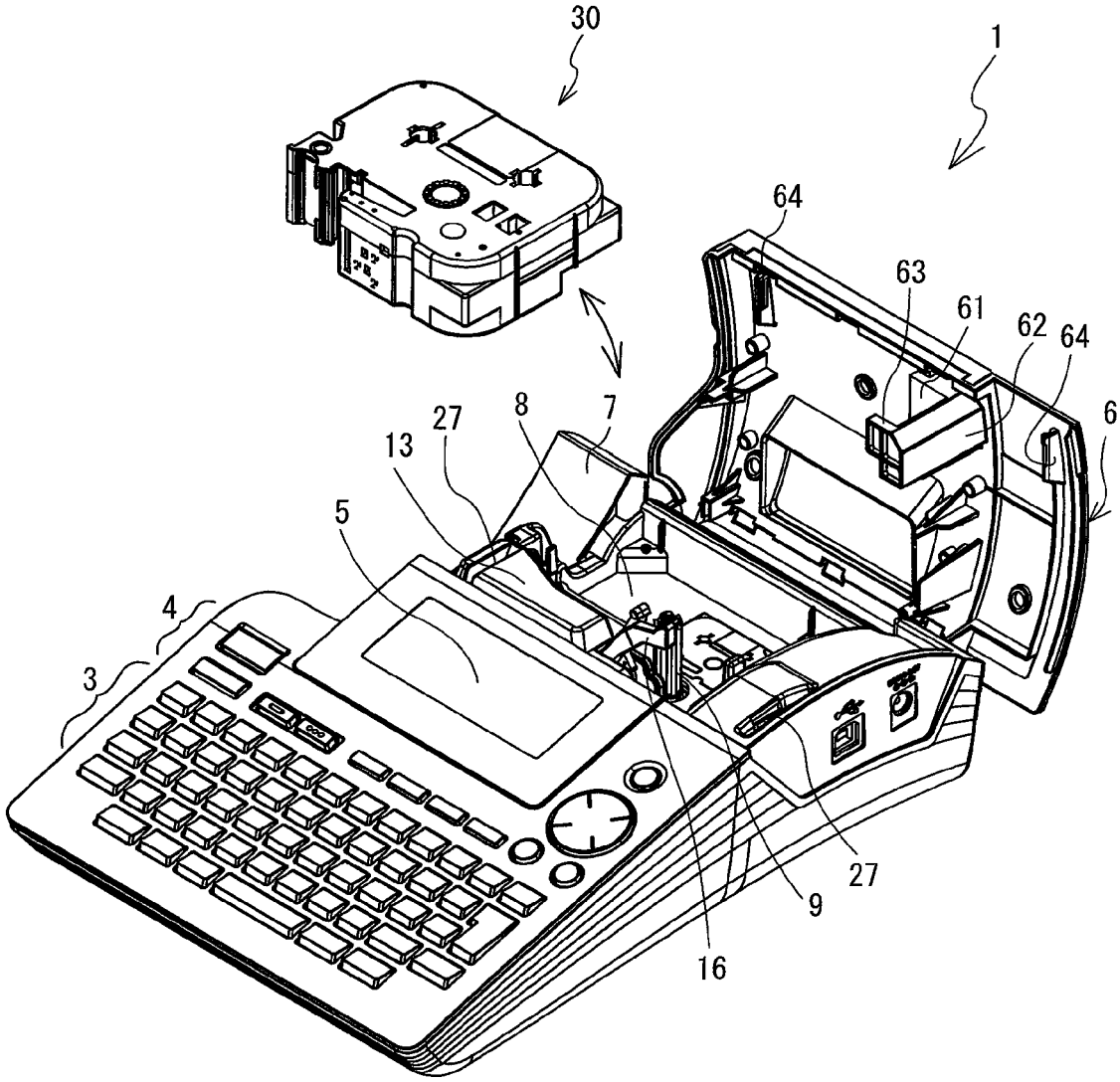
FIG. 2 is an oblique view of a tape cassette 30 and the printer 1 in a state in which the cover 6 is open.

As shown in FIG. 2, a cassette mounting portion 8 is formed to the rear of the liquid crystal display 5. The tape cassette 30 can be mounted in and removed from the cassette mounting portion 8 in the vertical (up-down) direction. A ribbon take-up shaft 9 rises vertically from the bottom of the cassette mounting portion 8. An ink ribbon 60 (refer to FIG. 4) that has been pulled out from a ribbon spool 42 (refer to FIG. 4) and used for the printing of characters and the like is taken up by the ribbon take-up shaft 9. A head holder 74 (refer to FIG. 15) that is roughly rectangular in a front view rises vertically from the bottom of the cassette mounting portion 8 in front and to the left of the ribbon take-up shaft 9. A thermal head 10 (refer to FIG. 15) that performs the printing of characters and the like on a film tape 59 (refer to FIG. 4) is attached to the front face of the head holder 74. A tape drive shaft 11 (refer to FIG. 15) for driving the feeding of the printed tape 50 rises vertically from the bottom of the cassette mounting portion 8 to the left of the head holder 74.

A roller holder 18, a sensor holder 19, a release rod 17, and the like that will be described later are disposed in front of the cassette mounting portion 8 (refer to FIG. 6). The roller holder 18, the sensor holder 19, the release rod 17, and the like are covered by a plate 13. A lever 16 that is coupled to the release rod 17 is provided to the right of the plate 13.

An arm portion 34 (refer to FIGS. 3 and 4) that will be described later is contained in a space that is formed between the head holder 74 and the roller holder 18 when the tape cassette 30 is mounted in the cassette mounting portion 8. The space that is formed within the cassette mounting portion 8 between the head holder 74 and the roller holder 18 is an arm accommodating portion 79 (refer to FIG. 15). Note that the length of the arm accommodating portion 79 in the front-rear direction is not less than a length L1 of the arm portion 34 in the front-rear direction (refer to FIGS. 16, 20, and 24), regardless the rotational position of the roller holder 18, which will be described later.

The cover 6 can be freely opened and closed, with the rear edge of the cover 6, extending in the left-right direction, serving as a pivot point. When the cover 6 is in the closed position, the cassette mounting portion 8 is closed such that the tape cassette 30 cannot be mounted or removed (refer to FIG. 1), and when the cover 6 is in the open position, the cassette mounting portion 8 is open such that the tape cassette 30 can be freely mounted and removed (refer to FIG. 2). A lever depressing portion 61 that depresses the lever 16 when the cover 6 is closed is provided on the underside of the front portion of the cover 6. A holding member 62 is provided at the right edge of the lever depressing portion 61, extending vertically downward from the underside of the cover 6. A plate-shaped projecting piece 63 extends toward the left from the lower end of the holding member 62. The projecting piece 63 extends parallel to the lever depressing portion 61 and pulls the lever 16 upward when the cover 6 is opened.

A pair of latching pieces 64, 64 are provided on the underside of the cover 6 at the edges on both sides. A pair of latching portions 27, 27 are provided on the outer sides of the cassette mounting portion 8 in a plan view. When the cover 6 is closed, the latching pieces 64, 64 engage with the latching portions 27, 27 such that the cover 6 is held in the closed position.

Next, the structure of the tape cassette 30 will be explained with reference to FIGS. 3 to 5. The tape cassette 30 according to the present embodiment is a general-purpose cassette in which various types of tapes can be mounted, such as a thermal type, a receptor type, a laminated type, and the like. In the present embodiment, tape cassette 30 is assembled as the laminated tape cassette. In the explanation that follows, the upper left side, the lower right side, the upper right side, the lower left side, the top side, and the bottom side of FIG. 3 are respectively the rear side, the front side, the right side, the left side, the top side and the bottom side of the tape cassette 30.

Figure 3:
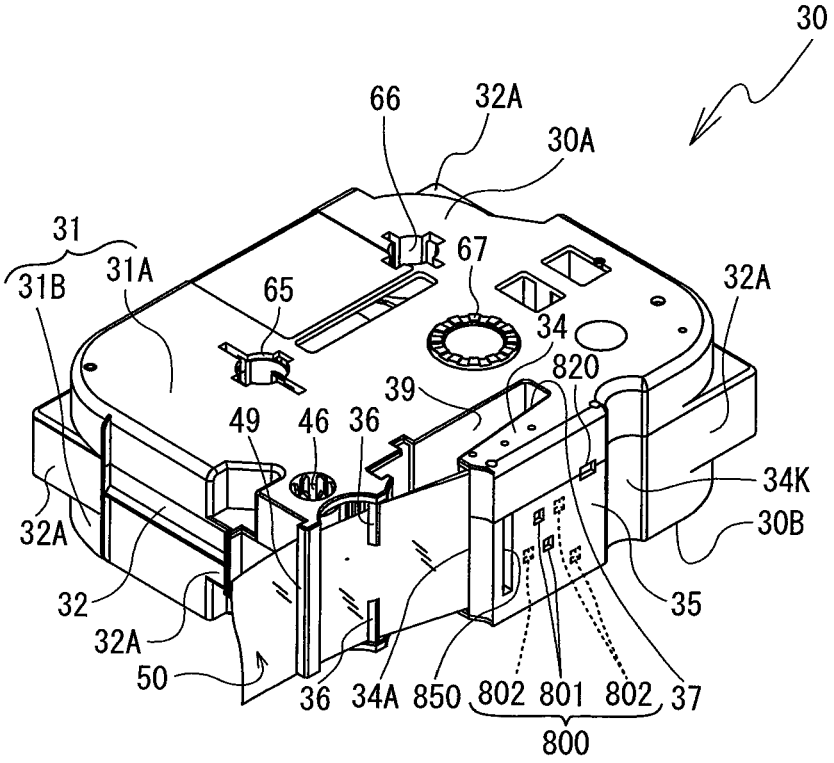
FIG. 3 is an oblique view of the tape cassette 30.

As shown in FIG. 3, the tape cassette 30 includes a cassette case 31 that, as a whole, is a roughly rectanglar (box-shaped) housing that has rounded corner portions in a plan view. The cassette case 31 includes a bottom case 31B that has a bottom surface 30B of the cassette case 31 and a top case 31A that has a top surface 30A of the cassette case 31. The top case 31A is fixed to the top of the bottom case 31B. In the explanation of the present embodiment, the distance from the bottom surface 30B to the top surface 30A is called the height dimension of the tape cassette 30 and the cassette case 31.

The cassette case 31 has corner portions 32A that have the same width (the same length in the vertical direction), regardless of the type of tape in the tape cassette 30 (for example, the tape width, the form of printing, and the like). The corner portions 32A each project outward to form a right angle when seen in a plan view. However, the lower left corner portion 32A does not form a right angle in the plan view, because a tape discharge outlet 49 is provided in the corner. The cassette case 31 includes a common portion 32 that extends around all of the side faces of the cassette case 31 (including the corner portions 32A) at the same position as the corner portions 32A in the vertical (height) direction of the cassette case 31 and has the same width as the corner portions 32A.

Figure 5:
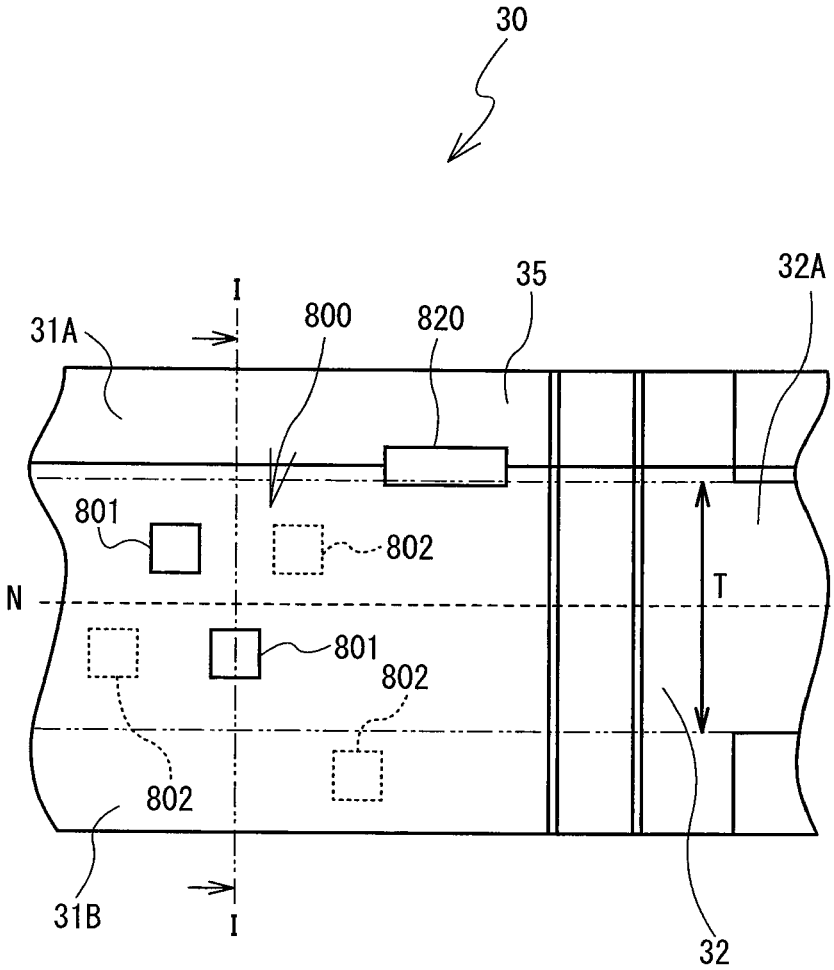
FIG. 5 is an enlarged front view of an arm front surface 35 of the tape cassette 30.

As shown in FIG. 5, the common portion 32 is a portion that is formed such that it is bilaterally symmetrical in relation to a line N that demarcates the center of the cassette case 31 in the vertical (height) direction. Note that the height dimension of the tape cassette 30 differs according to the widths of the film tape 59 and a double-sided adhesive tape 58 (that is, the width of the printed tape 50) that are contained in the cassette case 31. However, a width T of the common portion 32 (the length in the vertical direction) is set to be the same dimension regardless of the width of the printed tape 50.

For example, in a case where the width T of the common portion 32 is 12 millimeters, if the width of the printed tape 50 is greater (for example, 18 millimeters, 24 millimeters, 36 millimeters), the height dimension of the cassette case 31 is increased accordingly, but the width T of the common portion 32 remains constant. Note that in a case where the width of the printed tape 50 is not greater than the width T of the common portion 32 (for example, 6 millimeters, 12 millimeters), the height dimension of the cassette case 31 is equal to the width T of the common portion 32 plus a specified width. The height dimension of the cassette case 31 is at its smallest in this case.

As shown in FIG. 3, support holes 65, 66 and 67 are provided in both the top case 31A and the bottom case 31B that rotatably support spools that will be explained later. Only the support holes 65, 66 and 67 formed in the top case 31A are shown in FIG. 3, but the support holes 65, 66 and 67 are also formed in the same way in the bottom case 31B.

Figure 4:
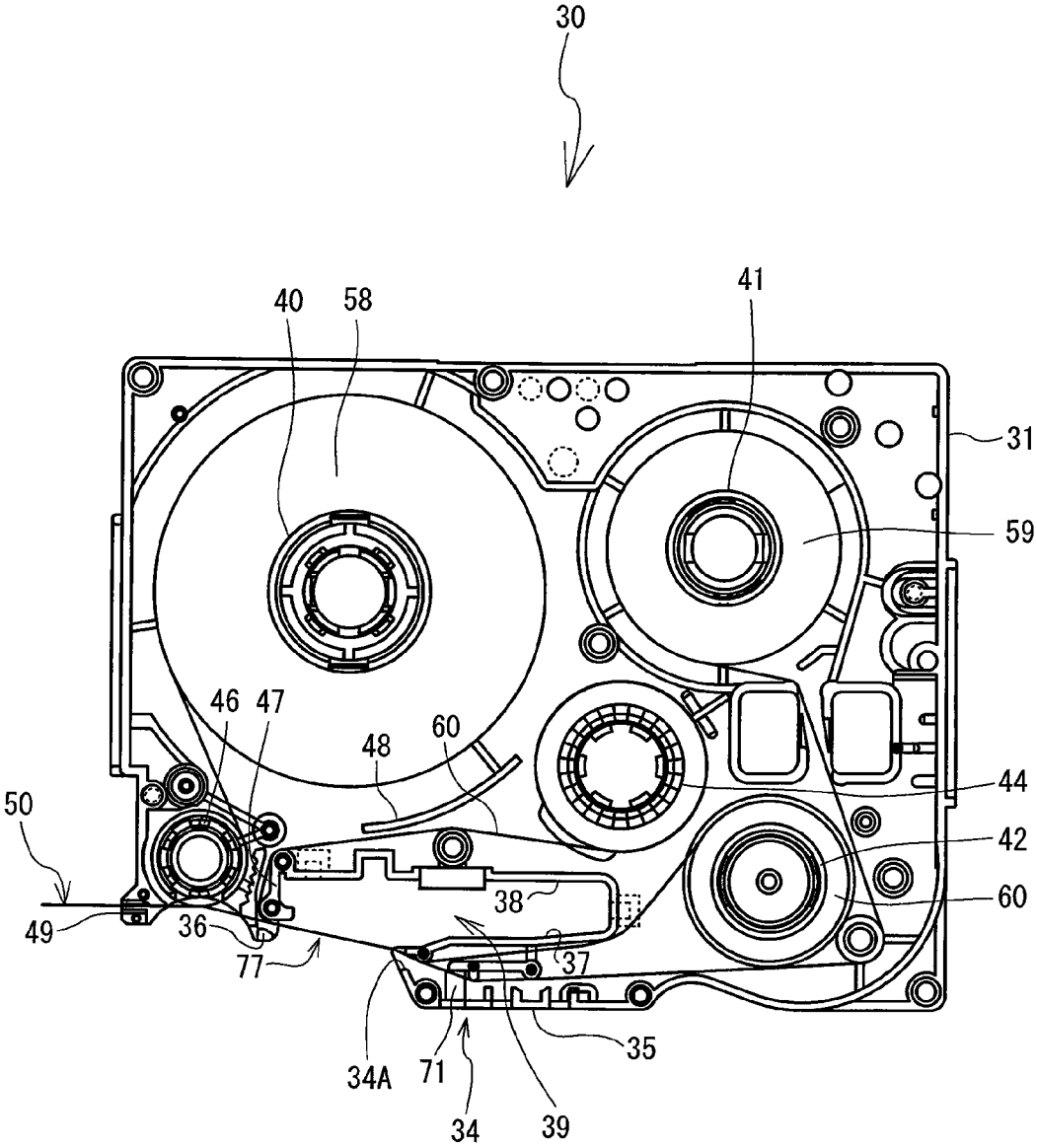
FIG. 4 is a plan view of the tape cassette 30 in a state in which a top case 31A has been removed.

As shown in FIG. 4, three types of tape rolls are contained in the cassette case 31, namely the double-sided adhesive tape 58, which is wound on a first tape spool 40, the transparent film tape 59, which is wound on a second tape spool 41, and the ink ribbon 60, which is wound on the ribbon spool 42. The double-sided adhesive tape 58 is a double-sided tape, with a release paper adhering to one side and the other side being stuck to the printed surface of the printed film tape 59.

The first tape spool 40, on which the double-sided adhesive tape 58 is wound with the release paper facing outward, is disposed inside the left rear portion of the cassette case 31 such that it can be rotated through the support holes 65. The second tape spool 41, on which the film tape 59 is wound, is disposed inside the right rear portion of the cassette case 31 such that it can be rotated through the support holes 66. The ink ribbon 60, which is wound on the ribbon spool 42, is disposed inside the right front of the cassette case 31 such that the ribbon spool 42 can be rotated.

Between the first tape spool 40 and the ribbon spool 42 in the cassette case 31, a ribbon take-up spool 44 is disposed such that it can be rotated through the support holes 67. The ribbon take-up spool 44 pulls out the ink ribbon 60 from the ribbon spool 42 and takes up the ink ribbon 60 that has been used to print characters and the like. Note that a clutch spring (not shown in the drawings) is attached to a lower portion of the ribbon take-up spool 44 to prevent loosening of the taken up ink ribbon 60 due to reverse rotation of the ribbon take-up spool 44.

As shown in FIG. 3, a semi-circular groove 34K that has a cross-sectional semi-circular shape in a plan view is provided in the front surface of the cassette case 31, extending over the entire height of the cassette case 31 (from the top surface 30A to the bottom surface 30B). The semi-circular groove 34K is a recessed portion that is provided such that a holder shaft 181 that is a shaft support portion of the roller holder 18 (refer to FIG. 6) will not interfere with the cassette case 31 when the tape cassette 30 is installed in the cassette mounting portion 8.

A section of the front surface of the cassette case 31 that extends to the left from the semi-circular groove 34K is called an arm front surface 35. A portion that is defined by the arm front surface 35 and by an arm rear surface 37 and that extends to the left from the right portion of the tape cassette 30 is called an arm portion 34. The arm rear surface 37 is provided in a position that is to the rear of and separated from the arm front surface 35, and it extends over the entire height of the cassette case 31.

As shown in FIG. 4, the film tape 59 that is pulled out from the first tape spool 41 and the ink ribbon 60 that is pulled out from the ribbon spool 42 are guided together inside the arm portion 34. The tip of the arm front surface 35 bends toward the rear. An opening 34A is formed by the tips of the arm front surface 35 and the arm rear surface 37. The film tape 59 and the ink ribbon 60 are joined together at the opening 34A and are discharged toward an exposing portion 77 that will be described later. Note that a pair of tape restricting portions 71 that restrict the movement of the film tape 59 in the vertical direction (that is, the width direction) are provided along the feed path for the film tape 59 within the arm portion 34.

A space that is bounded by the arm rear surface 37 and an inner perimeter wall 38 that extends continuously from the arm rear surface 37 is a head insertion portion 39. The head insertion portion 39 is continuous with the outside at the front side of the tape cassette 30, through the exposing portion 77 that is formed in the front side of the tape cassette 30. In a case where the tape cassette 30 has been mounted in the cassette mounting portion 8 (refer to FIG. 2), the head holder 74 (refer to FIG. 15) is inserted into the head insertion portion 39, and the arm portion 34 is accommodated in the arm accommodating portion 79.

Figure 15:
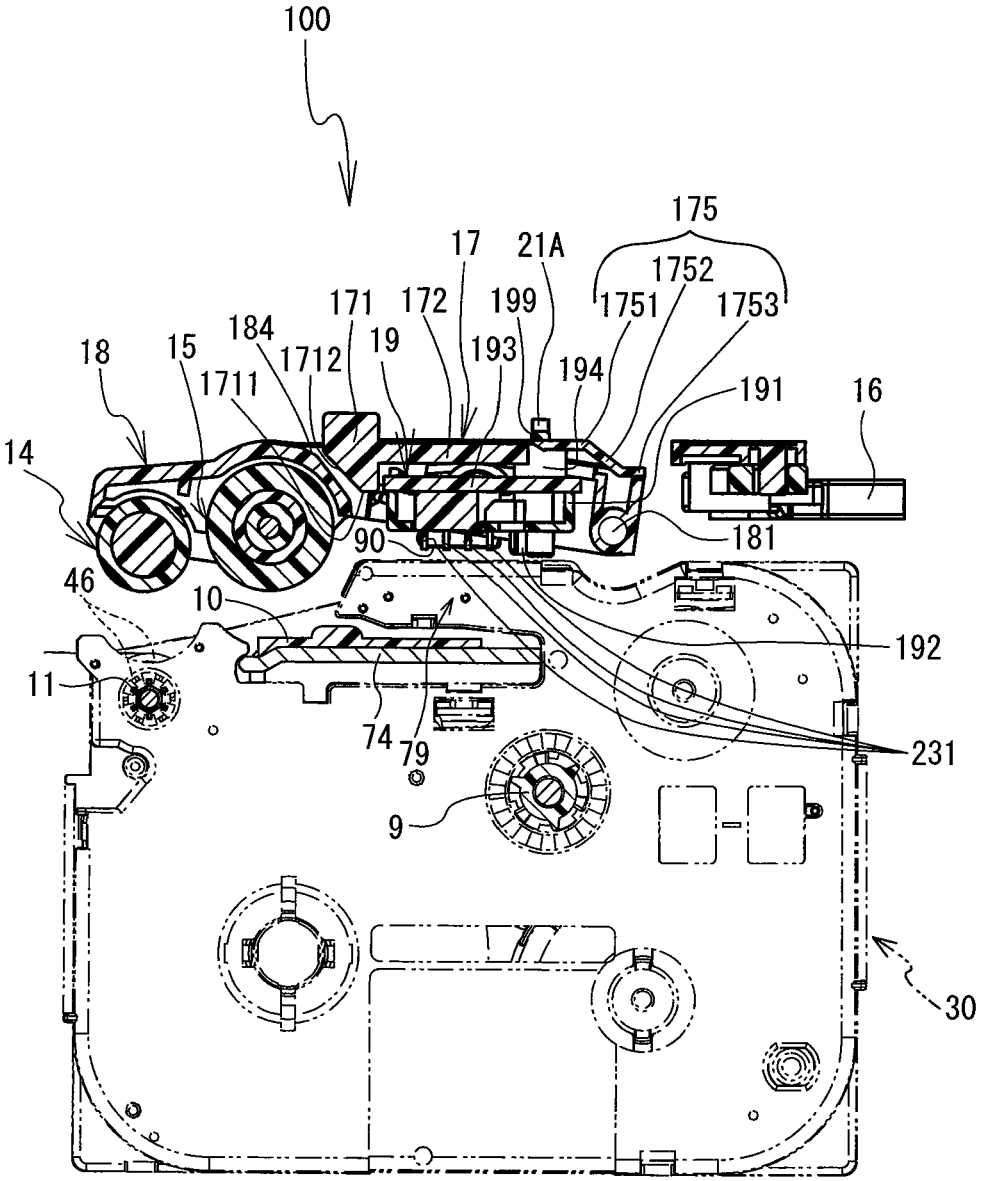
FIG. 15 is a sectional view of the movable mechanism 100 in the direction of the broken line II-II in FIG. 14, and a bottom plan view that shows the tape cassette 30, a tape drive shaft 11, and a head holder 74.
Figure 16:
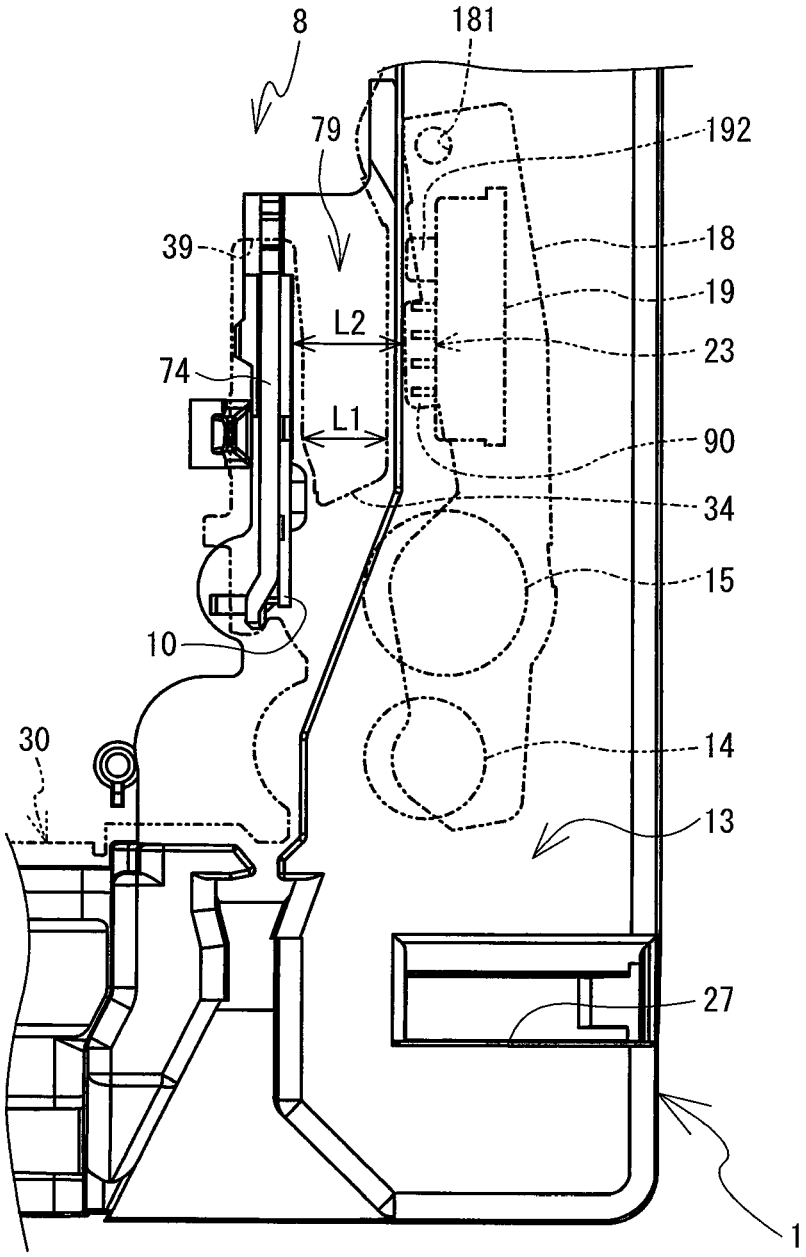
FIG. 16 is an enlarged plan view of the area around the roller holder 18, the sensor holder 19, and the head holder 74 in FIG. 15.
Figure 17:
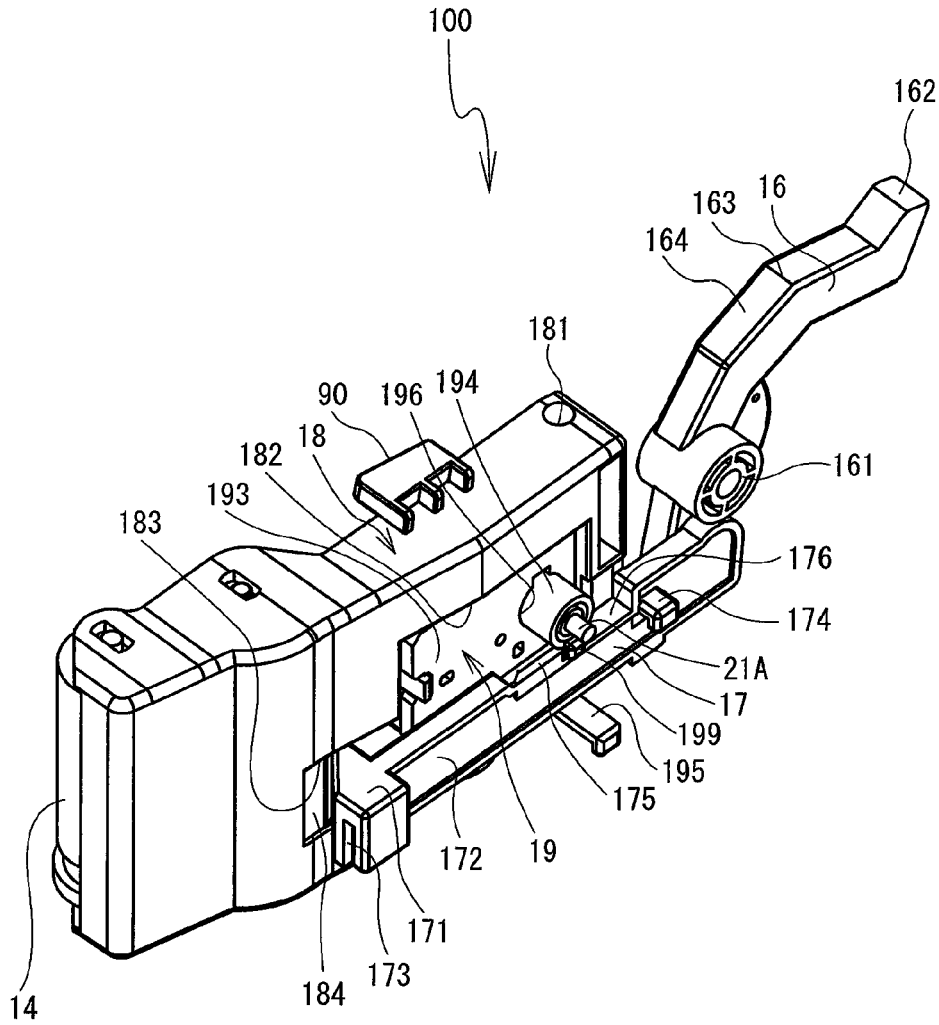
FIG. 17 is an oblique view of the movable mechanism 100 from which the wall 20 has been removed, as seen obliquely from the front in a state in which the cover 6 is in the process of being opened/closed.

One surface of the film tape 59 that is discharged from the opening 34A is exposed to the front at the exposing portion 77, and the other surface faces the thermal head 10 to the rear (refer to FIG. 15). In the present embodiment, the other surface of the film tape 59 faces the thermal head 10 with the ink ribbon 60 between the film tape 59 and the thermal head 10. At the exposing portion 77, the printing on the film tape 59 is performed by the thermal head 10 using the ink ribbon 60.

As shown in FIGS. 3 and 4, a tape drive roller 46 is rotatably supported on the feed path for the film tape 59 and the ink ribbon 60 extending from the opening 34A to the tape discharge outlet 49, on the downstream side of the head insertion portion 39. The tape drive roller 46 is rotationally driven by the tape drive shaft 11 (refer to FIG. 18), which is inserted into the tape drive roller 46. The tape drive roller 46 moves in concert with a movable feed roller 14 (refer to FIG. 19) that is positioned opposite the tape drive roller 46, pulling the film tape 59 out from the second tape spool 41 and pulling the double-sided adhesive tape 58 out from the first tape spool 40, such that the double-sided adhesive tape 58 is guided to and affixed to the printed surface of the film tape 59.

An upper-lower pair of restraining members 36 are provided on the upstream side of the tape drive roller 46. The base portions of the restraining members 36 restrain the printed film tape 59 in the vertical direction (the tape width direction) on the downstream side of the thermal head 10 and guide the printed film tape 59 toward the tape discharge outlet 49. The film tape 59 and the double-sided adhesive tape 58 are thus bonded together properly without any positional displacement occurring.

A guide wall 47 stands in the vicinity of the restraining members 36. The guide wall 47 separates the used ink ribbon 60 from the film tape 59 after the ink ribbon 60 has been fed through the head insertion portion 39 and guides the used ink ribbon 60 toward the ribbon take-up spool 44. A separating wall 48 stands between the guide wall 47 and the ribbon take-up spool 44. The separating wall 48 prevents the used ink ribbon 60 that is guided along the guide wall 47 and the double-sided adhesive tape 58 that is wound on and supported by the first tape spool 40 from coming into contact with one another.

As shown in FIGS. 3 and 5, an arm indicator portion 800 that indicates the type of tape in the tape cassette 30 is provided on the arm front surface 35 adjacent to the right side of the exposing portion 77. The arm indicator portion 800 includes indicators, each of which is one of a non-pressing portion 801 and a pressing portion 802 in a specific pattern that corresponds to the type of tape. The non-pressing portion 801 is an aperture that is rectangular in a front view and allows one of a plurality of switch terminals 231 (refer to FIG. 9) to be inserted and removed. The pressing portion 802 is a planar portion that comes into contact with one of the switch terminals 231. In the present embodiment, the arm indicator portion 800 has one of the non-pressing portion 801 and the pressing portion 802 in each of five positions that correspond to five of the switch terminals 231. Hereinafter, in a case where the non-pressing portion 801 and the pressing portion 802 are referred to collectively, and when neither is explicitly specified, they are simply called indicators.

In the arm indicator portion 800 according to the present embodiment, the plurality of indicators are arranged in a plurality of rows, counting in the vertical direction, such that at least one of the indicators forms a row in a direction (the horizontal direction) that is orthogonal to the direction in which the tape cassette 30 is mounted and removed (that is, the vertical direction) and a line that connects one of the indicators to another of the indicators intersects with the vertical direction. More specifically, the five indicators are arranged in three rows in a zigzag pattern, such that every indicator is in a different position in the left-right direction and no two indicators overlap in the up-down direction. Note that a number of rows other than three (for example, no more than two rows or at least four rows) may also be set, counting in the vertical direction of the tape cassette 30, in accordance with one of the width dimension of the tape cassette 30 and the width of the tape. The manner in which the type of tape is detected using the arm indicator portion 800 and mechanical sensors 23 (refer to FIG. 9) will be described separately later.

Figure 23:
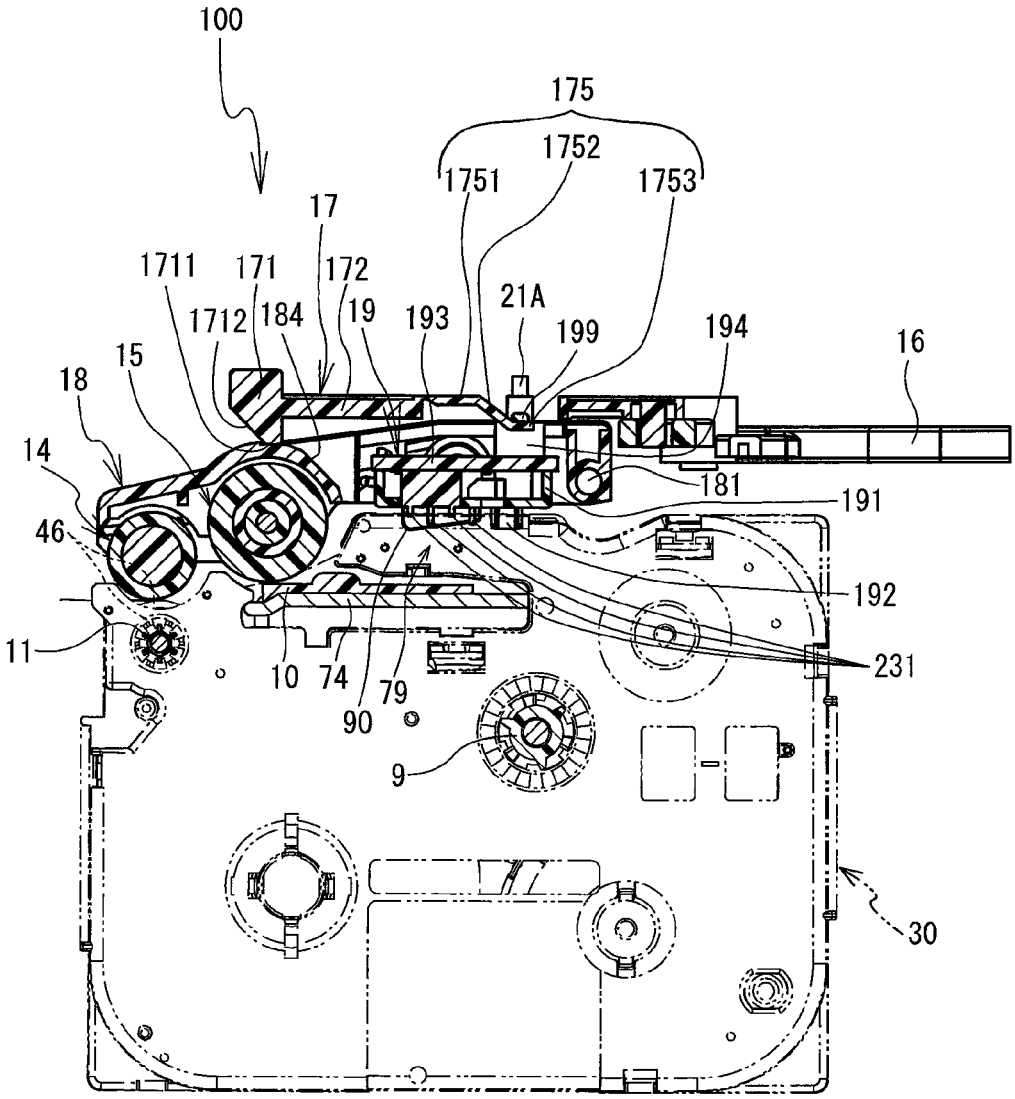
FIG. 23 is a sectional view of the movable mechanism 100 in the direction of the broken line IV-IV in FIG. 22, and a bottom plan view that shows the tape cassette 30, the tape drive shaft 11, and the head holder 74.
Figure 24:
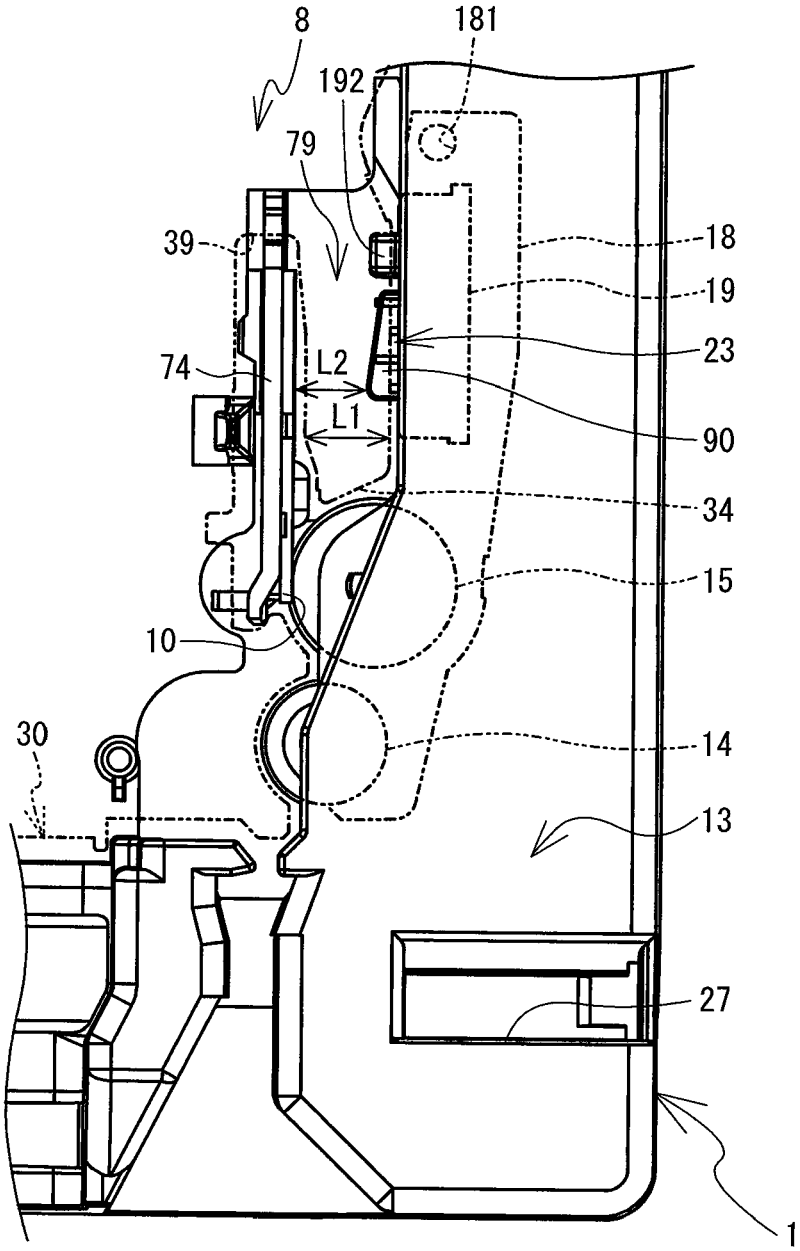
FIG. 24 is an enlarged plan view of the area around the roller holder 18, the sensor holder 19, and the head holder 74 in FIG. 23.

A latching hole 820 is provided on the arm front surface 35 on the upper right side of the arm indicator portion 800. The latching hole 820 is a hole (refer to FIG. 25) into which a latching piece 192 (refer to FIGS. 9 and 10) is inserted in a case where the sensor holder 19, which will be described later, is moved to an identification position (a position that is shown in FIG. 23). More specifically, the latching hole 820 is a roughly rectangular through hole, with its long sides extending in the left-right direction in a front view, straddling the portion where the top case 31A and the bottom case 31B are joined and extending toward the right from above the indicator that is positioned the farthest to the right on the arm indicator portion 800 (in the example in FIG. 5, the pressing portion 802 in the lowest row).

As shown in FIG. 3, a through hole 850 that is vertically rectangular in a front view is provided in the arm front surface 35, to the left of the arm indicator portion 800 on the bottom case 31B. The through hole 850 is provided as a relief hole for a die that is used in the molding of the cassette case 31 and does not have any particular function.

The overall configuration of a movable mechanism 100 that is provided in the printer 1 will be explained with reference to FIG. 6. The movable mechanism 100 is a set of mechanisms that move in response to external pressure and includes the lever 16, the release rod 17, the roller holder 18, the sensor holder 19 and a wall 20 that will be described later (refer to FIG. 7).

Figure 6:
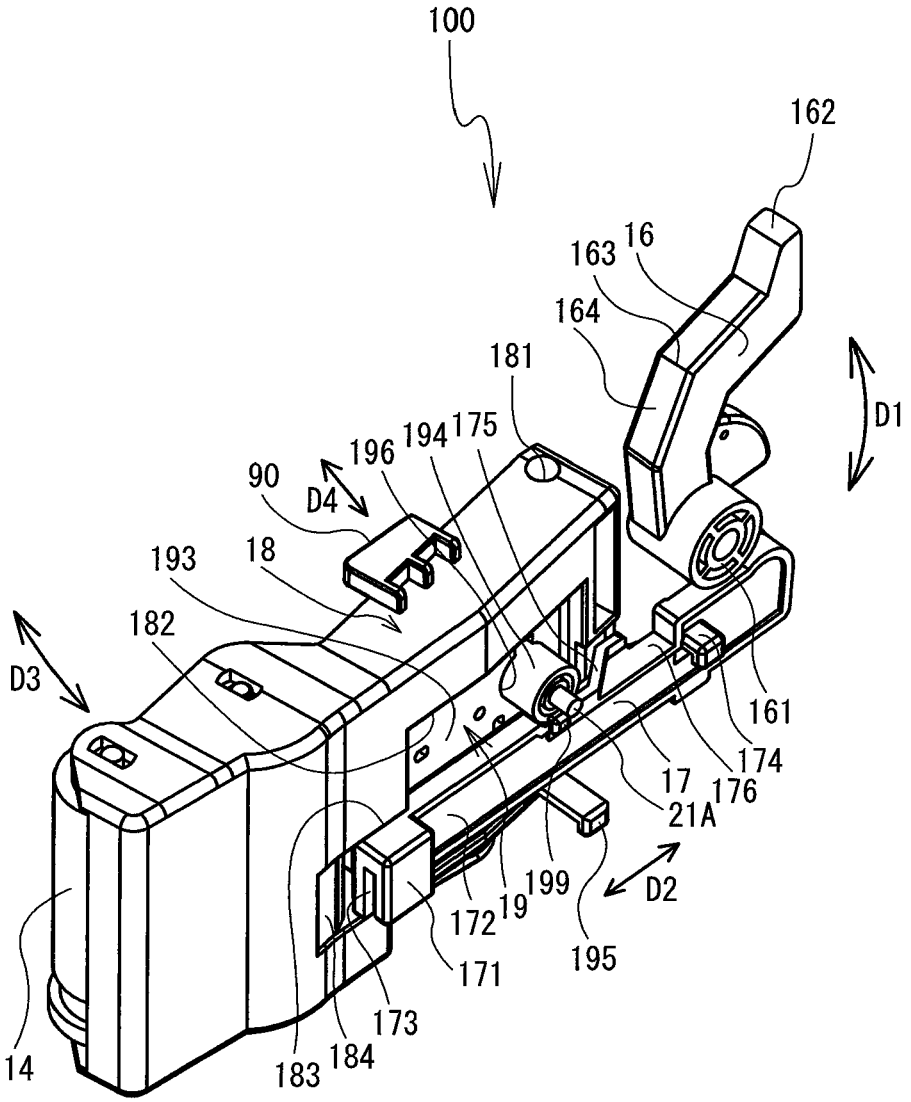
FIG. 6 is an oblique view of a movable mechanism 100 from which a wall 20 has been removed, as seen obliquely from the front in a state in which the cover 6 is open.

In the present embodiment, the lower right side, the upper left side, the upper right side, the lower left side, the top side and the bottom side in FIG. 6 correspond, respectively, to the front side, the rear side, the right side, the left side, the top side and the bottom side of the movable mechanism 100. In order to make the operating modes of the movable mechanism 100 easier to understand, the lever depressing portion 61, the holding member 62, and the projecting piece 63 that are provided on the cover 6 (refer to FIG. 2) have been omitted from FIG. 6 (the same is also true for FIGS. 14 to 24). The wall 20 and a spring member 22 (refer to FIGS. 7 and 8) have also been omitted from FIG. 6 (the same is also true for FIGS. 14, 15, 17 to 19, and 21 to 23).

A user opens the cover 6 upward when mounting the tape cassette 30 in and removing the tape cassette 30 from the cassette mounting portion 8. In a case where printing will be performed by the printer 1, the user closes the cover 6 downward. In accordance with the opening and closing operations of the cover 6, the lever 16 rotates up and down (rotation directions D1 shown in FIG. 6) around a lever shaft 161. As will be described in detail later, the lever 16 rotates upward as the cover 6 is opened upward. The lever 16 rotates downward as the cover 6 is closed downward.

The lower end of the lever 16 is engaged with the plate-shaped release rod 17, whose long dimension extends in the left-right direction in a front view. The release rod 17 moves to the left and the right (movement directions D2 shown in FIG. 6) in accordance with the rotation of the lever 16. As will be described in detail later, the release rod 17 moves to the left (the lower left in FIG. 6) when the lever 16 rotates downward (downward in FIG. 6). The release rod 17 moves to the right (the upper right in FIG. 6) when the lever 16 rotates upward (upward in FIG. 6).

The roller holder 18, which is a box-shaped unit that is open to the rear, is provided to the rear of the release rod 17 (the upper left in FIG. 6). A platen roller 15 (refer to FIG. 9) and the movable feed roller 14 are provided in the interior of the roller holder 18. The roller holder 18 is supported such that it can rotate around the holder shaft 181. The movable feed roller 14 is rotatably supported at the left end of the roller holder 18 such that the roller surface is exposed to the rear. To the right of the movable feed roller 14, the platen roller 15 is rotatably supported such that the roller surface is exposed to the rear. The movable feed roller 14 and the platen roller 15 are arranged in positions that are respectively opposite the tape drive roller 46 and the thermal head 10 (refer to FIG. 15).

The roller holder 18 is constantly elastically urged toward the front (the lower right in FIG. 6) by an urging spring (not shown in the drawings). In accordance with the movements of the release rod 17 to the left and right (the movement directions D2), the roller holder 18 rotates toward the front and rear (rotation directions D3 shown in FIG. 6) around the holder shaft 181. As will be described in detail later, in a case where the release rod 17 moves to the left, the roller holder 18 rotates toward the rear (the upper left in FIG. 6) against the urging force of the urging spring. In a case where the release rod 17 moves to the right, the roller holder 18 is rotated toward the front (the lower right in FIG. 6) by the urging force of the urging spring.

A first holder opening edge 182 that forms a roughly rectangular opening in a front view is provided between the holder shaft 181 and the platen roller 15 in the roller holder 18. The sensor holder 19 is provided to the rear of the release rod 17 and to the inside of the first holder opening edge 182. A plurality of mechanical sensors 23, each of which is provided with one of the switch terminals 231 that protrude toward the rear (the upper left in FIG. 6), are provided on the sensor holder 19 (refer to FIG. 9).

The plurality of mechanical sensors 23 are arranged in positions that correspond to the positions of the plurality of indicators that are provided on the arm indicator portion 800. The sensor holder 19 moves toward the front and the rear (movement directions D4 shown in FIG. 6), in accordance with the movements of the release rod 17 to the right and left (the movement directions D2). As will be described in detail later, in a case where the release rod 17 moves to the left, the sensor holder 19 moves toward the rear (the upper left in FIG. 6). In a case where the release rod 17 moves to the right, the sensor holder 19 moves toward the front (the lower right in FIG. 6). The sensor holder 19 is not fixed to the roller holder 18 and can therefore move independently of the roller holder 18.

According to the configuration that is described above, in the movable mechanism 100 according to the present embodiment, when the cover 6 is closed downward, the roller holder 18 rotates toward the rear, and the sensor holder 19 moves toward the rear. When the roller holder 18 rotates toward the rear, the platen roller 15 is pressed against the thermal head 10, and the movable feed roller 14 is pressed against the tape drive roller 46. When the sensor holder 19 moves toward the rear, the switch terminals 231 of the mechanical sensors 23 are pressed against the arm indicator portion 800. It is thus possible, in the printer 1, to perform a printing operation using the tape cassette 30 that has been mounted in the cassette mounting portion 8, and it is also possible to specify the type of tape in the tape cassette 30.

When the cover 6 is opened upward, the roller holder 18 rotates toward the front, and the sensor holder 19 moves toward the front. When the roller holder 18 rotates toward the front, the platen roller 15 is separated from the thermal head 10, and the movable feed roller 14 is separated from the tape drive roller 46. When the sensor holder 19 moves toward the rear, the switch terminals 231 of the mechanical sensors 23 are separated from the arm indicator portion 800. It is thus freely possible, in the printer 1, to mount the tape cassette 30 in the cassette mounting portion 8 and remove the tape cassette 30 from the cassette mounting portion 8.

Figure 7:
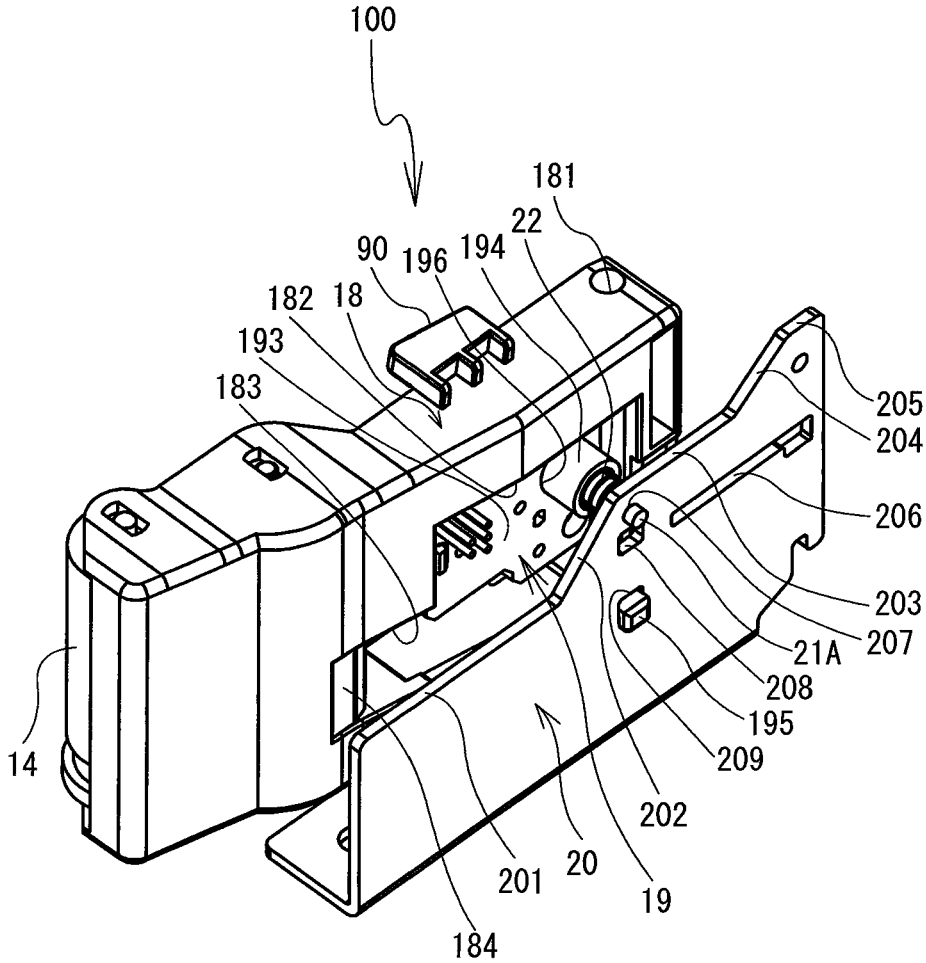
FIG. 7 is an oblique view of the movable mechanism 100 from which a lever 16 and a release rod 17 have been removed, as seen obliquely from the front in a state in which the cover 6 is closed.

The physical configuration of the individual members that are included in the movable mechanism 100 will be explained in detail with reference to FIGS. 6 to FIG. 10. FIG. 7 shows the movable mechanism 100 from the same direction as in FIG. 6. However, in FIGS. 7 and 8, in order to make the linked structure of the movable mechanism 100 easier to understand, the movable mechanism 100 is shown in a state in which the roller holder 18 is in a printing position (the position shown in FIG. 23), and the sensor holder 19 is in the identification position (the position shown in FIG. 23). Further, the movable mechanism 100 is shown in FIG. 7 with the lever 16 and the release rod 17 removed.

The physical configuration of the lever 16 will be explained with reference to FIG. 6. The lever 16 has a specified thickness and width and is curved such that, in a front view, it describes a roughly circular arc that extends toward the upper right. The lever shaft 161 that supports the lever 16 such that the lever 16 can rotate is provided at the lower end of the lever 16. A lever projection 162 that projects upward is provided on the upper end of the lever 16. A top surface curved portion 163 and a contact surface 164 are provided to the lower left from the lever projection 162. The top surface curved portion 163 is a corner portion that is formed on the outer side of the lever 16 in the direction of the curvature. The contact surface 164 is a flat portion that is connected to the lower side of the top surface curved portion 163. The lever projection 162, the top surface curved portion 163 and the contact surface 164 are all portions that come into contact with the lever depressing portion 61 when the cover 6 is closed (refer to FIG. 2), and they will be explained in detail later.

The physical configuration of the release rod 17 will be explained with reference to FIGS. 6, 7, and 15. FIG. 15 shows a horizontal cross section of the movable mechanism 100 when the printer 1 is seen in a bottom plan view and shows the tape cassette 30 depicted by broken lines (lines of alternate long and two short dashes).

The release rod 17 is engaged with the lower edge of the lever shaft 161 of the lever 16. The release rod 17 is provided with a pressing portion 171 and a body portion 172. The body portion 172 has a specified thickness and height and forms a rectangular cylinder whose long dimension extends in the left-right direction. The pressing portion 171 is a head portion that is formed on the left end of the body portion 172.

The pressing portion 171 causes the roller holder 18 to rotate in the front-rear direction (the up-down direction in FIG. 15). The pressing portion 171 has a shape that projects toward the front and the rear from the body portion 172 in a plan view, so the length of the pressing portion 171 in the front-rear direction (that is, its thickness) is greater than that of the body portion 172. A slanting surface is formed that extends across the rear face of the pressing portion 171 from the left side face, such that the length of the pressing portion 171 in the left-right direction in a plan view gradually diminishes as one moves rearward from the position of the body portion 172 in the front-rear direction (downward in FIG. 15). A rear surface portion that is formed parallel to the left-right direction of the pressing portion 171 is a rear surface 1711. In the pressing portion 171, the slanting surface that extends toward the front left from the left edge of the rear surface 1711 is a slanting surface 1712.

A concavity 176 is provided in the top surface of the body portion 172. The concavity 176 is provided within a specified range that extends toward the right from a roughly central position in the left-right direction of the body portion 172. The concavity 176 is formed as an indentation whose height position is slightly lower than the top surface. A rod guide portion 175 that guides the sensor holder 19 in the front-rear direction is formed on the top surface of the concavity 176. The rod guide portion 175 has a first rod guide portion 1751, a rod guide diagonal portion 1752, and a second rod guide portion 1753.

The first rod guide portion 1751 is a standing wall that is provided along the front edge of the concavity 176. The first rod guide portion 1751 extends from the left end of the concavity 176 to a position slightly to the left of the center of the concavity 176. The second rod guide portion 1753 is a standing wall that is provided along the rear edge of the concavity 176. The second rod guide portion 1753 extends to the right from a position slightly to the right of the center of the concavity 176. The rod guide diagonal portion 1752 is a standing wall that is provided in the concavity 176 such that it diagonally links the right end of the first rod guide portion 1751 and the left end of the second rod guide portion 1753 in a plan view. The first rod guide portion 1751, the rod guide diagonal portion 1752 and the second rod guide portion 1753 each have the same thickness and height, and the overall appearance of the rod guide portion 175 is rail-shaped.

A first guide portion 174 is provided on the front surface of the body portion 172, on the lower right side when seen from the right end of the concavity 176. The first guide portion 174 is a claw that projects toward the front from the front surface of the body portion 172, with its forward end bent in downward. A second guide portion 173 is provided on the pressing portion 171. The second guide portion 173 extends from the left surface to the right surface of the pressing portion 171. The second guide portion 173 is a groove-shaped concavity that extends upward from the bottom surface of the pressing portion 171. The second guide portion 173 is located toward the front from the body portion 172. The first guide portion 174 and the second guide portion 173 guide the movement of the release rod 17 to the left and right.

Figure 8:
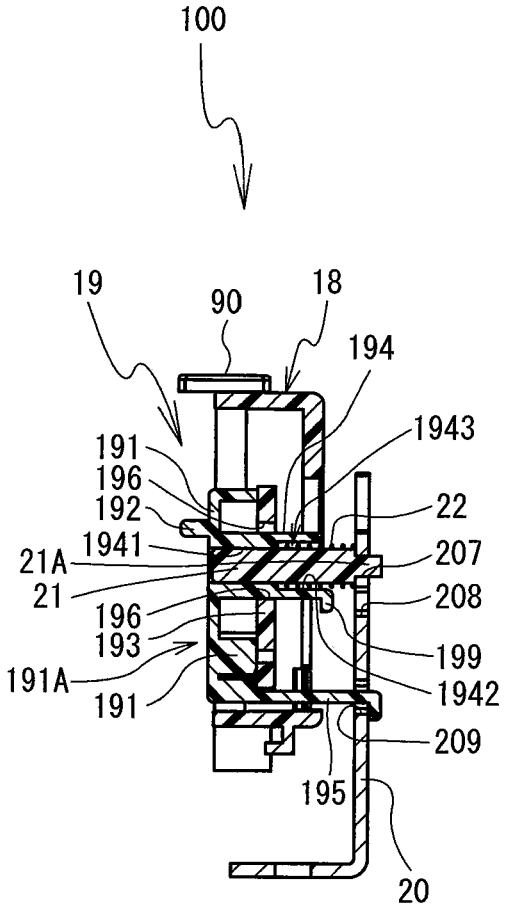
FIG. 8 is a vertical sectional view of the movable mechanism 100 that is shown in FIG. 7.
Figure 9:
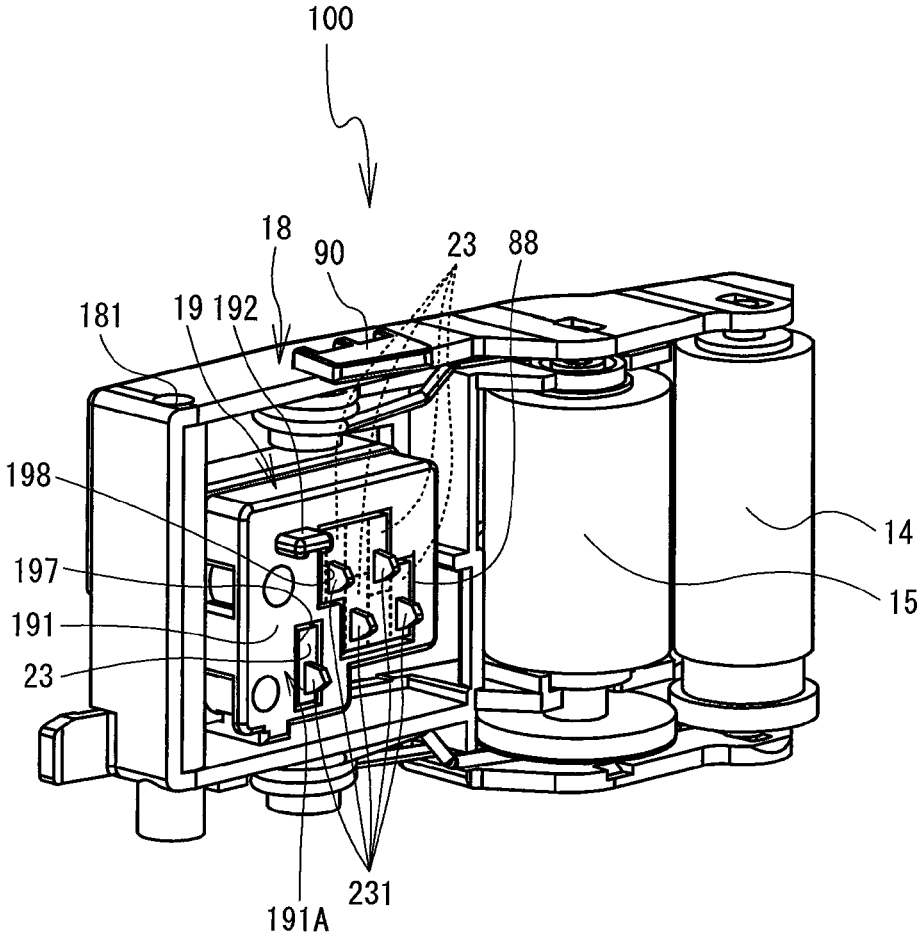
FIG. 9 is an oblique view of a roller holder 18 and a sensor holder 19 of the movable mechanism 100, as seen obliquely from the rear.
Figure 10:
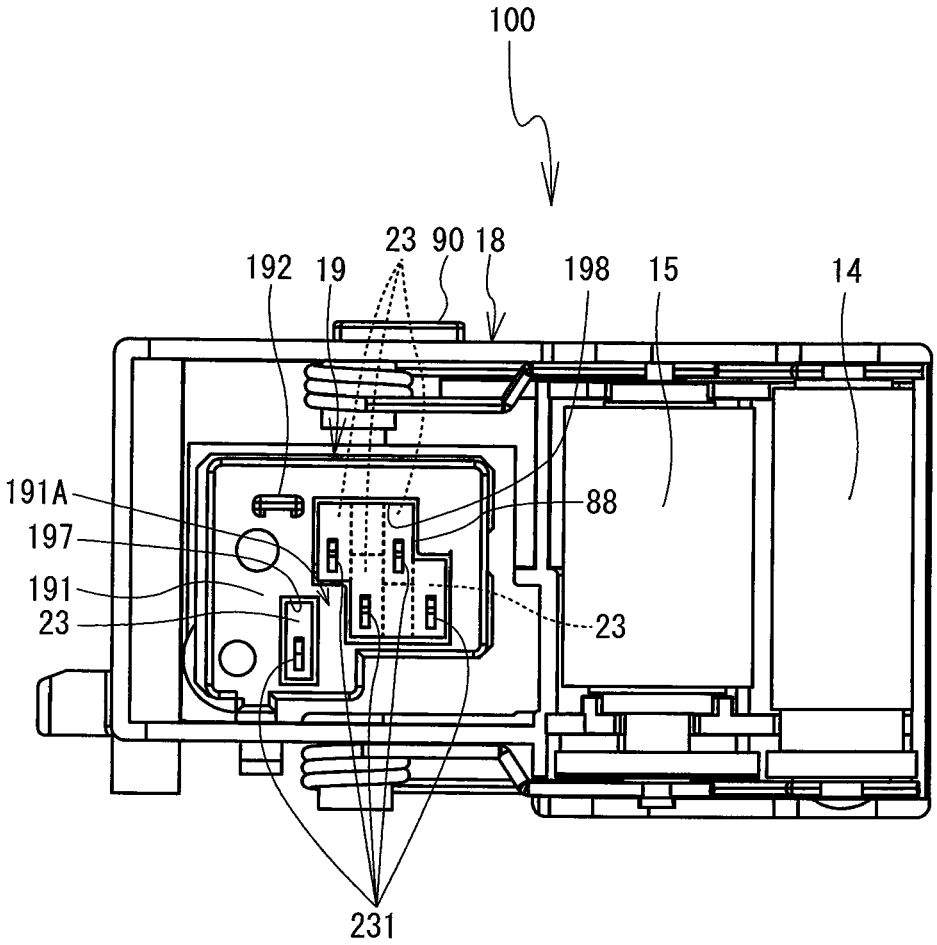
FIG. 10 is a rear view of the roller holder 18 and the sensor holder 19 of the movable mechanism 100.

The physical configuration of the wall 20 will be explained with reference to FIGS. 7 and 8. The wall 20 is a plate-shaped member that is long in the left-right direction, and stands to the front of the release rod 17 in the printer 1 (the lower right in FIG. 7). The upper edge of the wall 20 has a first upper edge portion 201, a second upper edge portion 202, a third upper edge portion 203, a fourth upper edge portion 204, and a fifth upper edge portion 205, in order from the left end to the right end of the wall 20 (from the lower left to the upper right in FIG. 7).

The first upper edge portion 201 is an edge portion that is parallel to the left-right direction of the printer 1, and it is formed such that it extends in the left-right direction of the wall 20, from the left end of the wall 20 to a position slightly to the left of the center of the wall 20. The third upper edge portion 203 is an edge portion that is parallel to the left-right direction of the printer 1 and higher than the first upper edge portion 201, and it is formed such that it extends from a position slightly to the right of the center of the wall 20 to a position slightly to the left of the right end of the wall 20. The fifth upper edge portion 205 is an edge portion that is parallel to the left-right direction of the printer 1 and higher than the third upper edge portion 203, and it is formed at the right end of the wall 20 in the left-right direction. The second upper edge portion 202 is an edge portion that diagonally links the first upper edge portion 201 and the third upper edge portion 203, which are at different height positions. The fourth upper edge portion 204 is an edge portion that diagonally links the third upper edge portion 203 and the fifth upper edge portion 205, which are at different height positions.

A long hole 206 is formed below the third upper edge portion 203, the fourth upper edge portion 204, and the fifth upper edge portion 205. The long hole 206 is a slot-shaped through hole that extends in the left-right direction. A round hole 207 that is a circular hole in a front view, is provided below the left end of the third upper edge portion 203. A first rectangular hole 208 that is a horizontally long rectangular hole in a front view is provided below the round hole 207. A second rectangular hole 209 that is a horizontally long rectangular hole in a front view is provided below the first rectangular hole 208.

The first guide portion 174 of the release rod 17 is engaged with the long hole 206 such that it can slide, and the second guide portion 173 is engaged with the first upper edge portion 201 such that it can slide. The first guide portion 174 is guided along the long hole 206, and the second guide portion 173 is guided along the first upper edge portion 201, thus moving the release rod 17 to the left and the right.

The physical configuration of the roller holder 18 will be explained with reference to FIGS. 6 to 10 and 15. As described above, the roller holder 18 is provided to the rear of the release rod 17 and holds the movable feed roller 14 and the platen roller 15 such that they can rotate. The first holder opening edge 182 is provided between the holder shaft 181 and the platen roller 15 in the left-right direction. A second holder opening edge 183 that forms an opening is formed such that it is continuous with the left end of the first holder opening edge 182. The second holder opening edge 183 is a roughly rectangular opening edge in a front view and is smaller than the first holder opening edge 182. The first holder opening edge 182 and the second holder opening edge 183 connect to form a single opening edge.

A holder side pressed portion 184 is provided to the rear of the second holder opening edge 183. The holder side pressed portion 184 extends from the front side of the platen roller 15 toward the right rear (the lower right in FIG. 15) and has a curved surface that follows the roller surface of the platen roller 15.

The release rod 17 is disposed such that the body portion 172 extends in the left-right direction on the inner side of the first holder opening edge 182 and the pressing portion 171 is inserted into the inner side of the second holder opening edge 183 from the right. When the pressing portion 171 is separated from the holder side pressed portion 184, the holder side pressed portion 184 is not pressed by the pressing portion 171.

As described above, the roller holder 18 that pivots around the holder shaft 181 is constantly elastically urged toward the front. In a state in which the holder side pressed portion 184 is not pressed, the roller holder 18 is maintained in a stand-by position (the position shown in FIG. 15). When the release rod 17 moves to the left, the pressing portion 171 comes into contact with and presses the holder side pressed portion 184 inside the second holder opening edge 183. In this case, the roller holder 18 moves toward the rear from the stand-by position (downward in FIG. 15). This will be explained in detail later.

A sensor protective plate 90 that is a roughly rectangular plate with its long dimension extending in the left-right direction is provided on the top surface of the roller holder 18. The sensor protective plate 90 is provided above the sensor holder 19 and more specifically, above four of the mechanical sensors 23, excluding the mechanical sensor 23 that is positioned directly below the latching piece 192. The part of the sensor protective plate 90 that is toward the front from the approximate center of the sensor protective plate 90 in the front-rear direction is fixed to the top of the roller holder 18, and the part that is toward the rear from the approximate center projects toward the rear from the roller holder 18.

In a state in which the sensor holder 19 is in the identification position (refer to FIGS. 7 and 8), the sensor protective plate 90 extends farther toward the rear than do the tips of the switch terminals 231 that are positioned directly below it. In other words, in a case where the sensor holder 19 has moved to the identification position, the sensor protective plate 90 hides, in a plan view, the switch terminals 231 that are positioned directly below it. However, the rear edge face of the sensor protective plate 90 is slanted in the left-right direction such that it is roughly parallel to a line that extends in the left-right direction orthogonally to the holder shaft 181. Therefore, the amount by which the sensor protective plate 90 projects toward the rear from the roller holder 18 increases as one moves farther away from the holder shaft 181. The function of the sensor protective plate 90 will be described separately later.

The physical configuration of the sensor holder 19 will be explained with reference to FIGS. 6 to 10. The sensor holder 19 is provided to the inside of the first holder opening edge 182 to the rear of the release rod 17 (the upper left side in FIG. 6). The sensor holder 19 includes a box-shaped unit main body 191, the mechanical sensors 23, the latching piece 192, an electrical board 193, a cylindrical portion 194, the spring member 22, and a rotation prevention member 195. The unit main body 191, the latching piece 192, the cylindrical portion 194, and the rotation prevention member 195 are formed as a single unit.

A surface of the unit main body 191 that faces the tape cassette 30 that has been mounted in the cassette mounting portion 8 is called a cassette-facing surface 191A. A first protective portion opening 197 and a second protective portion opening 198, which are openings in two locations, are provided on the cassette-facing surface 191A. The first protective portion opening 197 is formed as a vertically long, roughly rectangular shape in a rear view. The second protective portion opening 198 is formed as a rectangular shape to the upper left from the first protective portion opening 197 (the upper right in FIG. 10). The open area of the second protective portion opening 198 is larger than that of the first protective portion opening 197. One of the mechanical sensors 23 is inserted into the first protective portion opening 197. A sensor storage body 88, which holds four of the mechanical sensors 23 as a single unit, is inserted into the second protective portion opening 198. The mechanical sensors 23 that are slotted into the first protective portion opening 197 and the second protective portion opening 198 are electrically connected to the electrical board 193 that is disposed on the unit main body 191.

The electrical board 193 is provided on the front side of the unit main body 191. The front surface of the electrical board 193 is exposed to the front through the opening that is formed by the first holder opening edge 182. Although not shown in the drawings, electrical wiring is connected to the front surface of the electrical board 193. The electrical board 193 is electrically connected by the electrical wiring to a control circuit 400 that is provided inside the printer 1 (refer to FIG. 13). On and off signals of the mechanical sensors 23 are transmitted to a CPU 401 (refer to FIG. 13) through the electrical wiring that is connected to the electrical board 193.

Each of the mechanical sensors 23 includes one of the switch terminals 231, which protrude toward the rear from the cassette-facing surface 191A. In other words, each of the switch terminals 231 protrudes such that it faces the arm front surface 35 (refer to FIG. 3) of the tape cassette 30 that is mounted in the cassette mounting portion 8. The switch terminals 231 are provided in positions that correspond to the positions of the indicators of the arm indicator portion 800 (the non-pressing portions 801 and the pressing portions 802) (refer to FIG. 5). In the present embodiment, the five switch terminals 231 are arranged in a zigzag pattern, so the positions of the switch terminals 231 in the left-right direction differ from one another, and none of the switch terminals 231 overlap in the up-down direction. A line that connects one of the switch terminals 231 to another of the switch terminals 231 intersects with the up-down direction of the printer 1, which is the direction in which the tape cassette 30 is mounted and removed. The latching piece 192, which is a plate-shaped projection whose long dimension is in the left-right direction, is provided in an upper right portion of the cassette-facing surface 191A (an upper left portion in FIG. 10). The latching piece 192 projects farther toward the rear than do the switch terminals 231.

An electrical board hole 196 that is a circular hole in a front view is provided in the electrical board 193. The unit main body 191 includes the cylindrical portion 194, which extends toward the front (toward the right in FIG. 8). The cylindrical portion 194 protrudes toward the front through the electrical board hole 196 that is provided in the electrical board 193. The cylindrical portion 194 has a shaft hole that extends in the front-rear direction, and a small diameter columnar member 21 is inserted into the shaft hole. The shaft hole of the cylindrical portion 194 includes a first shaft hole 1941 and a second shaft hole 1942 that coaxially communicate to form a single, continuous hole. The first shaft hole 1941 extends toward the front from the cassette-facing surface 191A to a position close to the center of the cylindrical portion 194. The second shaft hole 1942 extends from the first shaft hole 1941 to the front end of the cylindrical portion 194 and has a larger inside diameter than does the first shaft hole 1941. The columnar member 21 that is inserted into the shaft hole of the cylindrical portion 194 can slide toward the front and the rear along the first shaft hole 1941, which has approximately the same diameter as the columnar member 21. A small diameter insertion pin 21A is provided on the front end of the columnar member 21.

The inside diameter of the second shaft hole 1942 is larger than the diameter of the columnar member 21. A spring housing portion 1943 that is a groove that is ring-shaped in a front view is therefore formed between the columnar member 21 and the cylindrical portion 194. The spring member 22, which has a greater total length than the length of the second shaft hole 1942, is accommodated in the spring housing portion 1943, and the columnar member 21 is inserted through the center of the coil of the spring member 22. Inside the spring housing portion 1943, the rear end of the spring member 22 is in contact with a step section that is formed by the difference in the diameters of the first shaft hole 1941 and the second shaft hole 1942. In a state in which the spring member 22 is wound around the columnar member 21, the insertion pin 21A is inserted into the round hole 207 and the front end of the spring member 22 is in contact with the wall 20. In this way, the elastic pressure of the spring member 22 urges the sensor holder 19 toward the rear (leftward in FIG. 8).

A holder guide portion 199 that extends toward the front is provided at the bottom edge of the opening at the front of the cylindrical portion 194. The front end of the holder guide portion 199 is bent downward and is engaged with the rod guide portion 175 of the release rod 17. In FIG. 8, the holder guide portion 199 is engaged with the second rod guide portion 1753 (refer to FIG. 23). The rearward movement of the sensor holder 19 that is urged toward the rear by the spring member 22 is restricted by the engaging of the holder guide portion 199 and the rod guide portion 175. As will be described in detail later, the sensor holder 19, guided by the rod guide portion 175, moves toward the front and the rear in accordance with the movements of the release rod 17 to the right and the left, respectively.

The rotation prevention member 195 is provided on the lower edge of the unit main body 191 and below the holder guide portion 199 and extends toward the front. The rotation prevention member 195 passes through the second rectangular hole 209 of the wall 20, and the front end of the rotation prevention member 195, which is bent downward, is engaged with the front surface of the wall 20. The sensor holder 19 is positioned by the wall 20 at the two vertically aligned points of the insertion pin 21A and the rotation prevention member 195, thus restricting the rotation of the sensor holder 19 around the columnar member 21.

The mechanical sensors 23 will be explained in detail with reference to FIGS. 11 and 12. In FIG. 12, the movement of the one of the five mechanical sensors 23 that is positioned the farthest to the upper left (the upper right in FIG. 10) is schematically depicted.

Figure 11:
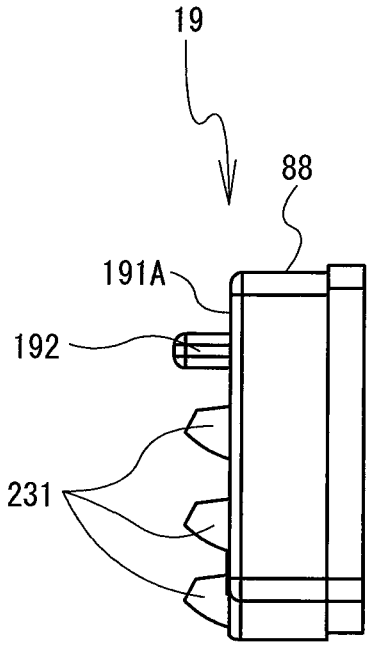
FIG. 11 is a left side view of the sensor holder 19.
Figure 12:
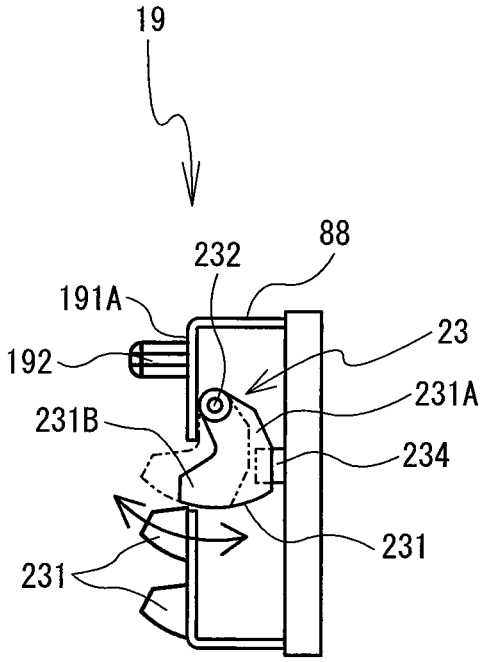
FIG. 12 is a vertical sectional view of the sensor holder 19 that is shown in FIG. 11.

As shown in FIGS. 11 and 12, in the mechanical sensor 23, the switch terminal 231 is provided inside a narrow box-shaped sensor main body (not shown in the drawings) that is short in the front-rear direction (the left-right direction in FIGS. 11 and 12). The switch terminal 231 can rotate toward the front and the rear, the center of rotation being a shaft portion 232 that extends inside the sensor main body in the left-right direction (the front-rear direction in FIGS. 11 and 12). The switch terminal 231 is constantly urged by a spring (not shown in the drawings) to rotate toward the rear (the left in FIGS. 11 and 12), such that it moves to a protruding position. When an external pressure is applied to the tip of the switch terminal 231, the switch terminal 231 rotates toward the front (the right in FIGS. 11 and 12), such that it moves to a retracted position. A detecting element 234 that detects a state of displacement of the switch terminal 231 is provided to the front of the switch terminal 231.

The switch terminal 231 as a whole is a plate-shaped member that has a flat portion that is curved approximately into a U shape in a side view. The switch terminal 231 includes an arm 231A and a protruding portion 231B. The arm 231A extends in a radial direction from the shaft portion 232. The protruding portion 231B protrudes toward the rear from the end of the arm 231A. The length of the protruding portion 231B in the vertical direction tapers from the arm 231A toward the rear, and the protruding portion 231B has a form that protrudes in approximately a V shape in a side view. In a state in which the switch terminal 231 has moved to the protruding position, the protruding portion 231B protrudes farther to the rear than the cassette-facing surface 191A. At this time, the arm 231A is not in contact with the detecting element 234, and the mechanical sensor 23 is in an off state.

When an external pressure is applied that presses against the outer edge of the approximate V shape of the protruding portion 231B, the protruding portion 231B retracts toward the front. At this time, the arm 231A comes into contact with the detecting element 234, and the mechanical sensor 23 enters an on state. In other words, the protruding portion 231B retracts in the forward direction, and the mechanical sensor 23 enters the on state, not only in a case where the protruding portion 231B is pressed horizontally from the rear, but also in a case where the protruding portion 231B is pressed vertically from one of above and below.

Figure 13:
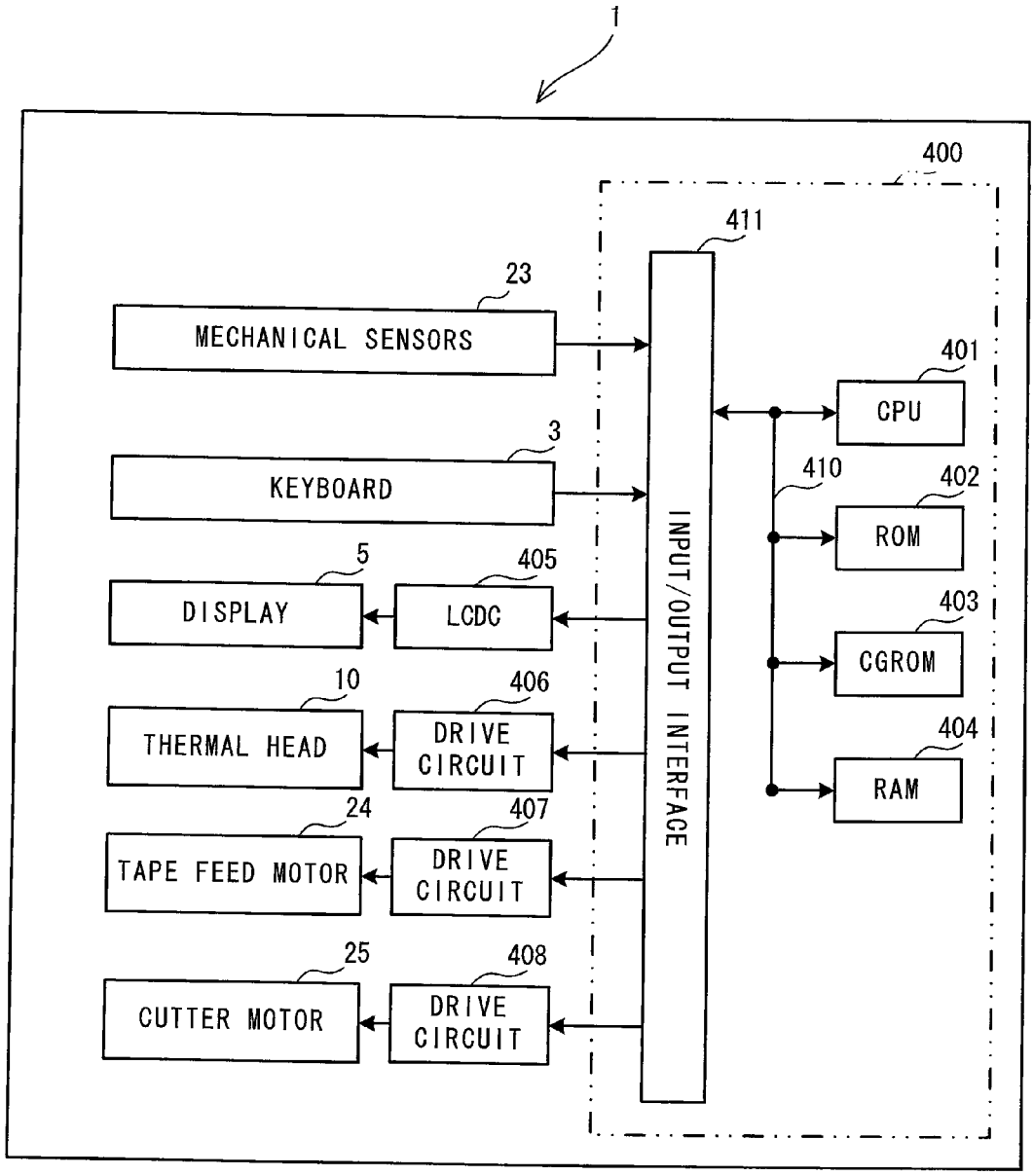
FIG. 13 is a block diagram that shows an electrical configuration of the printer 1.
Figure 14:
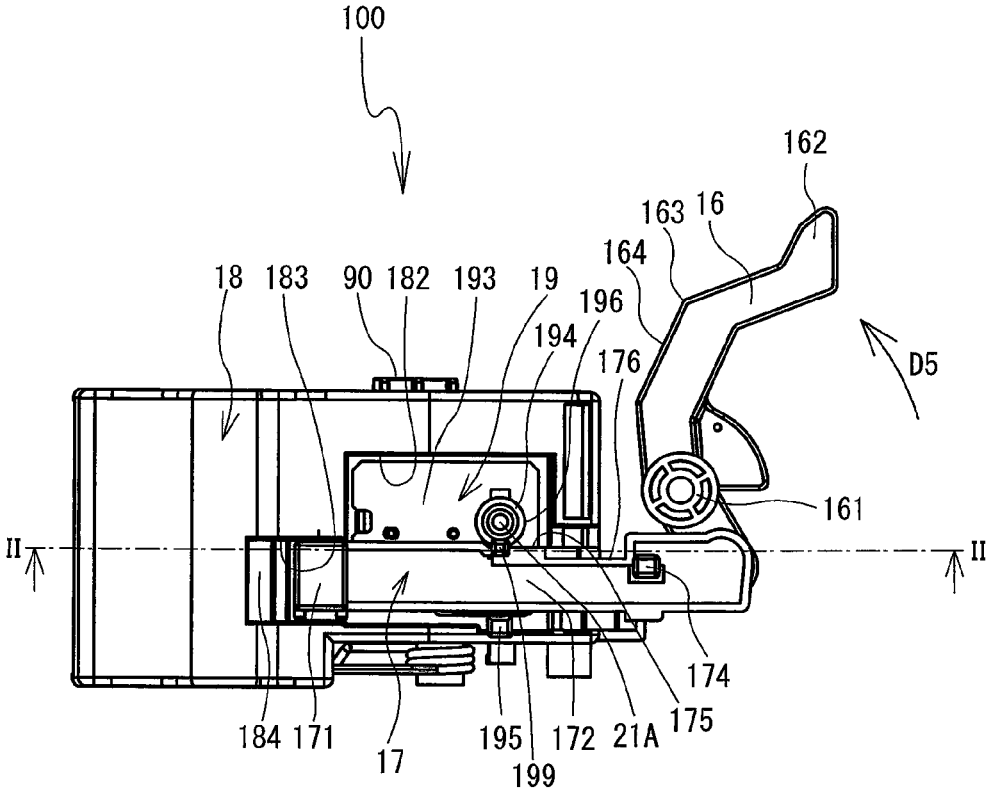

The electrical configuration of the printer 1 will be explained with reference to FIG. 13. As shown in FIG. 13, the printer 1 includes the control circuit 400, which is formed on a control board. The control circuit 400 includes the CPU 401, which controls various devices, as well as a ROM 402, a CGROM 403, a RAM 404, an input/output interface 411, and the like, all of which are connected to the CPU 401 through a data bus 410.

The ROM 402 stores various types of programs for the CPU 401 to control the printer 1. The ROM 402 also stores a table that is used to identify the type of tape in the tape cassette 30 that is mounted in the cassette mounting portion 8. The CGROM 403 stores printing dot pattern data that are used to print characters. The RAM 404 includes a plurality of storage areas, including a text memory, a print buffer, and the like.

The mechanical sensors 23, the keyboard 3, a liquid crystal drive circuit (LCDC) 405, drive circuits 406, 407, and 408, and the like are connected to the input/output interface 411. The drive circuit 406 is en electronic circuit that drives the thermal head 10. The drive circuit 407 is an electronic circuit that drives a tape feed motor 24 that causes the ribbon take-up shaft 9 and the tape drive shaft 11 to rotate. The drive circuit 408 is an electronic circuit that drives a cutter motor 25 that operates a moving blade (not shown in the drawings) that cuts the printed tape 50. The liquid crystal drive circuit (LCDC) 405 has a video RAM (not shown in the drawings) for outputting display data to the display 5.

The operating modes of the movable mechanism 100 will be explained in detail with reference to FIGS. 6 and 14 to 25. In order to make the explanation of the operating modes of the movable mechanism 100 easier to understand, the tape cassette 30, the roller holder 18, and the sensor holder 19 are depicted by broken lines in FIGS. 16, 20, and 24. Note that FIGS. 6 and 14 to 16 show a state in which the cover 6 is open (that is, a state in which the roller holder 18 is in the stand-by position and the sensor holder 19 is in a separated position). FIGS. 17 to 20 show a state in which the cover 6 is in the process of being closed (that is, a state in which the roller holder 18 is in a contact position and the sensor holder 19 is in the separated position). FIGS. 21 to 25 show a state in which the cover 6 is closed (that is, a state in which the roller holder 18 is in the printing position and the sensor holder 19 is in the identification position).

The operating mode of the movable mechanism 100 in a case where the cover 6 is moved from the open position (refer to FIG. 2) to the closed position (refer to FIG. 1) by being closed downward will be explained.

As shown in FIGS. 6 and 14 to 16, the lever 16 is urged in the upward direction (rotation direction D5 in FIG. 14) by a lever spring (not shown in the drawings). When the cover 6 is in the open position due to the urging force of the lever 16, the lever projection 162 is at its highest position. At this time, the release rod 17 that is coupled to the lower end of the lever 16 is at a right end position of the range of movement of the release rod 17.

In a state in which the cover 6 is in the open position, the holder guide portion 199 is engaged with the first rod guide portion 1751. The movement of the sensor holder 19, which is urged toward the rear (downward in FIG. 15) by the spring member 22, is restricted by the first rod guide portion 1751, and the sensor holder 19 is held in the separated position (the position shown in FIG. 15). The holder side pressed portion 184 of the roller holder 18 is separated from the pressing portion 171 of the release rod 17. The roller holder 18 is not pressed by the pressing portion 171 and is urged toward the front by the urging spring (not shown in the drawings), thus being maintained in the stand-by position (the position shown in FIG. 15).

In a case where the roller holder 18 is moving to the stand-by position, the movable feed roller 14 and the platen roller 15, which are exposed to the rear of the roller holder 18, move to below the plate 13. The sensor protective plate 90, which projects toward the rear from the roller holder 18, also moves to below the plate 13. At this time, a length L2 between the head holder 74 and the sensor protective plate 90 in the front-rear direction becomes not less than the length of the arm accommodating portion 79 in the front-rear direction (and therefore not less than the length L1 of the arm portion 34 in the front-rear direction).

In a case where the sensor holder 19 is moving to the separated position, the latching piece 192 and the switch terminals 231, which are exposed to the rear of the sensor holder 19, move to below the plate 13. At this time, the latching piece 192 and the tips of the switch terminals 231 move farther forward than the rear edge of the sensor protective plate 90 in a plan view.

Thus, in a state in which the cover 6 is open (FIGS. 6 and 14 to 16), the movable feed roller 14, the platen roller 15, the sensor protective plate 90, the latching piece 192, and the switch terminals 231 have retracted to below the plate 13, so these members are unlikely to interfere with the tape cassette 30 that is being one of mounted in and removed from the cassette mounting portion 8. In particular, because the front-rear direction length L2 is not less than the front-rear direction length L1, the sensor protective plate 90, the latching piece 192, and the switch terminals 231 are unlikely to interfere with the arm portion 34 that is being one of mounted in and removed from the arm accommodating portion 79. In other words, the printer 1 is in a state in which the tape cassette 30 can be freely mounted in and removed from the cassette mounting portion 8.

In a case where the cover 6 is closed by the user, pressure in the downward direction is applied to the cover 6 in the open position. In the process of the cover 6 moving toward the closed position in accordance with the downward pressure, the lever depressing portion 61 (refer to FIG. 2) comes into contact with the lever projection 162. The lever depressing portion 61 depresses the lever projection 162, causing the lever 16 to rotate downward against the urging force of the lever spring (not shown in the drawings). In accordance with the rotation of the lever 16, the release rod 17 moves to the left from the right end position. The lever depressing portion 61 depresses the top surface curved portion 163 of the lever 16, causing the lever 16 to rotate farther downward and causing the release rod 17 to move farther to the left.

In accordance with the movement of the release rod 17 to the left, the slanting surface 1712 of the pressing portion 171 comes into contact with the holder side pressed portion 184 of the roller holder 18. In accordance with the pressing of the holder side pressed portion 184 by the slanting surface 1712, the holder side pressed portion 184 slides along the slanting surface 1712, and the roller holder 18 rotates toward the rear against the urging force of the urging spring (not shown in the drawings).

As shown in FIGS. 17 to 20, when the release rod 17 reaches a first position (the position shown in FIG. 19), the tape cassette 30 is fixed inside the cassette mounting portion 8 by the roller holder 18. Specifically, the platen roller 15 presses against the thermal head 10 through the film tape 59 and the ink ribbon 60 that are positioned at the exposing portion 77. Through the film tape 59 and the double-sided adhesive tape 58, the movable feed roller 14 presses against the tape drive roller 46, into which the tape drive shaft 11 has been inserted. The position in which the tape cassette 30 is fixed inside the cassette mounting portion 8 (the position shown in FIG. 19) is the contact position of the roller holder 18.

The sensor holder 19 is configured such that it can move only in the front-rear direction and does not move in the left-right direction. Therefore, the rod guide portion 175 slides in the left-right direction in accordance with the movement of the release rod 17 in the left-right direction, while maintaining its state of engagement with the holder guide portion 199. More specifically, when the release rod 17 moves to the left from the right end position to the first position, the first rod guide portion 1751 slides to the left while maintaining its state of engagement with the holder guide portion 199. The first rod guide portion 1751 is a wall portion that is parallel to the left-right direction, so in a state in which the first rod guide portion 1751 is engaged with the holder guide portion 199, the sensor holder 19 does not move in the front-rear direction, even if the release rod 17 moves in the left-right direction.

Thus, in the state in which the cover 6 is in the process of being closed (refer to FIGS. 17 to 20), the roller holder 18 rotates toward the rear from the stand-by position (refer to FIG. 15) in accordance with the leftward movement of the release rod 17 from the right end position to the first position. When the roller holder 18 reaches the contact position (refer to FIG. 19), the movable feed roller 14 and the platen roller 15, which are exposed to the rear of the roller holder 18, move to the rear of the plate 13 (that is, into the cassette mounting portion 8) in a plan view. At this time, in a case where the tape cassette 30 has already been mounted in the cassette mounting portion 8, the movable feed roller 14 and the platen roller 15 respectively press against the tape drive roller 46 and the thermal head 10, fixing the tape cassette 30 in the cassette mounting portion 8.

Figure 20:
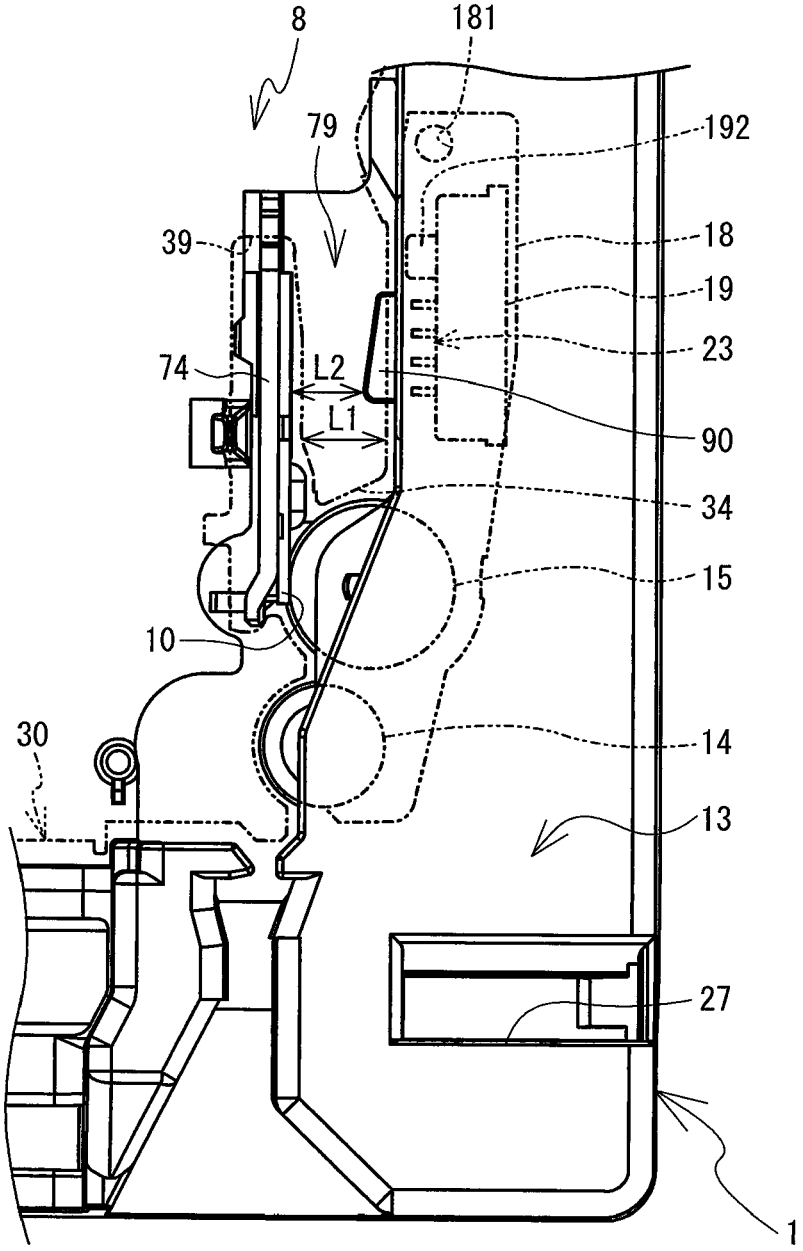
FIG. 20 is an enlarged plan view of the area around the roller holder 18, the sensor holder 19, and the head holder 74 in FIG. 19.

The sensor protective plate 90 that projects to the rear from the roller holder 18 also moves to the rear of the plate 13 (that is, into the arm accommodating portion 79) in a plan view. At this time, as shown in FIG. 20, the rear edge of the sensor protective plate 90 is positioned farther to the rear, in a plan view, than the position where the front surface of the tape cassette 30 (specifically, the arm front surface 35 shown in FIG. 3) is disposed in the cassette mounting portion 8. The length L2 between the head holder 74 and the sensor protective plate 90 in the front-rear direction becomes less than the length of the arm accommodating portion 79 in the front-rear direction (and therefore less than the length L1 of the arm portion 34 in the front-rear direction). This makes it difficult for the arm portion 34, which is inserted into and removed from the arm accommodating portion 79, to move up and down by passing between the head holder 74 and the sensor protective plate 90.

Figure 25:
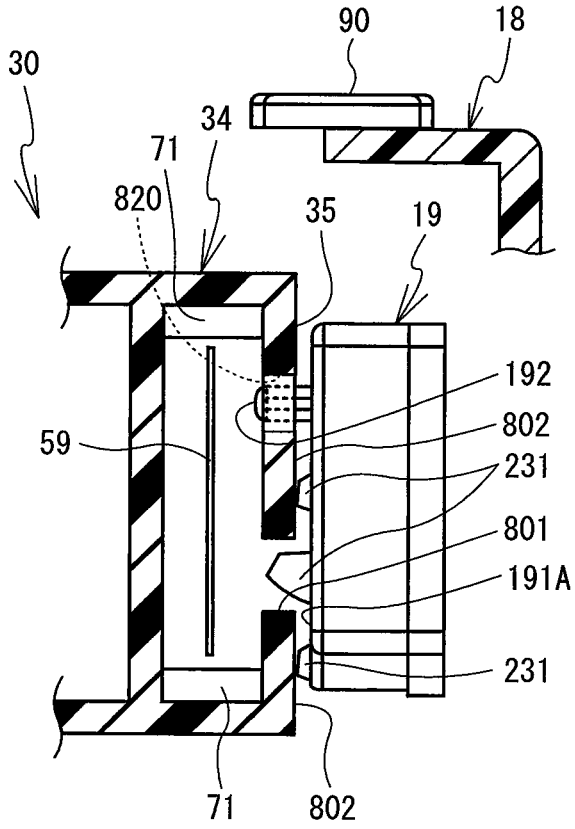
FIG. 25 is a sectional view of the movable mechanism 100 in the direction of the broken line I-I in FIG. 5, showing a state in which the sensor holder 19 is close to the tape cassette 30.
Figure 26:
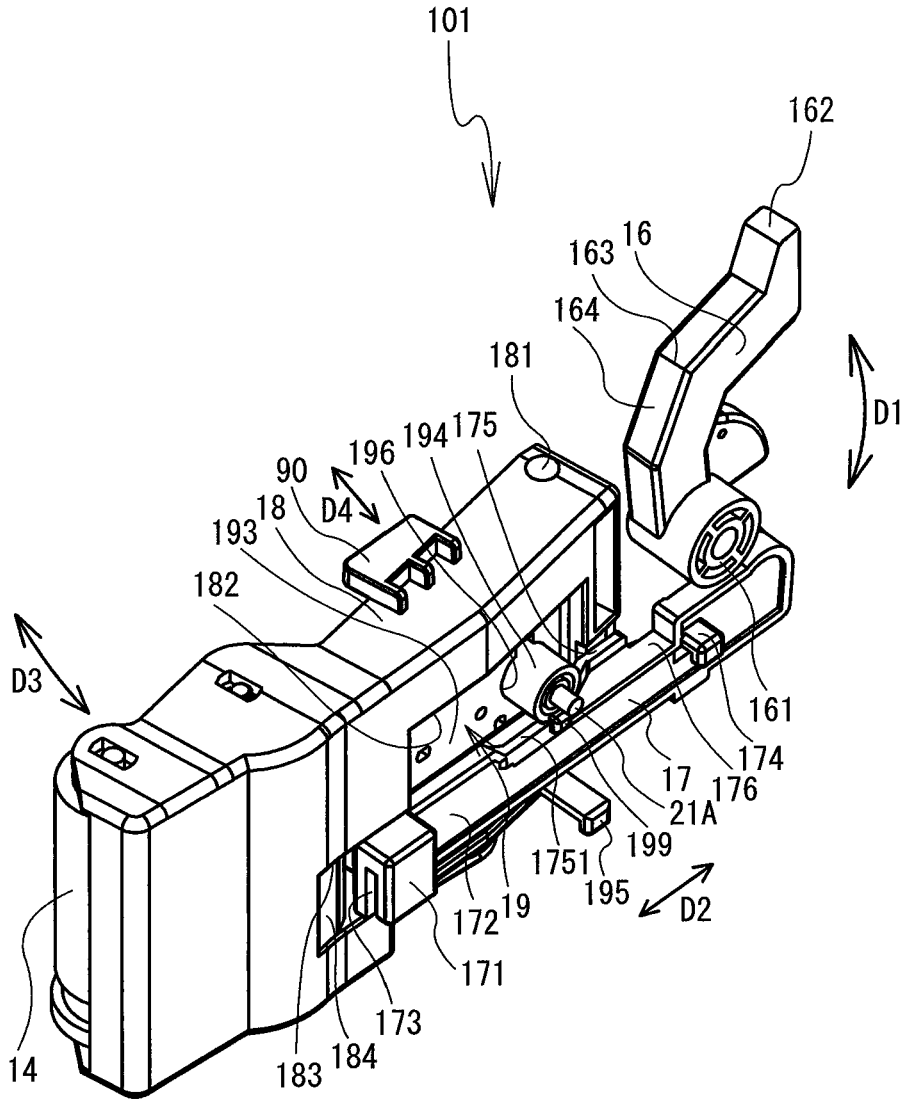
FIG. 26 is an oblique view of a movable mechanism 101 from which the wall 20 has been removed, as seen obliquely from the front in a state in which the cover 6 is open.
Figure 27:
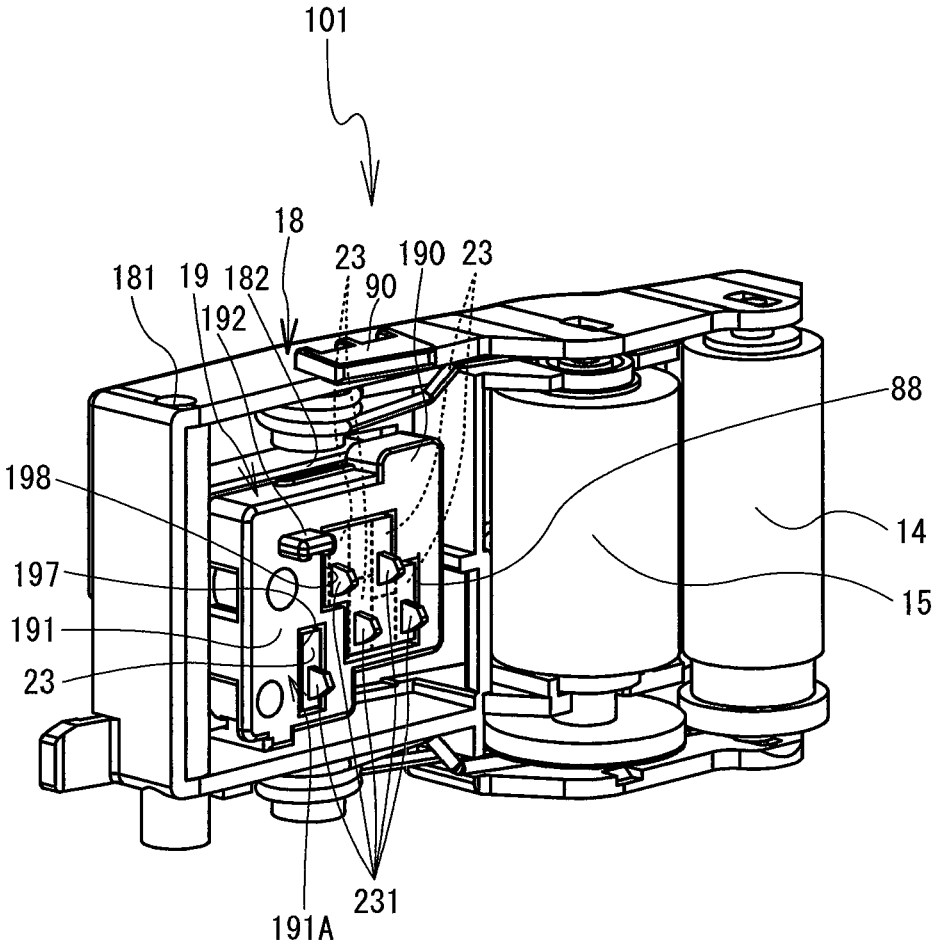
FIG. 27 is an oblique view of the roller holder 18 and the sensor holder 19 of the movable mechanism 101, as seen obliquely from the rear.
Figure 28:
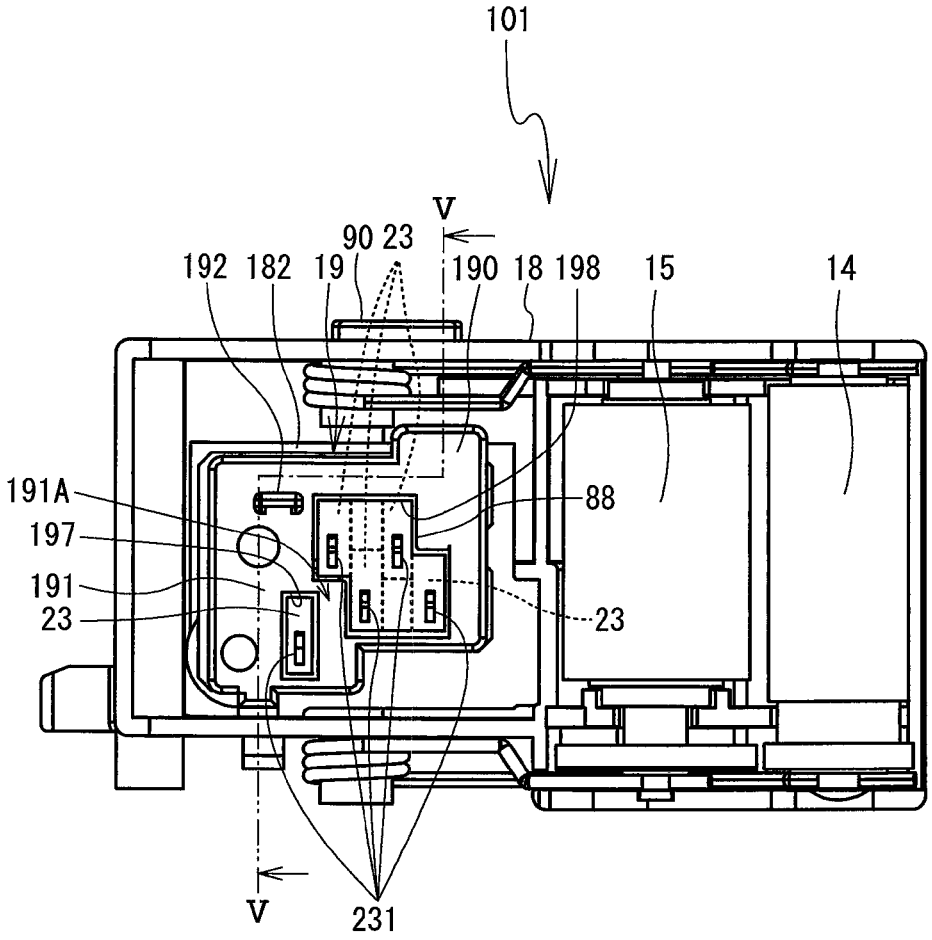
FIG. 28 is a rear view of the roller holder 18 and the sensor holder 19 of the movable mechanism 101.
Figure 29:
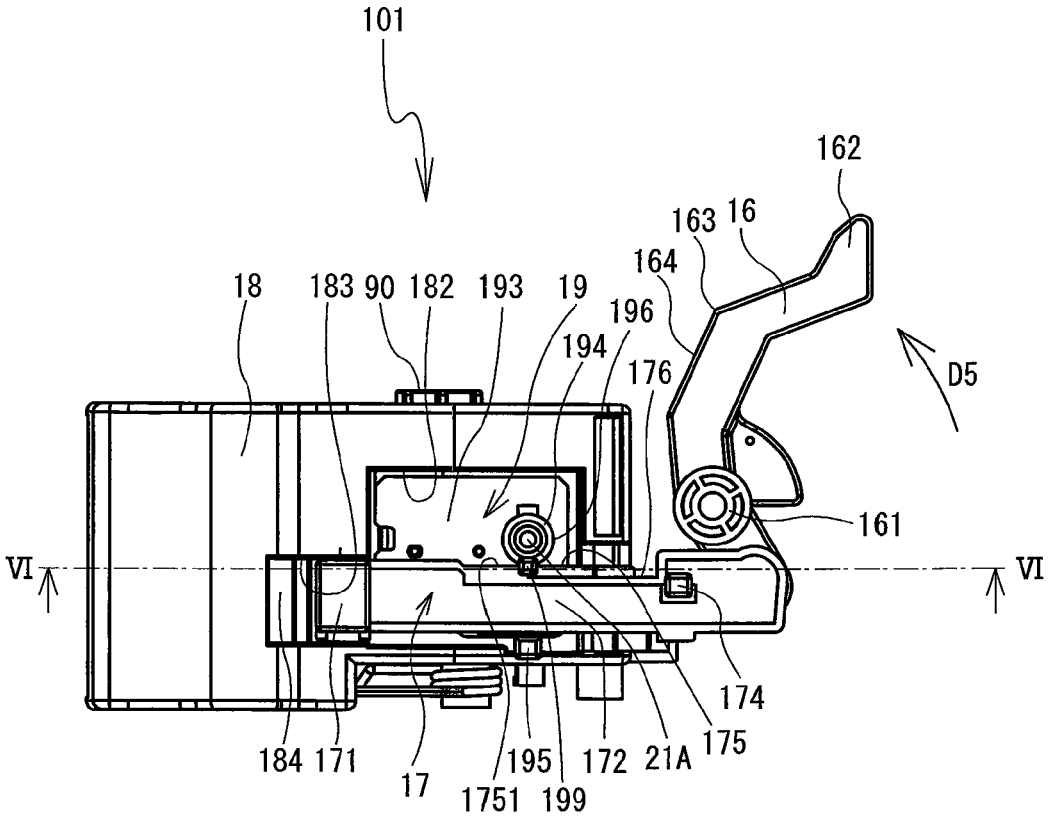
FIG. 29 is a front view of the movable mechanism 101 that is shown in FIG. 26.
Figure 30:
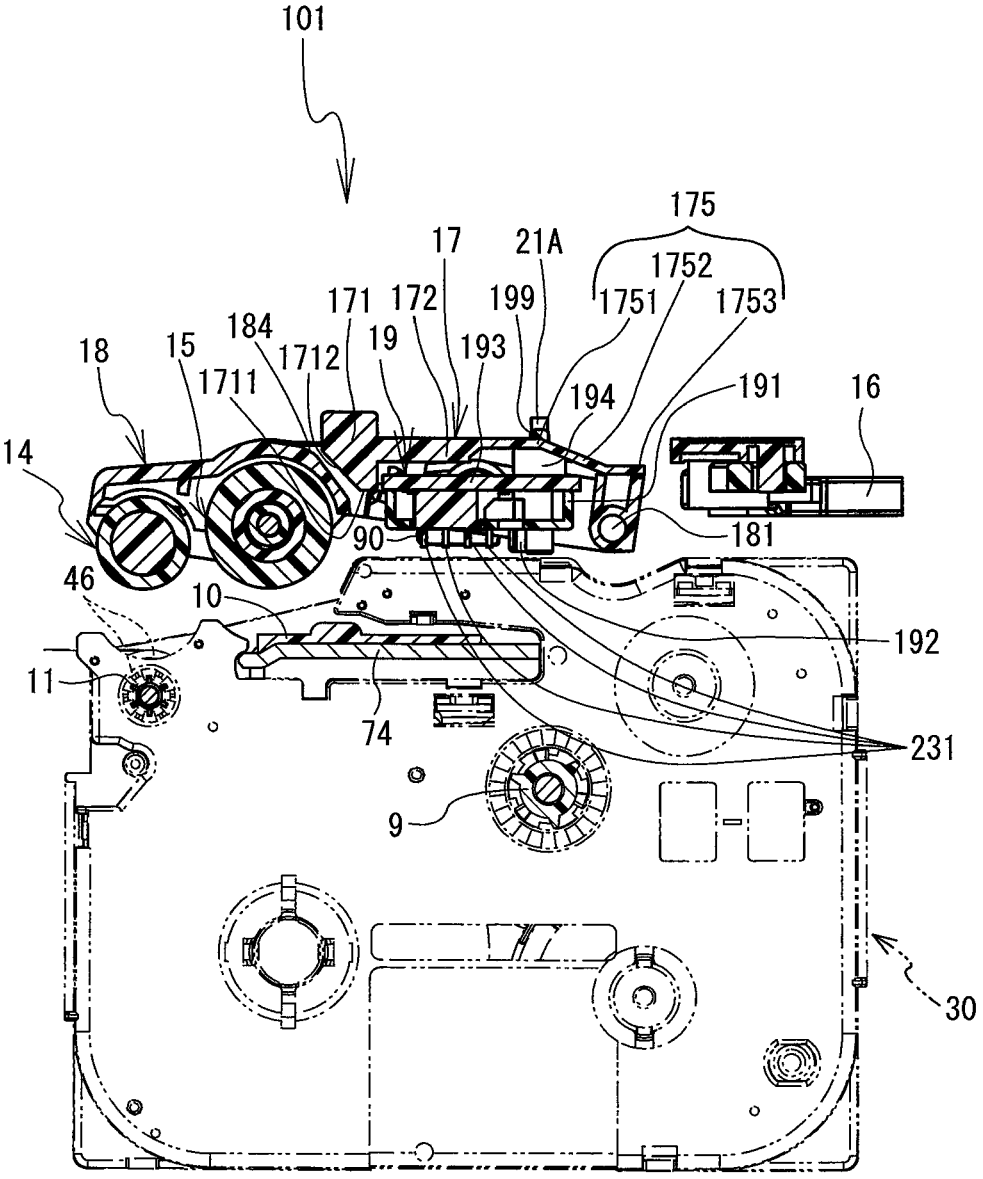
FIG. 30 is a sectional view of the movable mechanism 101 in the direction of the broken line V-V in FIG. 29, and a bottom plan view that shows the tape cassette 30, the tape drive shaft 11, and a thermal head 10.

In the state in which the cover 6 is in the process of being closed, in a case where the tape cassette 30 has already been mounted in the cassette mounting portion 8, the sensor protective plate 90 moves to a position above the tape cassette 30 (specifically, above the arm front surface 35) (refer to FIG. 25). In this state, if the tape cassette 30 moves upward from the cassette mounting portion 8, the sensor protective plate 90 comes into contact with the top surface of the arm portion 34, so the upward movement of the tape cassette 30 is restricted. It is therefore possible to prevent the tape cassette 30 that is mounted in the cassette mounting portion 8 from coming out in the upward direction due, for example, to a mistaken operation by the user, vibration of the printer 1, or the like.

In the state in which the cover 6 is in the process of being closed, in a case where the tape cassette 30 has not yet been mounted in the cassette mounting portion 8, it may happen that the user mistakenly mounts the tape cassette 30 in the cassette mounting portion 8. In this sort of case, the mounting of the tape cassette 30 in the cassette mounting portion 8 is obstructed by the sensor protective plate 90. Specifically, the sensor protective plate 90 comes into contact with the tape cassette 30 from below (specifically, the bottom surface of the arm portion 34) before the arm portion 34 enters the arm accommodating portion 79, so the arm portion 34 is restricted from entering the arm accommodating portion 79. The mistaken mounting of the tape cassette 30 is thus restricted, making it possible to prevent the arm portion 34 from pressing against the switch terminals 231 from above. It is therefore possible to limit the occurrence of bending and damage to the switch terminals 231.

Furthermore, in the state in which the cover 6 is in the process of being closed, the sensor holder 19 is maintained in the separated position, and the switch terminals 231 are retracted to below the plate 13. Therefore, in the process of the cover 6 being closed, the switch terminals 231 are restricted from interfering with the tape cassette 30, even in a case where the tape cassette 30 is mistakenly mounted in the cassette mounting portion 8, so it is therefore possible to reliably limit the occurrence of bending and damage to the switch terminals 231.

When the cover 6 is moved farther toward the closed position from the state in which the cover 6 is in the process of being closed (refer to FIGS. 17 to 20), the lever depressing portion 61 depresses the top surface curved portion 163. This causes the release rod 17 to move even farther to the left from the first position, in accordance with the additional downward rotation of the lever 16. When the cover 6 reaches the closed position, the lever depressing portion 61 is in contact with the contact surface 164 of the lever 16. At this time, the release rod 17 moves to a second position (the position shown in FIG. 23) that is the left end position of the range of movement of the release rod 17.

In accordance with the movement of the release rod 17 farther to the left side than the first position (refer to FIG. 19), the holder side pressed portion 184 is pressed farther toward the rear by the slanting surface 1712. As shown in FIGS. 21 to 24, when the release rod 17 reaches the second position (refer to FIG. 23), the rear surface 1711 of the pressing portion 171 comes into contact with the holder side pressed portion 184. In the state in which the holder side pressed portion 184 is in contact with the rear surface 1711, the position in which the roller holder 18 is held (the position shown in FIG. 23) is the printing position of the roller holder 18.

In this way, the roller holder 18 gradually moves toward the rear in conjunction with the movement of the cover 6 from the open position to the closed position. As the cover 6 approaches the closed position, the pressure with which the platen roller 15 presses against the thermal head 10 and the pressure with which the movable feed roller 14 presses against the tape drive roller 46 gradually increase. In the state in which the roller holder 18 is in the printing position (refer to FIG. 23), the tape cassette 30 is even more firmly fixed in the cassette mounting portion 8 than when the roller holder 18 is in the contact position (refer to FIG. 19).

In a case where the roller holder 18 is in the printing position, the state in which the sensor protective plate 90 has moved into the arm accommodating portion 79 is maintained, in the same manner as when the roller holder 18 is in the contact position, so the upward movement of the tape cassette 30 is restricted by the sensor protective plate 90.

The length by which the sensor protective plate 90 according to the present embodiment projects out from the roller holder 18 increases as the distance from the holder shaft 181 increases. Therefore, in a case where the roller holder 18 moves to the stand-by position, the rear edge of the sensor protective plate 90 retracts to a position in which, in a plan view, it is parallel to the left-right direction (the up-down direction in FIG. 16), which is the long direction of the head holder 74 (that is, a position in which the rear edge of the sensor protective plate 90 is completely hidden below the plate 13). On the other hand, in a case where the roller holder 18 moves to one of the contact position and the printing position, the sensor protective plate 90 moves out from below the plate 13 and into the arm accommodating portion 79, such that the left end (the bottom end in FIG. 20) of the rear edge of the sensor protective plate 90 projects farther toward the rear than the rest of the rear edge.

It is thus possible, simply by rotating the roller holder 18 through a minimum angle of rotation, to move the sensor protective plate 90 efficiently into the arm accommodating portion 79 and to retract the sensor protective plate 90 efficiently from the arm accommodating portion 79 to below the plate 13. In other words, the it is possible to move the sensor protective plate 90 efficiently between the position where the sensor protective plate 90 interferes with the arm portion 34 and the position where the sensor protective plate 90 does not interfere with the arm portion 34.

When the release rod 17 moves further to the left than the first position (refer to FIG. 19), the portion of the release rod 17 that engages with the holder guide portion 199 changes from the first rod guide portion 1751 to the rod guide diagonal portion 1752. The rod guide diagonal portion 1752, which is a wall that extends toward the right rear of the first rod guide portion 1751, enters a state in which it can slide while engaged with the holder guide portion 199. In this state, when the release rod 17 moves to the left, the holder guide portion 199 moves toward the rear along the rod guide diagonal portion 1752 while being pressed by the spring member 22.

When the release rod 17 moves further to the left and reaches the second position (refer to FIG. 23), the portion that engages with the holder guide portion 199 changes from the rod guide diagonal portion 1752 to the second rod guide portion 1753. The second rod guide portion 1753 is a wall that extends parallel to the left-right direction, so in a state in which the second rod guide portion 1753 is engaged with the holder guide portion 199, the sensor holder 19 does not move in the front-rear direction even if the release rod 17 moves in the left-right direction. The position in which the holder guide portion 199 is engaged with the second rod guide portion 1753 (the position shown in FIG. 23) is the identification position of the sensor holder 19.

As shown in FIGS. 21 to 24, in a state in which the sensor holder 19 has moved to the identification position, the latching piece 192 and the switch terminals 231, which are exposed to the rear of the sensor holder 19, move toward the rear from the plate 13 (that is, into the arm accommodating portion 79) in a plan view. At this time, as shown in FIG. 25, in a case where the tape cassette 30 has been mounted in the proper position in the cassette mounting portion 8, the latching piece 192 that is provided on the cassette-facing surface 191A is inserted into the latching hole 820 on the arm front surface 35. The mechanical sensors 23 that are provided in the cassette-facing surface 191A are positioned opposite the arm indicator portion 800 of the tape cassette 30.

Each of the five switch terminals 231 is one of not pressed and pressed by the indicator (one of the non-pressing portion 801 and the pressing portion 802) that is positioned opposite it on the arm indicator portion 800. Specifically, the switch terminal 231 that is positioned opposite the pressing portion 802 is pressed against the surface of the arm front surface 35, such that the corresponding mechanical sensor 23 enters the on state. The switch terminal 231 that is positioned opposite the non-pressing portion 801 is inserted into the non-pressing portion 801, such that the corresponding mechanical sensor 23 enters the off state.

The CPU 401 that is provided in the printer 1 (refer to FIG. 13) specifies the type of tape in the tape cassette 30 that has been mounted in the cassette mounting portion 8, based on the combination of the on and off states of the five mechanical sensors 23. Specifically, the CPU 401 refers to the table that is stored in the ROM 402 in advance and specifies the type of tape that corresponds to the combination of the on and off states of the mechanical sensors 23.

In the present embodiment, the position in the up-down direction of the tape that is supplied to the thermal head 10 is accurately restricted by using the tape restricting portions 71 that are provided in the arm portion 34 to restrict the movement of the film tape 59 in the width direction. The five switch terminals 231 are pressed into contact with the arm indicator portion 800 that is provided on the arm portion 34. The CPU 401 (refer to FIG. 13) is therefore able to accurately detect the type of tape using the area around the thermal head 10 as a reference position.

Thus, in the state in which the cover 6 is closed (refer to FIGS. 21 to 24), the switch terminals 231 are pressed against the arm indicator portion 800 in a state in which the tape cassette 30 is firmly fixed in the cassette mounting portion 8. That is, the printer 1 is in a state in which stable and accurate printing can be performed and in a state in which the type of tape in the tape cassette 30 can be determined.

The operating mode of the movable mechanism 100 in a case where the cover 6 is moved from the closed position (refer to FIG. 1) to the open position (refer to FIG. 2) by being opened upward will be explained. This operating mode is similar to the case where the cover 6 is closed in the downward direction, but the order of the operations of the roller holder 18 and the sensor holder 19 is reversed.

Although not shown in FIGS. 6 and 14 to 24, in the state in which the cover 6 is in the closed position (refer to FIGS. 21 to 24), the projecting piece 63 of the cover 6 (refer to FIG. 2) is positioned below the lever projection 162 of the lever 16. When the cover 6 is opened upward from the closed position, the top surface of the projecting piece 63 pushes the lever 16 upward. The upwardly pushed lever 16 is urged by the lever spring (not shown in the drawings) to rotate upward. In accordance with the rotation of the lever 16, the release rod 17 moves to the right from the second position (refer to FIG. 23).

When the release rod 17 moves to the right from the second position (refer to FIG. 23), the holder guide portion 199 slides toward the front along the rod guide portion 175 (specifically, the rod guide diagonal portion 1752). As the holder guide portion 199 slides toward the front, the sensor holder 19 moves toward the front from the identification position (refer to FIG. 23), and the switch terminals 231 are separated from the arm indicator portion 800. When the release rod 17 then moves farther to the right than the first position (refer to FIG. 19), the sensor holder 19 is held in the separated position (refer to FIG. 15).

In accordance with the movement of the release rod 17 to the right from the second position (refer to FIG. 23) toward the first position (refer to FIG. 19), the holder side pressed portion 184 is slid by the urging spring (not shown in the drawings) toward the front along the pressing portion 171 (specifically, the slanting surface 1712). As the roller holder 18 moves toward the contact position (refer to FIG. 19) in accordance with the sliding of the holder side pressed portion 184 toward the front, the pressure that holds the tape cassette 30 in place gradually becomes weaker than in the case where the roller holder 18 is in the printing position (refer to FIG. 23).

Figure 21:
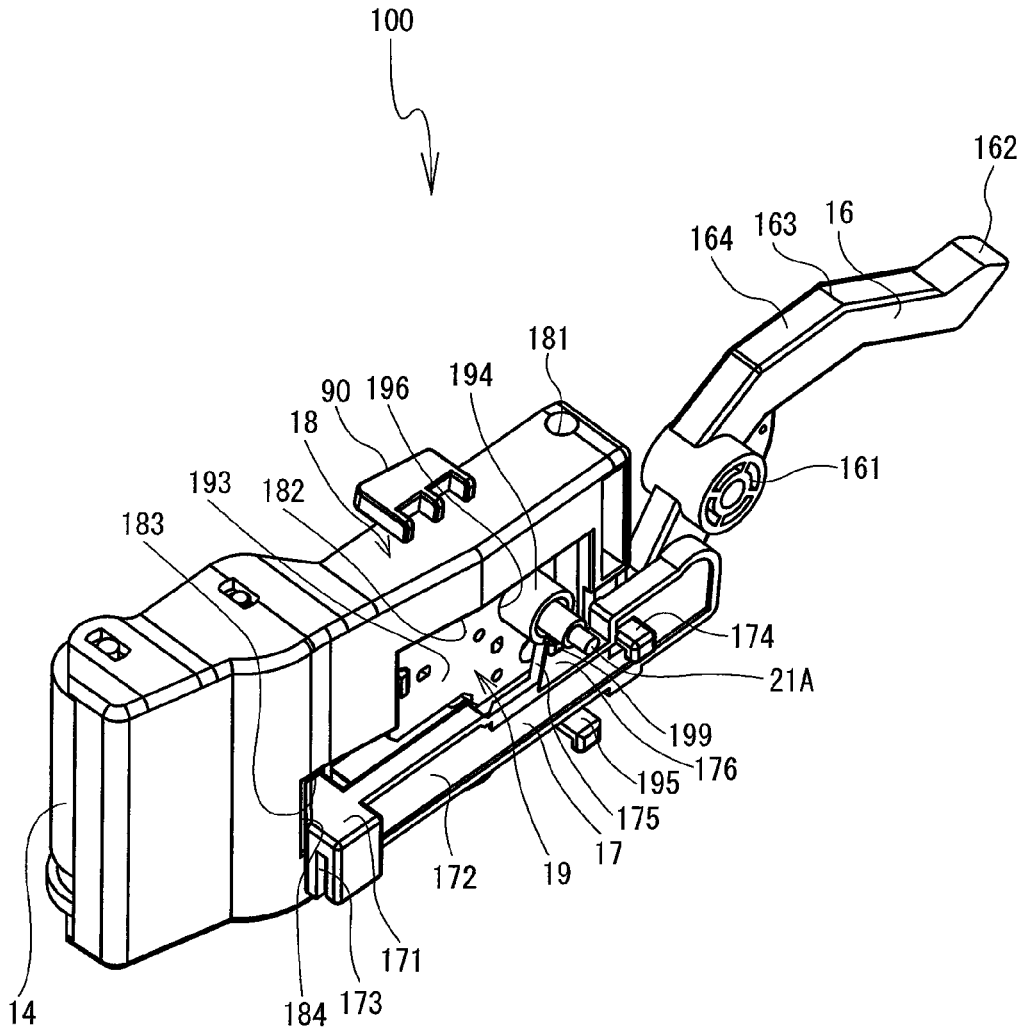
FIG. 21 is an oblique view of the movable mechanism 100 from which the wall 20 has been removed, as seen obliquely from the front in a state in which the cover 6 is closed.
Figure 22:
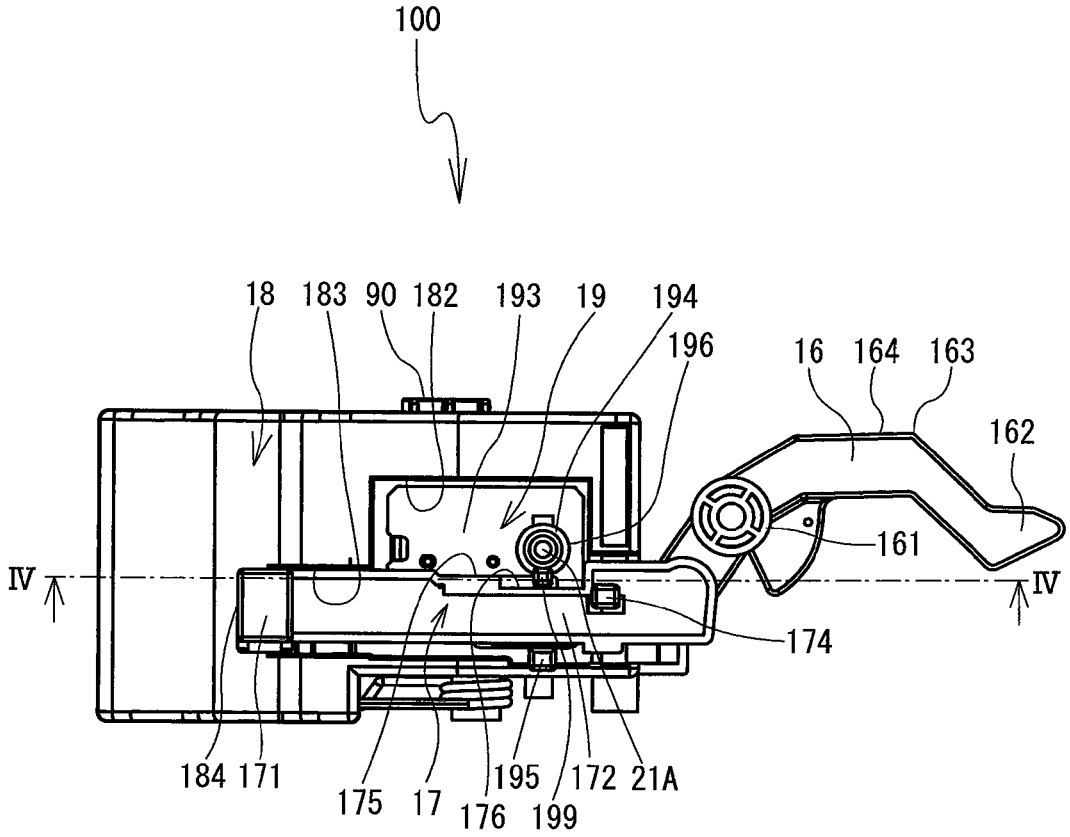
FIG. 22 is a front view of the movable mechanism 100 that is shown in FIG. 21.

When the release rod 17 moves farther to the right than the first position (refer to FIG. 19), the roller holder 18 rotates farther toward the front than the contact position (refer to FIG. 21). The platen roller 15 and the movable feed roller 14 are thus separated from the thermal head 10 and the tape drive roller 46, respectively, and the roller holder 18 is held in the stand-by position (refer to FIG. 15). Thus, in the state in which the cover 6 is opened (refer to FIGS. 6 and 14 to 16), the roller holder 18 moves to the stand-by position, and the sensor holder 19 moves to the separated position.

As explained above, in the printer 1 according to the present embodiment, the arm indicator portion 800 is provided in the arm front surface 35 of the tape cassette 30. The type of tape is detected by the pressing of the switch terminals 231 of the mechanical sensors 23 against the arm indicator portion 800 from the front. The type of tape in the tape cassette 30 can thus be appropriately detected with fewer restrictions on the space and positions in which the mechanical sensors 23 are disposed than in a case where the mechanical sensors are disposed such that they protrude toward the bottom surface of the tape cassette.

In a case where the cover 6 is being closed, the roller holder 18 reaches the contact position before the sensor holder 19 reaches the identification position. In other words, the tape cassette 30 is fixed by the roller holder 18 before the switch terminals 231 are pressed into contact with the arm indicator portion 800. In a case where the cover 6 is being opened, the sensor holder 19 moves from the identification position toward the separated position before the roller holder 18 moves from the contact position toward the stand-by position. In other words, the tape cassette 30 is released by the roller holder 18 after the switch terminals 231 have been separated from the arm indicator portion 800.

That is, whenever the sensor holder 19 is pressed against and separated from the tape cassette 30, the tape cassette 30 is in a state of being held by the roller holder 18. In this case, while the switch terminals 231 are being pressed against and separated from the arm indicator portion 800, any change in the position of the tape cassette 30 is inhibited, even in a case where the user's hand touches the tape cassette 30 or an abnormal vibration is imposed on the printer 1, for example. It is therefore possible to inhibit damage or the like to the switch terminals 231 and to appropriately protect the mechanical sensors 23.

Furthermore, in a case where the roller holder 18 is rotated to the contact position, the sensor protective plate 90 that is provided on the roller holder 18 moves to the position where it will come into contact with the tape cassette 30 from below if an attempt is made to mount the tape cassette 30 in the cassette mounting portion 8. This makes it possible to inhibit the user from mounting the tape cassette 30 in the cassette mounting portion 8 by mistake. It is also possible to prevent the arm portion 34 from pressing against the switch terminals 231 from above and therefore to inhibit the occurrence of bending and damage to the switch terminals 231.

The sensor protective plate 90 is a plate-shaped member that extends toward the thermal head 10 from the sensor holder 19 and is provided above the arm front surface 35 of the tape cassette 30 when the tape cassette 30 has been mounted in the cassette mounting portion 8. In a case where the roller holder 18 is rotated from the stand-by position to the contact position, the length L2 between the sensor protective plate 90 and the head holder 74 in the front-rear direction becomes less than the length L1 of the arm portion 34 in the front-rear direction. This sort of configuration makes it possible to easily and reliably protect the switch terminals 231 of the mechanical sensors 23 that are disposed below the sensor protective plate 90.

The roller holder 18 rotates, and the sensor holder 19 moves, in accordance with the moving of the release rod 17. In other words, the roller holder 18 and the sensor holder 19 are moved independently of one another by the moving of the release rod 17. The printer 1 does not need to be separately provided with a member that moves the roller holder 18 and a member that moves the sensor holder 19. It is therefore possible to reduce the number of component parts of the printer 1 and to inhibit any increase in the size of the printer 1.

The release rod 17 moves in accordance with the opening and closing operations of the cover 6. When the cover 6 is open, the tape cassette 30 can be mounted in and removed from the cassette mounting portion 8. When the cover 6 is closed, the printing by the thermal head 10 is enabled, and it is possible for the type of tape to be detected by the plurality of mechanical sensors 23. Therefore, simply by opening and closing the cover 6, the user is able to put the printer 1 into a state to be optimally used in accordance with whether the cover 6 is open or closed, and the operability of the printer 1 can be improved.

A printer and a tape cassette according to a second embodiment will be explained with reference to FIGS. 26 to 35. In FIGS. 26 to 35, the same reference numerals are used for the structural elements that are the same as in the printer 1 and the tape cassette 30 according to the first embodiment. Hereinafter, explanations of the structural elements that are the same as in the first embodiment will be omitted, and only the points that are different from the first embodiment will be explained.

Figure 31:
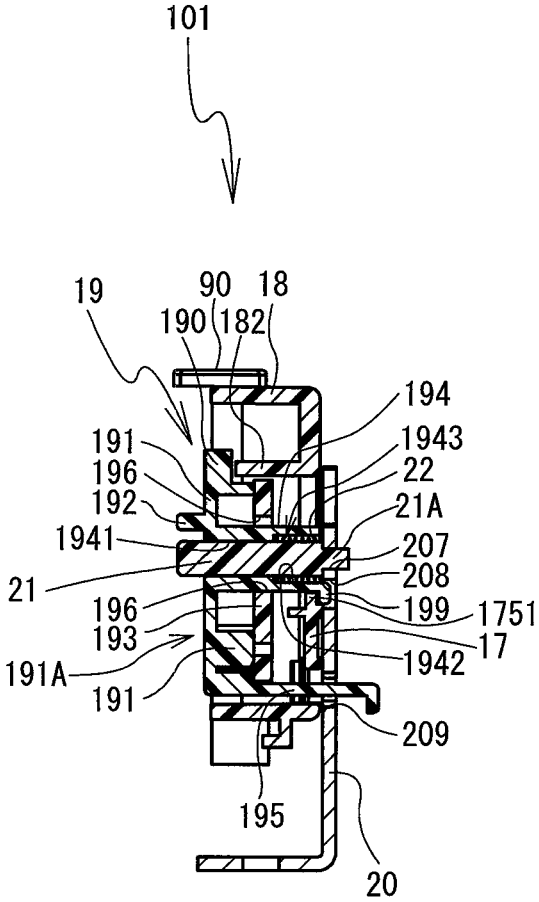
FIG. 31 is a sectional view of the movable mechanism 101 as seen from the direction of the broken line VI-VI in FIG. 28, in a state in which the cover 6 is open.
Figure 32:
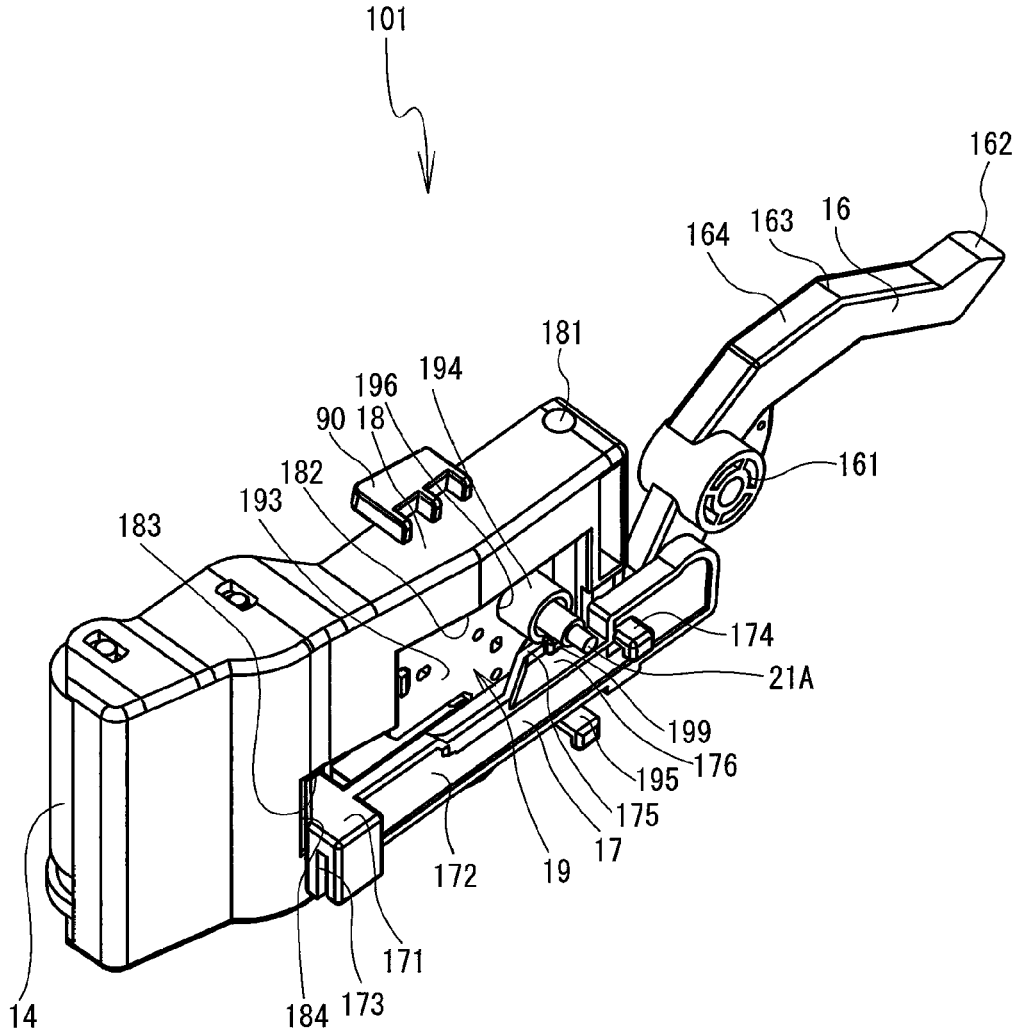
FIG. 32 is an oblique view of a movable mechanism 101 from which the wall 20 has been removed, as seen obliquely from the front in a state in which the cover 6 is closed.
Figure 33:
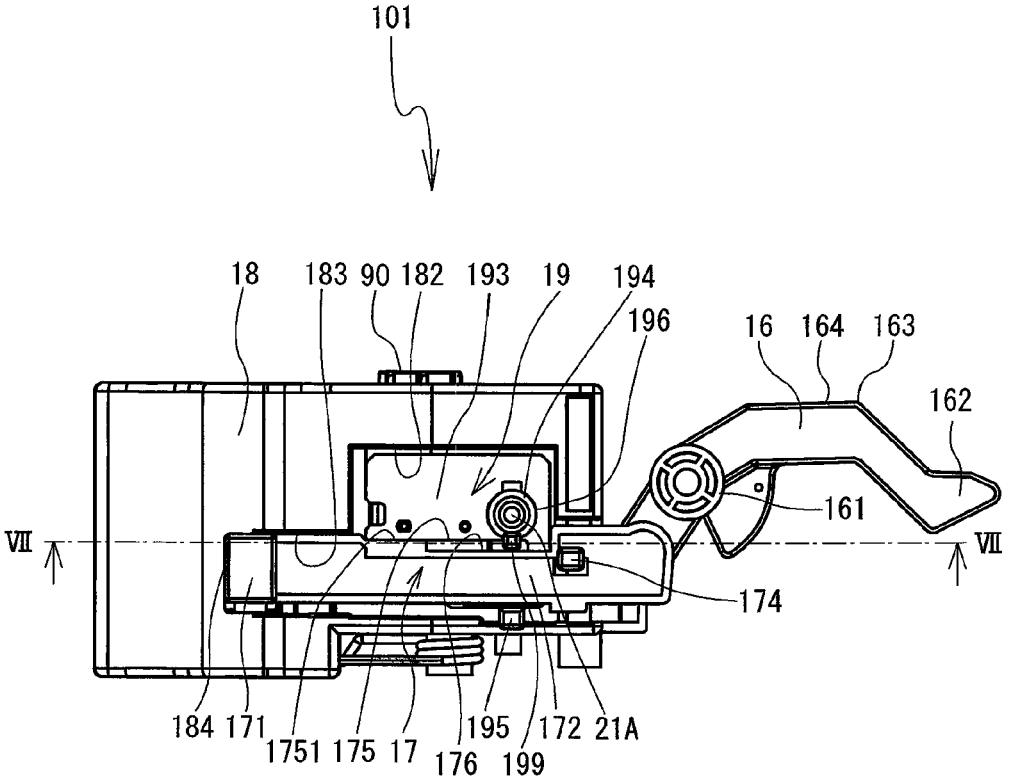
FIG. 33 is a front view of the movable mechanism 101 that is shown in FIG. 32.
Figure 34:
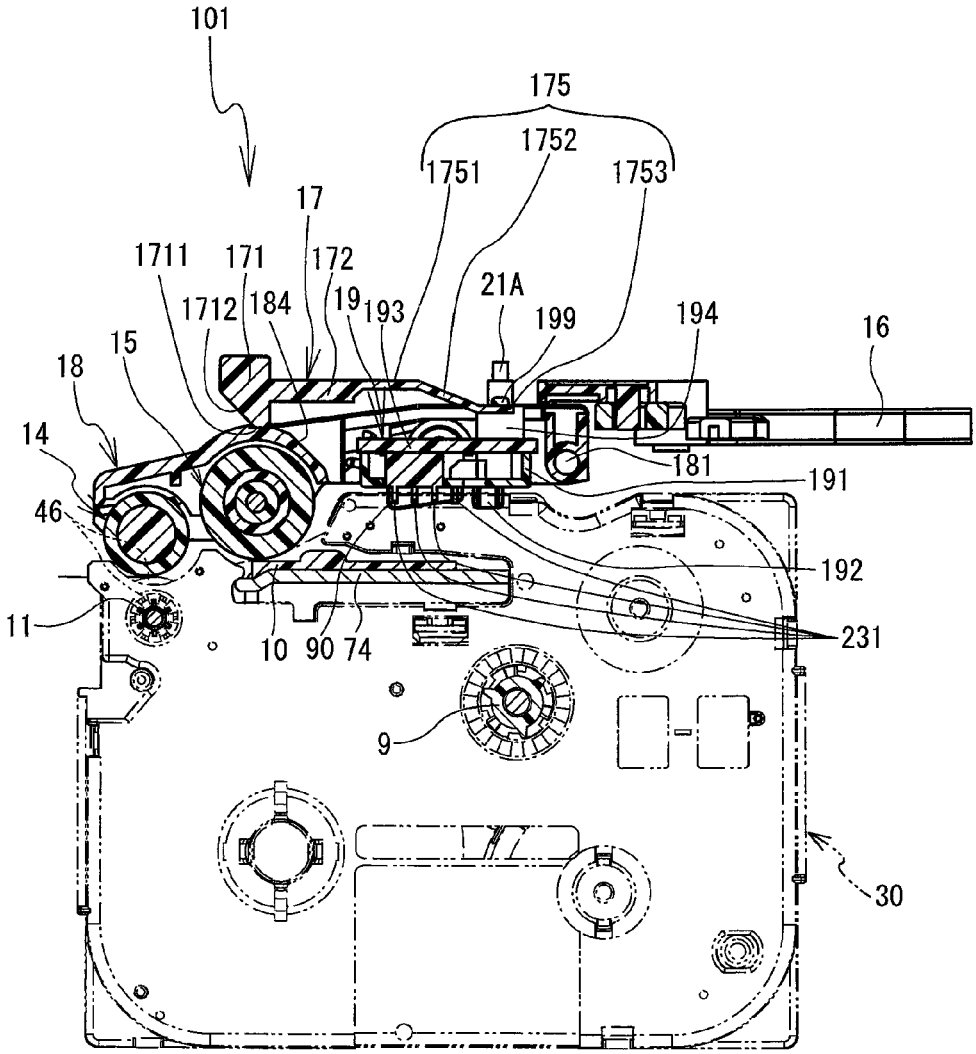
FIG. 34 is a sectional view of the movable mechanism 101 in the direction of the broken line VII-VII in FIG. 33, and a bottom plan view that shows the tape cassette 30, the tape drive shaft 11, and the thermal head 10.
Figure 35:
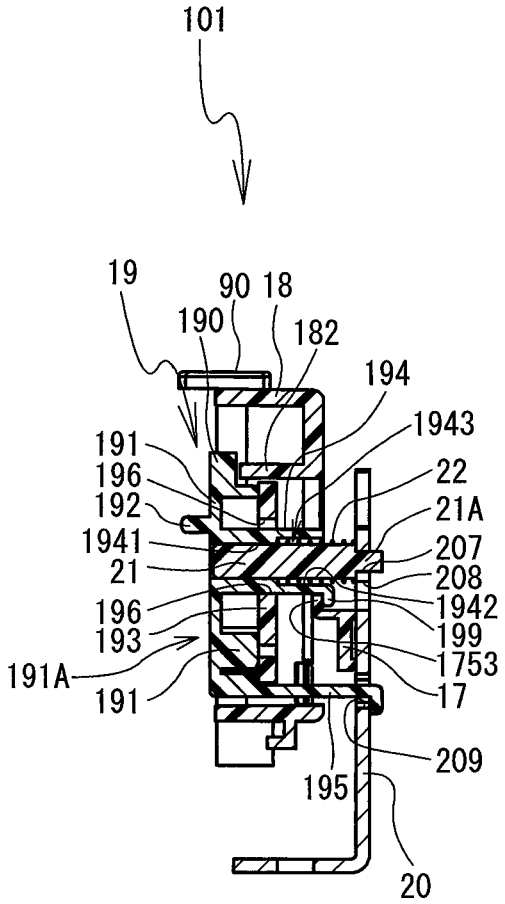
FIG. 35 is a sectional view of the movable mechanism 101 as seen from the direction of the broken line VI-VI in FIG. 28, in a state in which the cover 6 is closed.

Note that FIGS. 26 to 30 are drawings that respectively correspond to FIGS. 6, 9, 10, 14, and 15 in the first embodiment. FIGS. 32 to 34 are drawings that respectively correspond to FIGS. 21 to 23 in the first embodiment. FIGS. 31 and 35 are drawings that each correspond to FIG. 8 in the first embodiment. However, FIGS. 26 and 29 to 31 show a state in which the cover 6 is open (that is, a state in which the roller holder 18 is in the stand-by position and the sensor holder 19 is in the separated position). FIGS. 32 to 35 show a state in which the cover 6 is closed (that is, a state in which the roller holder 18 is in the printing position and the sensor holder 19 is in the identification position).

The printer according to the present embodiment is provided with a Movable mechanism 101, hereinafter described, instead of the movable mechanism 100 in the first embodiment. In the movable mechanism 101, the upper edge portion of the first holder opening edge 182 projects slightly toward the rear of the front surface of the roller holder 18 (refer to FIGS. 31 and 35). A holder protruding portion 190 that protrudes upward higher than the upper edge portion of the first holder opening edge 182 is provided in the upper left portion of the sensor holder 19 (refer to FIGS. 27 and 28). The first holder opening edge 182 and the holder protruding portion 190 will be described later.

The operating modes of the movable mechanism 101 are basically the same as those of the movable mechanism 100 in the first embodiment. That is, the release rod 17 moves to the left in conjunction with the downward closing of the cover 6. In accordance with the movement of the release rod 17, the roller holder 18 moves to the printing position, and the sensor holder 19 moves to the identification position (refer to FIGS. 32 to 35). This fixes the tape cassette 30 firmly in the cassette mounting portion 8 and creates a state in which stable and accurate printing can be performed. The switch terminals 231 are pressed against the arm indicator portion 800, creating a state in which the type of tape in the tape cassette 30 can be determined. Furthermore, the sensor protective plate 90 is maintained in a state of having moved into the arm accommodating portion 79, so upward movement of the tape cassette 30 is restricted by the sensor protective plate 90 (refer to FIG. 20).

In contrast, the release rod 17 moves to the right in conjunction with the upward opening of the cover 6. In accordance with the movement of the release rod 17, the roller holder 18 moves to the stand-by position, and the sensor holder 19 moves to the separated position (refer to FIGS. 26 and 29 to 31). The movable feed roller 14, the platen roller 15, the sensor protective plate 90, the latching piece 192, and the switch terminals 231 thus retract to below the plate 13, so these members are unlikely to interfere with the tape cassette 30 that is being one of mounted in and removed from the cassette mounting portion 8. That is, the printer 1 enters a state in which tape cassette 30 can be freely mounted in and removed from the cassette mounting portion 8.

Next, an operating mode of the movable mechanism 101 will be explained in which, in a case where the platen roller 15 and the thermal head 10 are adhering to one another, for example, the adhesion between the platen roller 15 and thermal head 10 is released. In the explanation that follows, the tape cassette 30, which is depicted by broken lines in FIGS. 30 and 34, will be explained as not being mounted in the cassette mounting portion 8.

For example, in a case where the cover 6 is kept in the closed state for a long time, without the tape cassette 30 being mounted in the cassette mounting portion 8, it may happen that the platen roller 15 and the thermal head 10 adhere to one another, such that the roller holder 18 is mistakenly fixed in the printing position. In a case where the roller holder 18 is mistakenly fixed in the printing position, the movable feed roller 14 and the platen roller 15 would interfere with the tape cassette 30 if an attempt were made to mount the tape cassette 30 in the cassette mounting portion 8, so the tape cassette 30 cannot be mounted in the cassette mounting portion 8.

In the present embodiment, when the cover 6 is opened upward from the state in which it is in the closed position (refer to FIGS. 32 to 35), the release rod 17 moves to the right from the left end position (refer to FIG. 34) in accordance with the upward rotation of the lever 16. However, in a case where the platen roller 15 is adhering to the thermal head 10, it is possible that the roller holder 18 will not rotate toward the front, even though the urging spring is applying its urging force to the roller holder 18 in the direction from the printing position toward the stand-by position.

At the same time, in a case where the cover 6 is opened upward, the holder guide portion 199 slides along the rod guide portion 175. Therefore, the sensor holder 19 starts to move from the identification position (refer to FIG. 34) toward the separated position (refer to FIG. 30) (that is, toward the front), regardless of whether or not the platen roller 15 is adhering to the thermal head 10. At this time, if the platen roller 15 is adhering to the thermal head 10, the front surface of the holder protruding portion 190 (refer to FIGS. 31 and 35) comes into contact with the upper edge portion of the first holder opening edge 182. In other words, the sensor holder 19 presses toward the front against the roller holder 18, so the platen roller 15 is pulled away from the thermal head 10. The roller holder 18 is thus released from the state in which it was mistakenly fixed in the printing position and becomes able to rotate toward the front, so the roller holder 18 is moved to the stand-by position (refer to FIG. 30) by the urging force of the urging spring (not shown in the drawings).

As explained above, in the printer according to the second embodiment, in a case where the platen roller 15 and the thermal head 10 are adhering to one another, for example, the holder protruding portion 190 presses against the first holder opening edge 182 in accordance with the movement of the sensor holder 19 from the identification position to the separated position. This makes it possible for the roller holder 18 to be released from the state in which it has been mistakenly fixed in the printing position and for the roller holder 18 to be rotated toward the stand-by position.

The holder protruding portion 190 is provided on the sensor holder 19, so it is not necessary to provide a part separately from the sensor holder 19 in order to release the roller holder 18 from the mistakenly fixed state. That means it is not necessary to provide a space between the platen roller 15 and the holder shaft 181 in order to provide a part for releasing the roller holder 18 from the mistakenly fixed state. It is therefore possible for both the sensor holder 19 and the part for releasing the roller holder 18 from the mistakenly fixed state to be provided between the platen roller 15 and the holder shaft 181. This makes it possible to limit any increase in the size of the printer 1.

The sensor holder 19 in which the mechanical sensors 23 are provided is provided between the platen roller 15 and the holder shaft 181, which is the center of rotation for the roller holder 18. The sensor holder 19 is provided within the space where the roller holder 18 is disposed, so it is not necessary to provide a separate space in which the sensor holder 19 would be disposed. It is therefore possible to provide the sensor holder 19, which operates independently of the roller holder 18, without increasing the size of the printer 1, which is useful for conserving space within the printer housing. The degree of freedom in the printer design is also increased.

The holder protruding portion 190 is provided in the upper left portion of the sensor holder 19. In other words, the holder protruding portion 190 is provided in an area that is farther away from the holder shaft 181 than is the center of the sensor holder 19 in the left-right direction. Therefore, in a case where the platen roller 15 and the thermal head 10 are adhering to one another, for example, the force that is required in order to release the adhesion between the platen roller 15 and the thermal head 10 is less than would be required if the holder protruding portion 190 were provided in a position closer to the holder shaft 181. Therefore, the state in which the roller holder 18 is mistakenly fixed in the printing position can be released more reliably.

The roller holder 18 and the sensor holder 19 can be moved independently of one another by moving the release rod 17. Furthermore, in a case where the roller holder 18 is mistakenly fixed in the printing position, the holder protruding portion 190 is brought into contact with the first holder opening edge 182 by moving the release rod 17, making it possible to release the mistakenly fixed state of the roller holder 18.

The movements of the release rod 17 are coupled with the opening and closing operations of the cover 6. Therefore, even in a case where the platen roller 15 and the roller holder 18 are mistakenly fixed in the printing position, when the user performs the operation of opening the cover 6, the fixing of the platen roller 15 and the roller holder 18 in the printing position is released. Therefore, in a case where the user opens the cover 6 in order to use the printer 1, the roller holder 18 and the platen roller 15 will definitely move to the stand-by position. It is therefore possible, when the user mounts and removes the tape cassette 30, to prevent the tape cassette 30 from interfering with the platen roller 15.

A printer and a tape cassette according to a third embodiment will be explained with reference to FIGS. 36 to 47. In FIGS. 36 to 47, the same reference numerals are used for the structural elements that are the same as in the printer 1 and the tape cassette 30 according to the first embodiment. Hereinafter, explanations of the structural elements that are the same as in the first embodiment will be omitted, and only the points that are different from the first embodiment will be explained.

Figure 36:
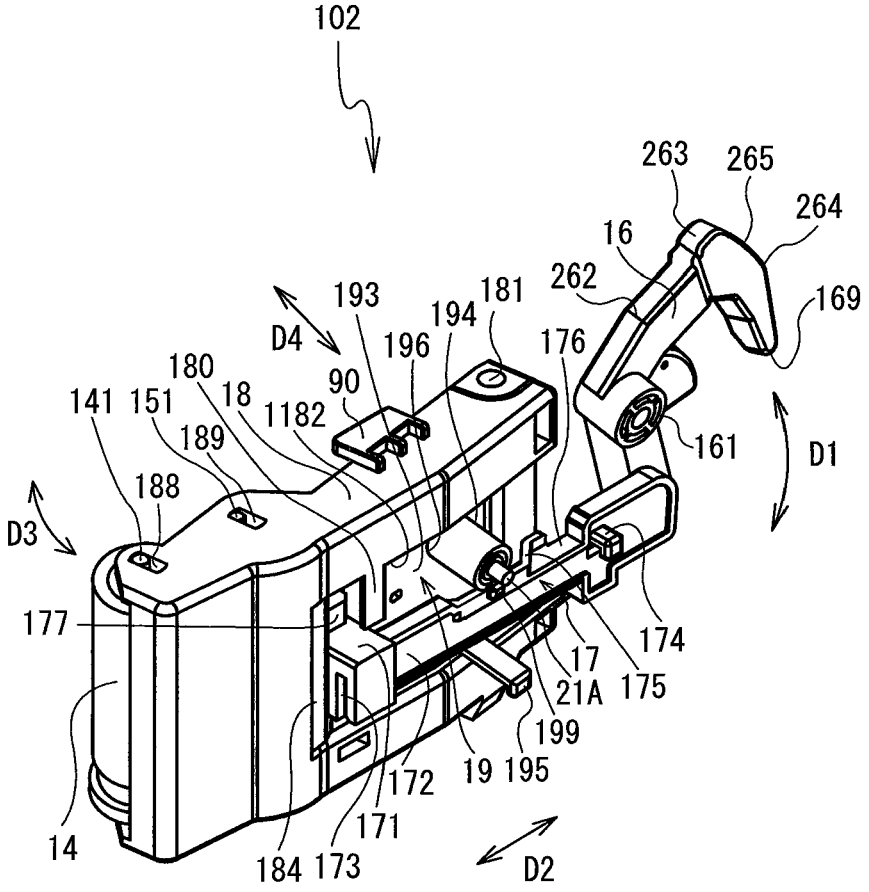
FIG. 36 is an oblique view of a movable mechanism 102 from which the wall 20 has been removed, as seen obliquely from the front.
Figure 37:
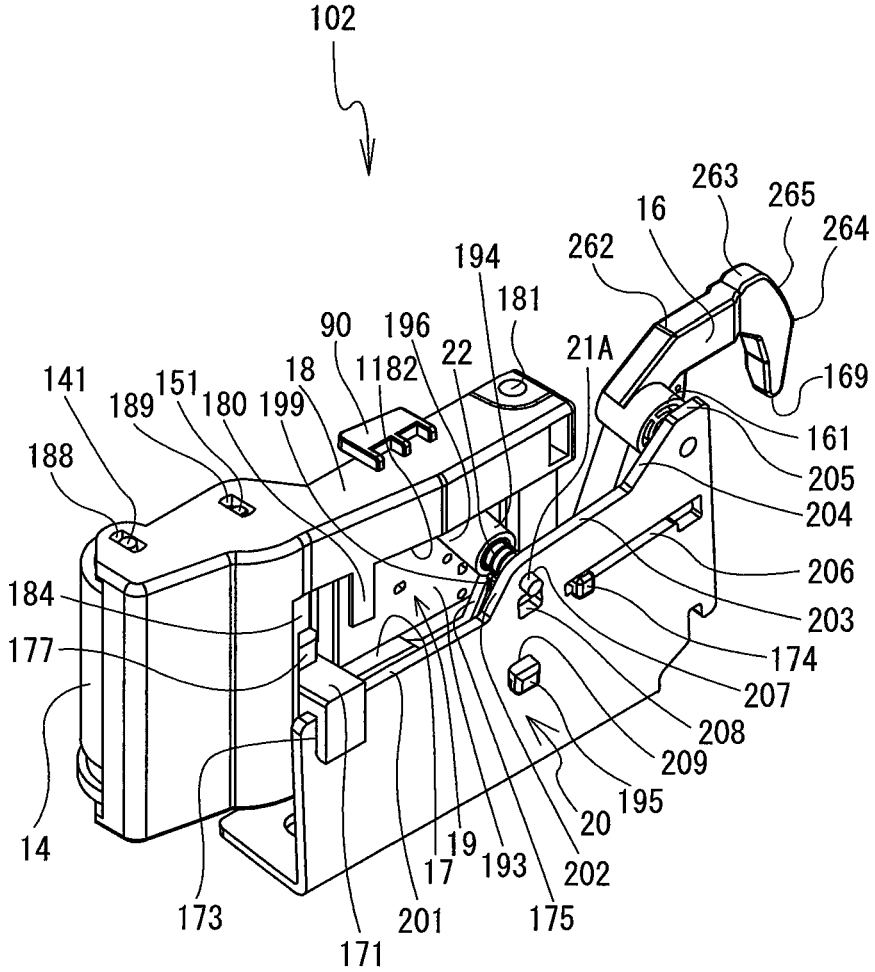
FIG. 37 is an oblique view of the movable mechanism 102, as seen obliquely from the front.
Figure 38:
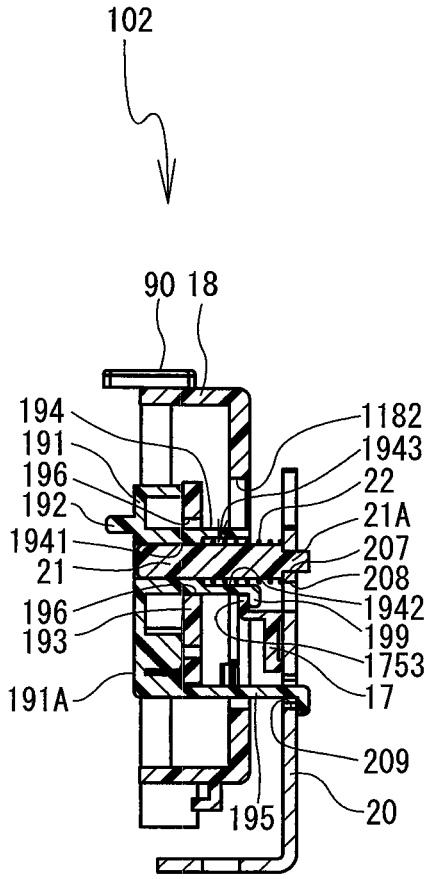
FIG. 38 is a vertical sectional view of the movable mechanism 102 in a state in which the cover 6 is closed.
Figure 40:
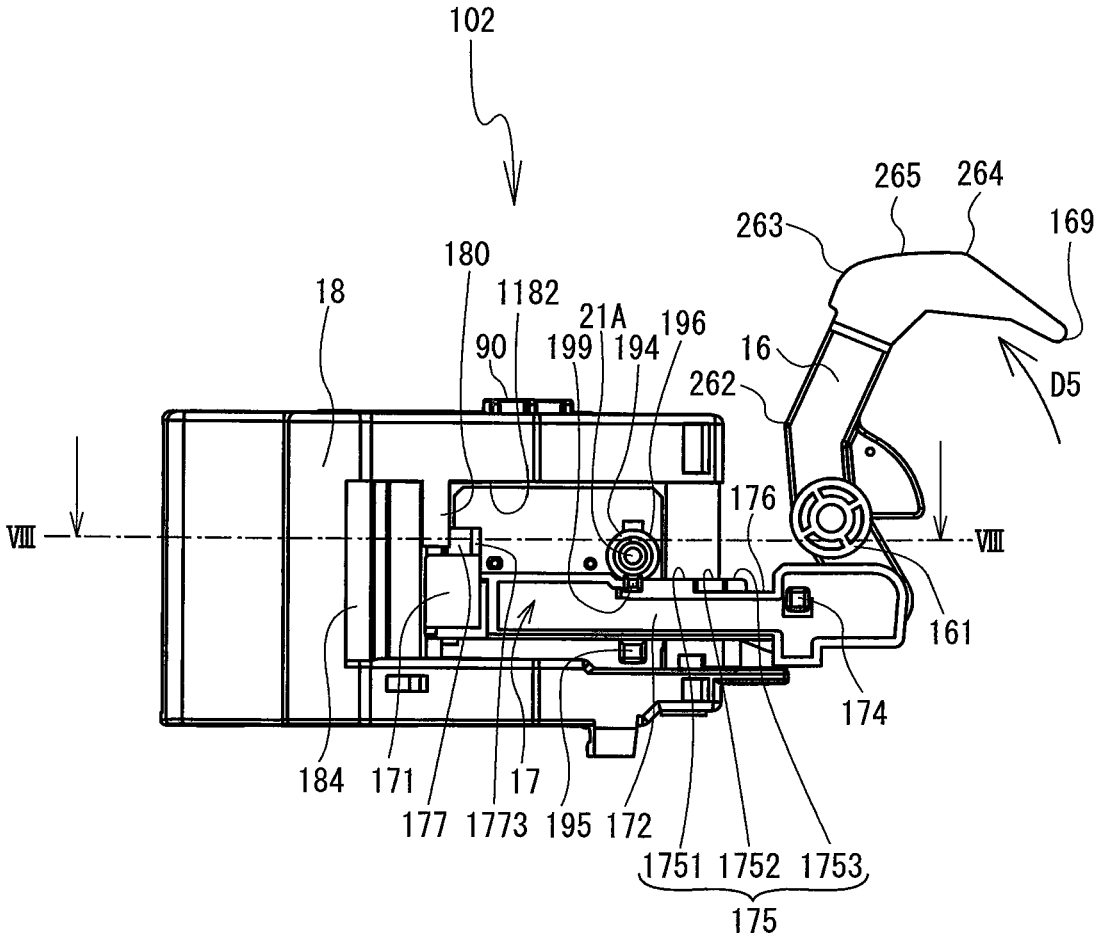
FIG. 40 is a front view of the movable mechanism 102 in a state in which the cover 6 is open.
Figure 41:
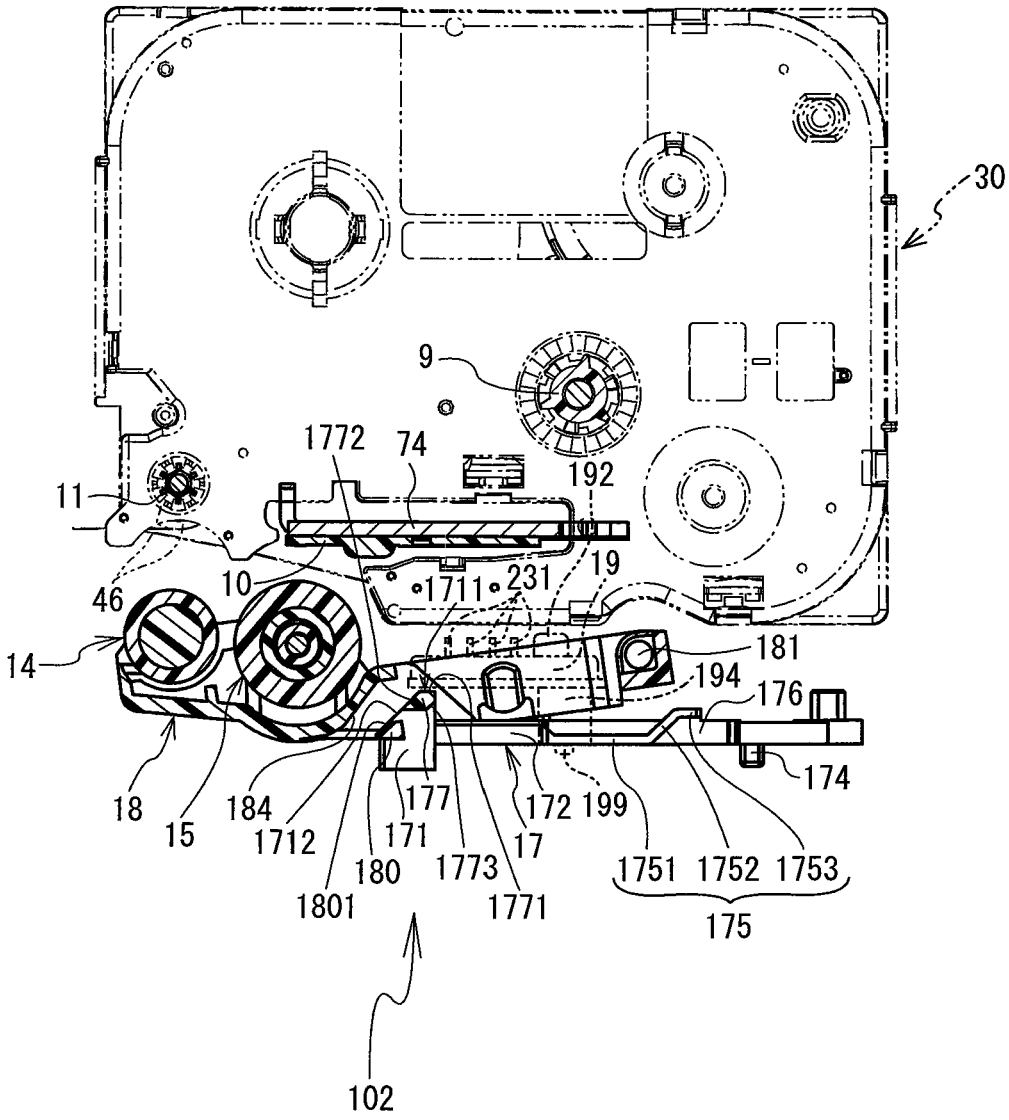
FIG. 41 is a sectional view in the direction of the broken line VIII-VIII in FIG. 40, and a plan view that shows the tape cassette 30, the tape drive shaft 11, and the thermal head 10.
Figure 42:
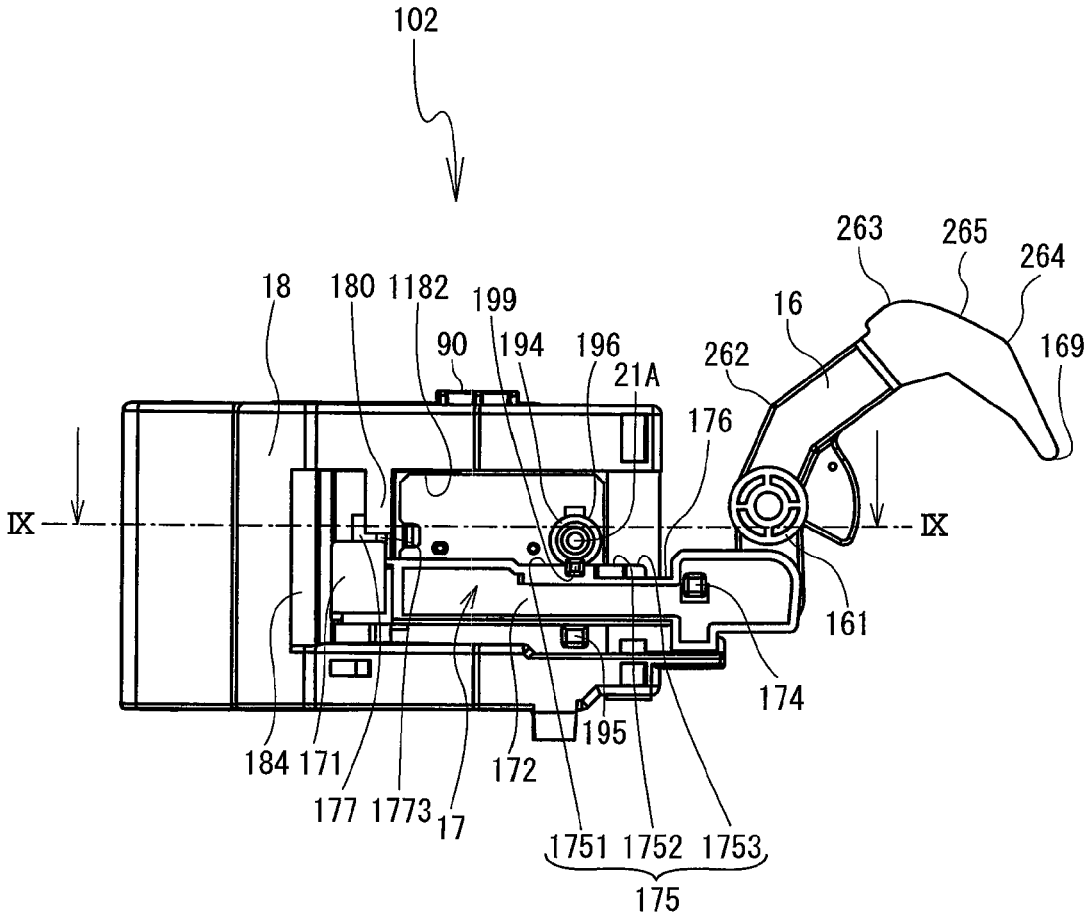
FIG. 42 is a front view of the movable mechanism 102 in a state in which the cover 6 is in the process of being opened/closed.
Figure 43:
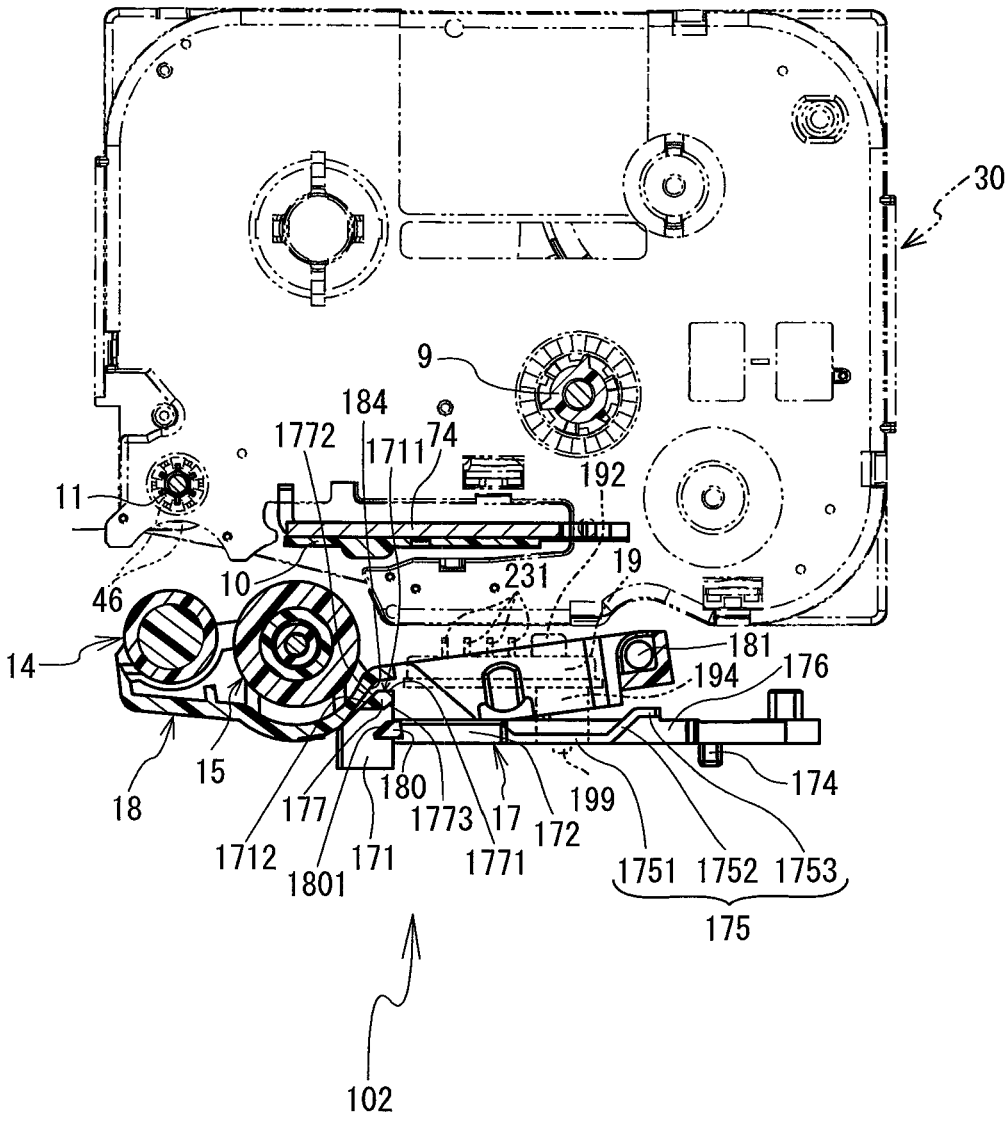
FIG. 43 is a sectional view in the direction of the broken line IX-IX in FIG. 42, and a plan view that shows the tape cassette 30, the tape drive shaft 11, and the thermal head 10.
Figure 44:
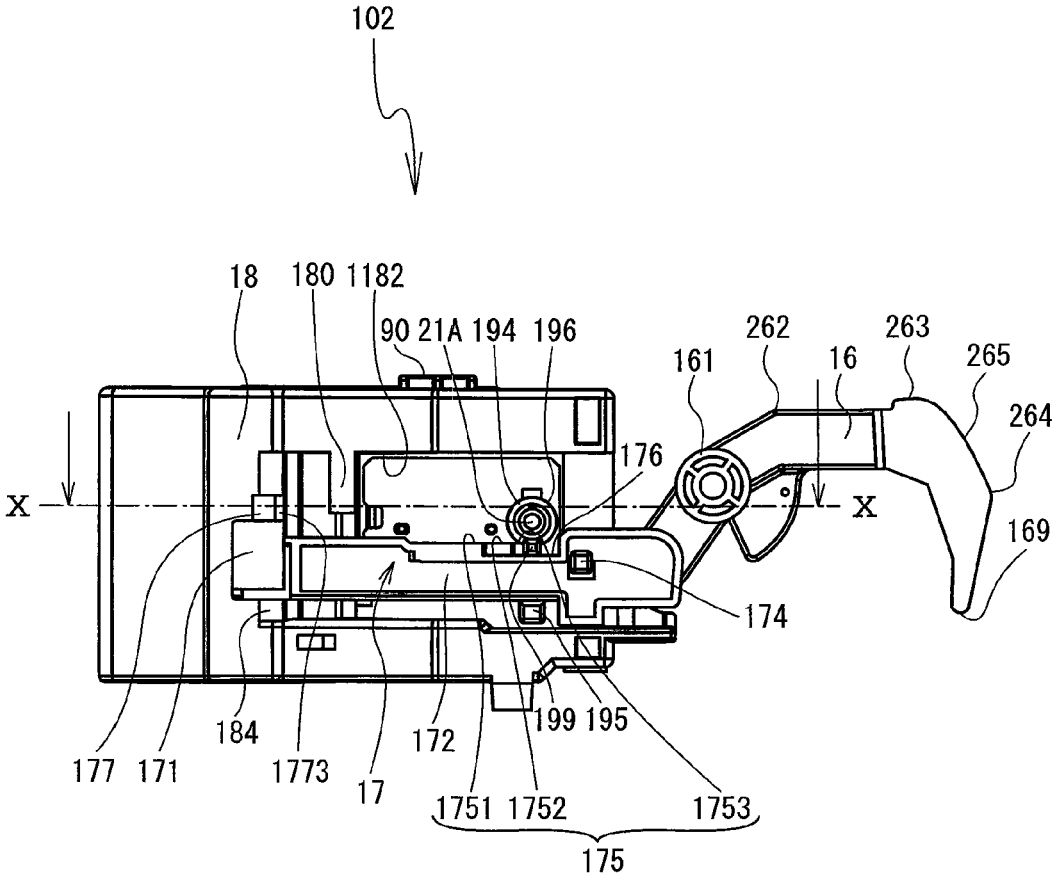
FIG. 44 is a front view of the movable mechanism 102 in a state in which the cover 6 is closed.
Figure 45:
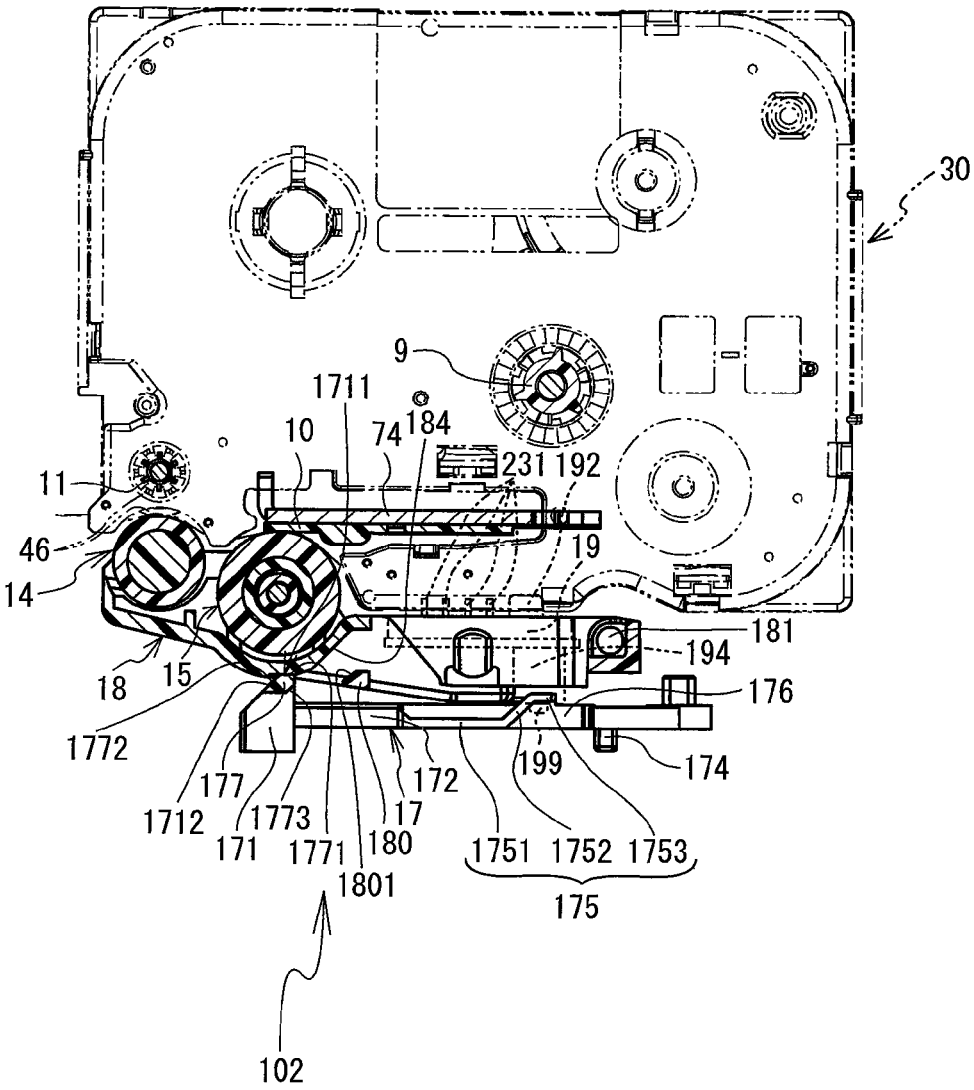
FIG. 45 is a sectional view in the direction of the broken line X-X in FIG. 44, and a plan view that shows the tape cassette 30, the tape drive shaft 11, and the thermal head 10.

Note that FIGS. 36 to 39 are drawings that respectively correspond to FIGS. 6 to 8 and 10 in the first embodiment. FIGS. 40 to 45 are drawings that respectively correspond to FIGS. 14, 15, 18, 19, 22, and 23 in the first embodiment. However, FIG. 37, is a drawing in which the lever 16 and the release rod 17 have not been removed. FIGS. 40 and 41 show a state in which the cover 6 is open (that is, a state in which the roller holder 18 is in the stand-by position and the sensor holder 19 is in the separated position). FIGS. 36, 42, and 43 show a state in which the cover 6 is in the process of being closed (that is, a state in which the roller holder 18 is in the stand-by position and the sensor holder 19 is in the separated position). FIGS. 37, 44, and 45 show a state in which the cover 6 is closed (that is, a state in which the roller holder 18 is in the printing position and the sensor holder 19 is in the identification position).

Figure 18:
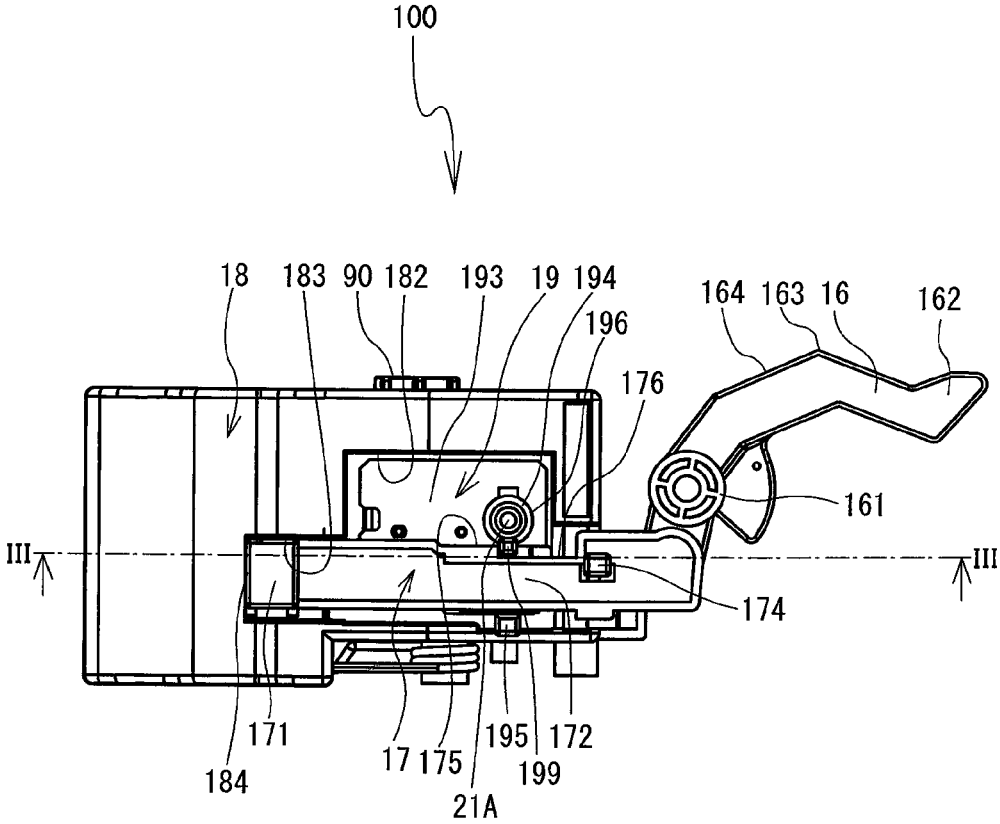
FIG. 18 is a front view of the movable mechanism 100 that is shown in FIG. 17.
Figure 19:
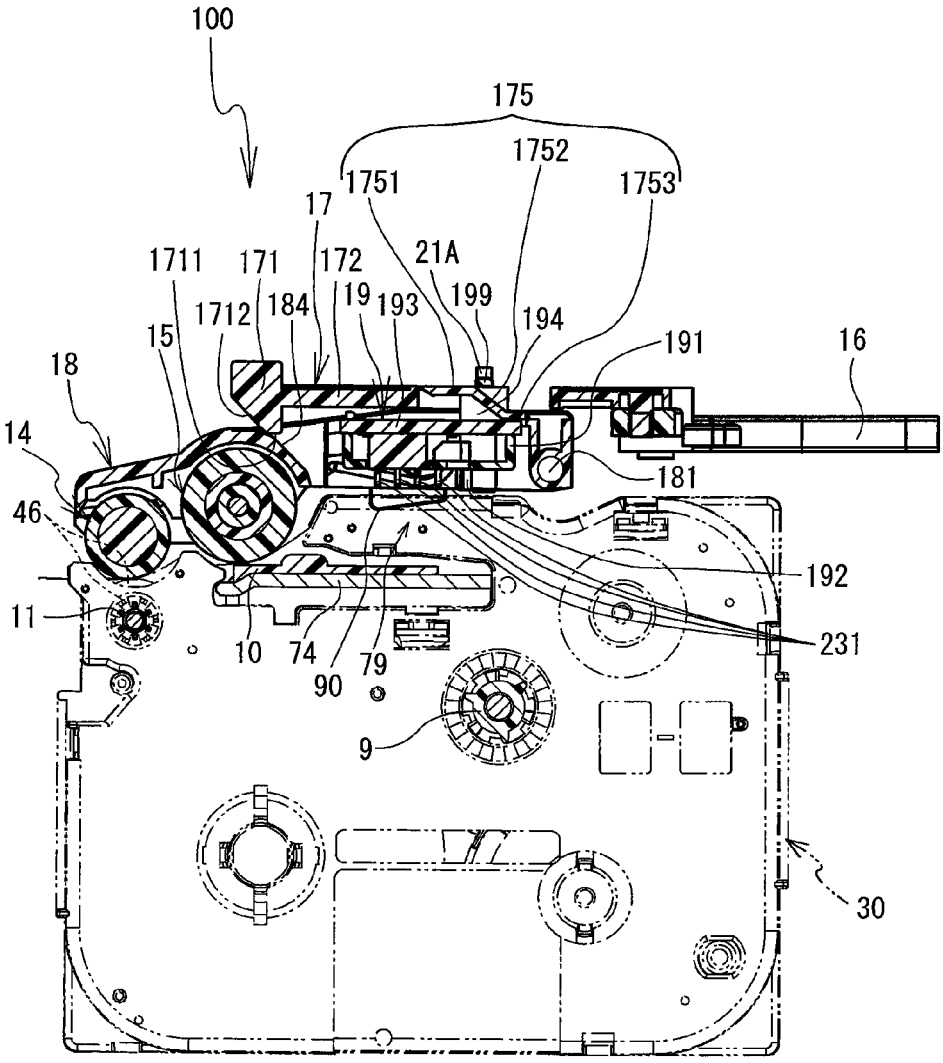
FIG. 19 is a sectional view of the movable mechanism 100 in the direction of the broken line in FIG. 18, and a bottom plan view that shows the tape cassette 30, the tape drive shaft 11, and the head holder 74.
Figure 46:
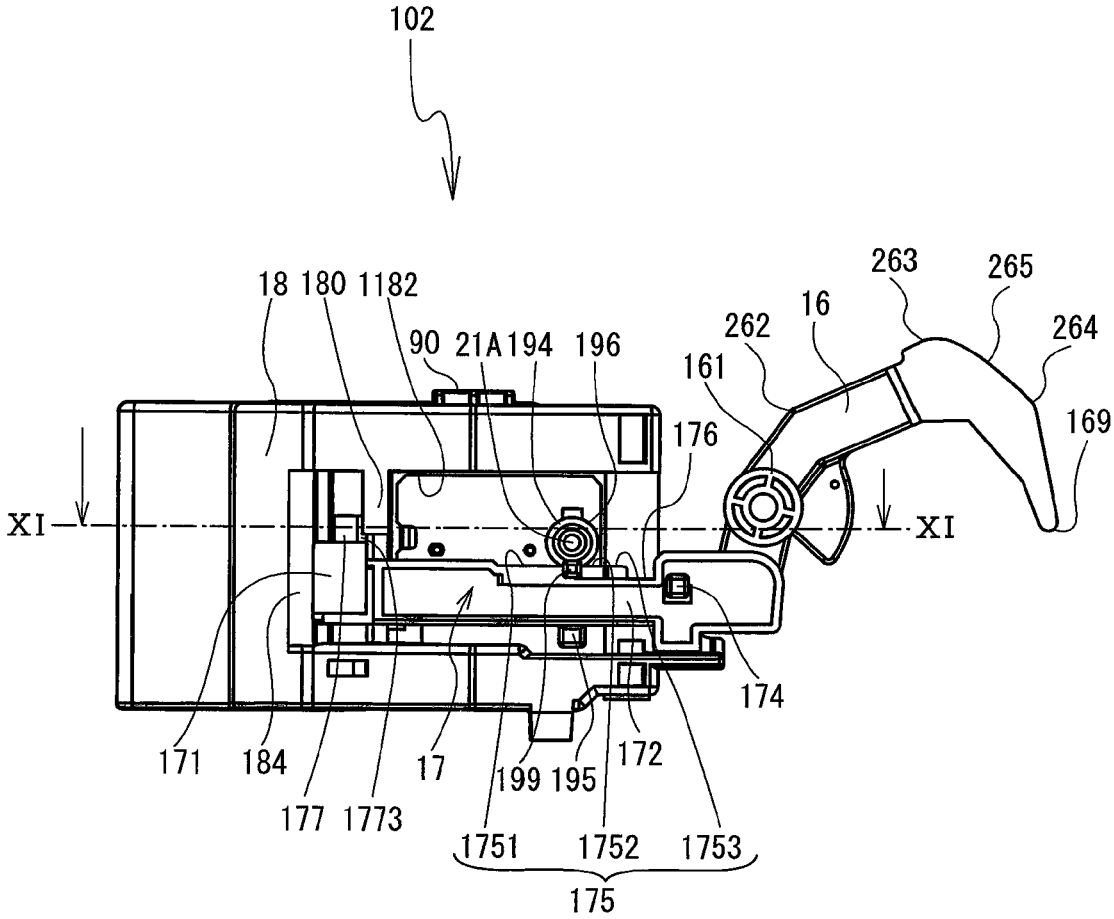
FIG. 46 is a front view of the movable mechanism 102 in a state in which a rod projecting portion 177 and a holder projecting portion 180 are in contact.
Figure 47:
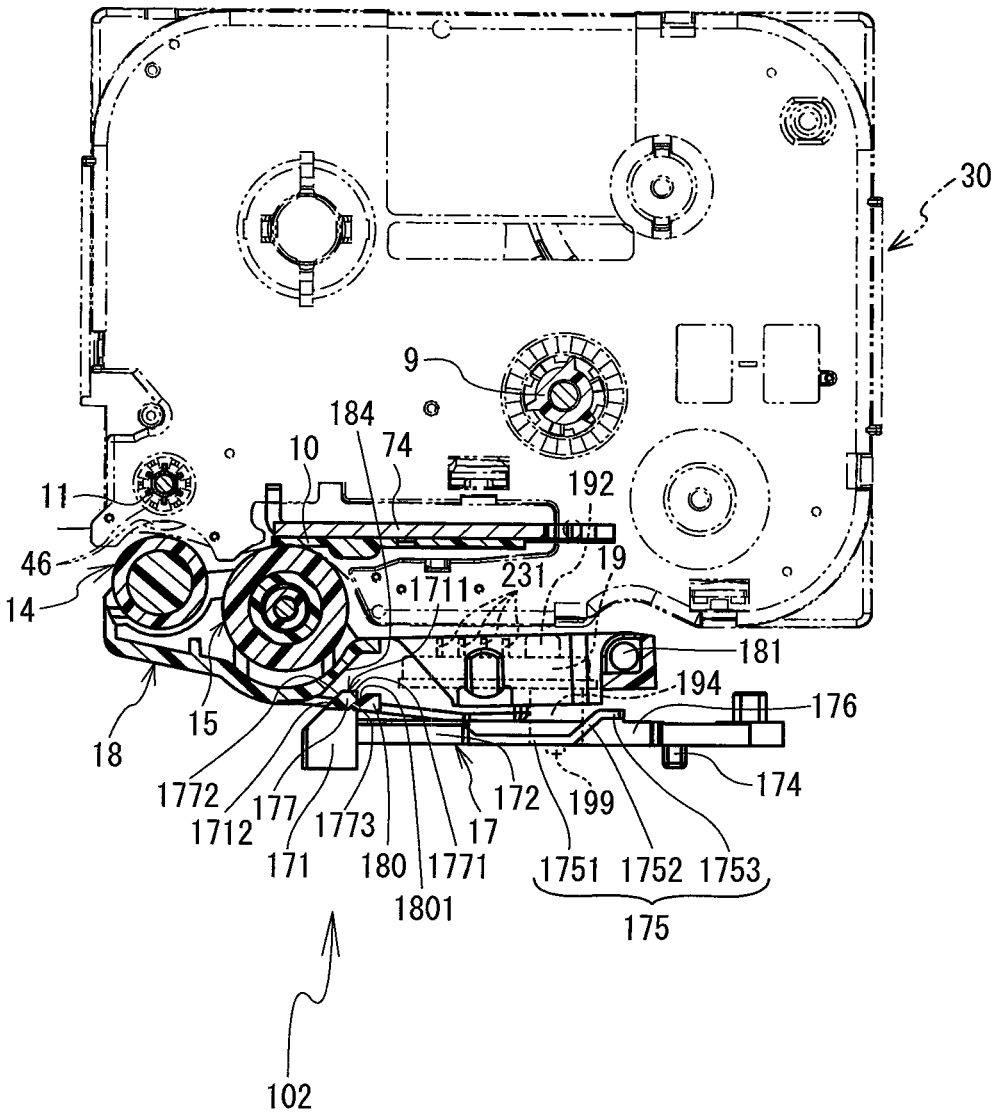
FIG. 47 is a sectional view in the direction of the broken line XI-XI in FIG. 46, and a plan view that shows the tape cassette 30, the tape drive shaft 11, and the thermal head 10.

Furthermore, FIGS. 46 and 47 are drawings that respectively correspond to FIGS. 18 and 19 in the first embodiment, and they show the state in which the cover 6 is in the process of being closed. However, FIGS. 46 and 47 show a state in which the platen roller 15 and the thermal head 10 are adhering to one another (that is, a state in which the roller holder 18 is in the printing position).

The printer according to the present embodiment is provided with a movable mechanism 102, hereinafter described, instead of the movable mechanism 100 in the first embodiment.

The lever 16 according to the present embodiment is different from that of first embodiment (refer to FIGS. 36 and 37) in shape. As shown FIGS. 36, the lever 16 in the present embodiment includes a first curved portion 262, a second curved portion 263, and a third curved portion 264. As shown in FIG. 40, in a case where the cover 6 is in the open position (refer to FIG. 2), the lever 16 extends approximately upward, the first curved portion 262 is curved to the upper right, the second curved portion 263 is curved approximately to the right, and the third curved portion 264 is curved slightly to the lower right. In a case where the cover 6 is in the open position, the third curved portion 264 is at its highest position. The upper surface of the lever 16 between the second curved portion 263 and the third curved portion 264 is called a contact surface 265. The second curved portion 263, the third curved portion 264, and the contact surface 265 are portions that come into contact with the lever depressing portion 61 (refer to FIG. 2) when the cover 6 is being closed and will be described in detail later. A lever tip portion 169 that is the tip of lever 16 is a portion that comes into contact with the projecting piece 63 (refer to FIG. 2) when the cover 6 is being opened.

Unlike in the first embodiment, the release rod 17 according to the present embodiment is provided with a rod projecting portion 177 that projects upward from the pressing portion 171 (refer to FIGS. 36 and 37). As shown in FIGS. 40 and 41, the rod projecting portion 177 configures a part of the rear surface 1711 and a part of the slanting surface 1712. In the rod projecting portion 177, the surface that configures a part of the rear surface 1711 is called a first projecting surface 1771, and the surface that configures a part of the slanting surface 1712 is called a second projecting surface 1772. In the rod projecting portion 177, the surface that is on the opposite side from the second projecting surface 1772 is called a third projecting surface 1773. The third projecting surface 1773 is slanted from the left front toward the right rear. In a case where the platen roller 15 is adhering to the thermal head 10, for example, the third projecting surface 1773 comes into contact with a holder projecting surface 1801 and releases the adhesion. This will be described in detail later.

Furthermore, as shown in FIGS. 36, 37, and 40, in the release rod 17 according to the present embodiment, the concavity 176 is provided within a specified range that extends toward the right from a position that is slightly to the left of the center of the body portion 172 in the left-right direction. The first rod guide portion 1751 extends from the left end of the concavity 176 to approximately the center of the concavity 176.

Figure 39:
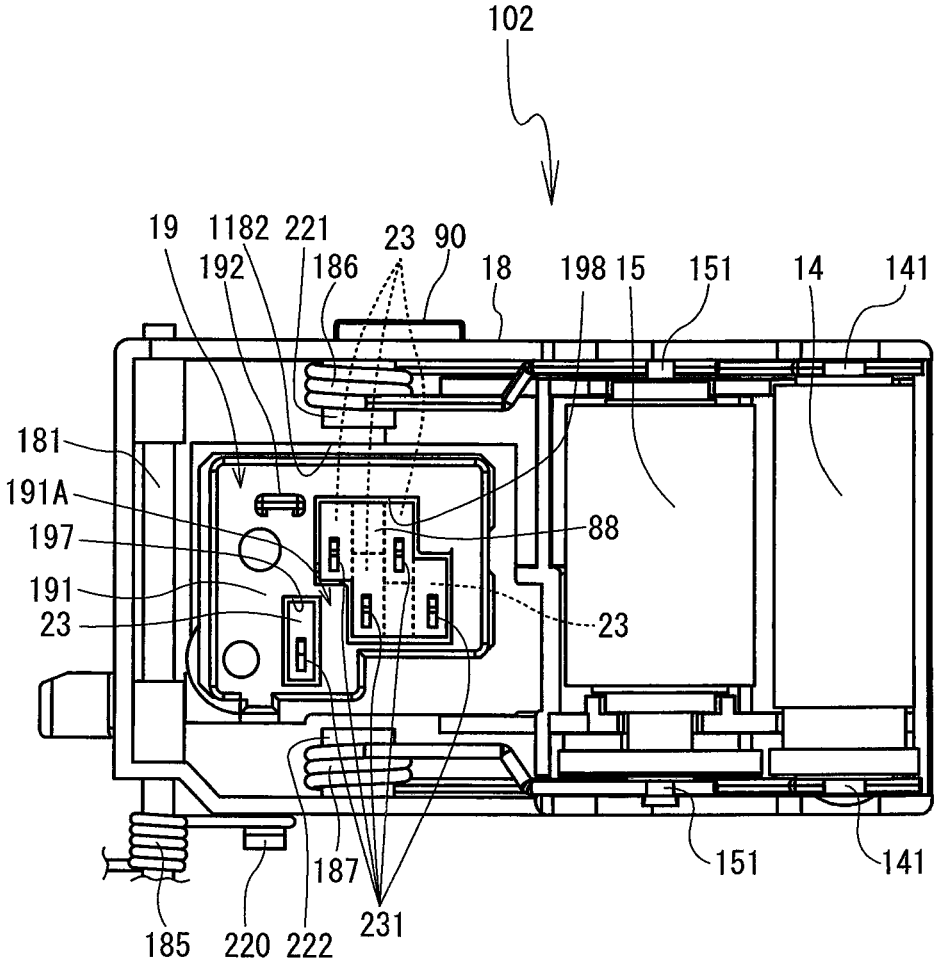
FIG. 39 is a rear view of the roller holder 18 and the sensor holder 19 of the movable mechanism 102.

As shown in FIGS. 36, 37, and 39, in the roller holder 18 according to the present embodiment, a shaft 141 that is the axis of rotation of the movable feed roller 14 is rotatably supported by shaft support holes 188 that are provided in the top surface and the bottom surface of the roller holder 18. A shaft 151 that is the axis of rotation of the platen roller 15 is rotatably supported by shaft support holes 189 that are provided in the top surface and the bottom surface of the roller holder 18. Each of the shaft support holes 188, 189 is a hole that is long in the front-rear direction.

As shown in FIGS. 36 to 41, instead of the first holder opening edge 182 and the second holder opening edge 183, a holder opening edge 1182 that forms a roughly rectangular opening in a front view is provided between the holder shaft 181 and the platen roller 15 in the roller holder 18. The holder opening edge 1182 is provided in the front surface of the roller holder 18 and extends from the right edge of the roller holder 18 to in front of the position where the platen roller 15 is held. The holder side pressed portion 184 is provided to the rear of the left portion of the holder opening edge 1182. The release rod 17 is disposed such that the body portion 172 extends in the left-right direction inside the holder opening edge 1182 and the pressing portion 171 is inserted into the left portion of the holder opening edge 1182 from the right.

A holder projecting portion 180 that projects downward from the top of the holder opening edge 1182 is provided slightly to the right of the left edge of the holder opening edge 1182. The holder projecting surface 1801, which is the left surface of the holder projecting portion 180, is slanted from the left front toward the right rear. In a case where the platen roller 15 has adhered to the thermal head 10, the holder projecting surface 1801 releases the adhesion by being pressed against the third projecting surface 1773 of the release rod 17. This will be described in detail later.

A coil portion of a coil spring 185 is fitted onto the bottom of the holder shaft 181. Two arm portions are provided that extend radially outward from the coil portion of the coil spring 185. One of the arms portions is affixed to a spring holding portion 220 that projects downward from the bottom surface of the roller holder 18, and the other arm portion is fixed to a bottom plate (not shown in the drawings) of the cassette mounting portion 8 (refer to FIG. 2). The coil spring 185 is constantly elastically urged such that it causes the roller holder 18 to rotate toward the front (the lower right in FIG. 36). The elastic energy that is accumulated in the coil spring 185 (that is, the force that urges toward the front) increases as the roller holder 18 rotates farther toward the rear (the upper left in FIG. 36).

In a state in which the holder side pressed portion 184 is not being pressed by the urging force of the coil spring 185, the roller holder 18 is held in the stand-by position (refer to FIG. 41). When the release rod 17 moves to the left, the pressing portion 171 comes into contact with and presses against the holder side pressed portion 184 inside the holder opening edge 1182. In this case, the roller holder 18 moves toward the rear from the stand-by position (upward in FIG. 41). This will be described in detail later.

A spring holding portion 221 that projects downward from the top plate of the roller holder 18 and a spring holding portion 222 that projects upward from the bottom plate of the roller holder 18 are provided on the inner top and bottom surfaces of the roller holder 18 such that they are opposite one another in the up-down direction. Coil portions of roller springs 186, 187 that are a top-bottom pair of coil springs are respectively fitted onto the spring holding portions 221, 222. Two arm portions are provided on each of the roller springs 186, 187, extending radially outward from the coil portions. The arms portions extend to the left (to the right in FIG. 39) along the top plate and the bottom plate, respectively, of the roller holder 18.

Of the two arm portions that are provided on each of the roller springs 186, 187, extending radially outward from the coil portions, one arm portion on each of the roller springs 186, 187 is fixed to the surface on the inner side of the roller holder 18. The other arm portion on the roller spring 186 is in contact with the front side of the shaft 151 on the upper end of the platen roller 15 and in contact with the front side of the shaft 141 on the upper end of the movable feed roller 14. The other arm portion on the roller spring 187 is in contact with the front side of the shaft 151 on the bottom end of the platen roller 15 and in contact with the front side of the shaft 141 on the bottom end of the movable feed roller 14.

The roller springs 186, 187 constantly elastically urge the shafts 141, 151 at a specified pressure, such that they cause the movable feed roller 14 and the platen roller 15 to move toward the rear (the upper left in FIG. 36). The elastic energy that is accumulated in the roller springs 186, 187 (that is, the force that urges toward the rear) increases as the movable feed roller 14 and the platen roller 15 move farther toward the front (the lower right in FIG. 36). In a state in which the movable feed roller 14 and the platen roller 15 are not pressed, the movable feed roller 14 and the platen roller 15 move toward rear to a position where the shafts 141, 151 come into contact with the rear ends of the shaft support holes 188, 189, respectively.

Note that the length that the spring holding portion 221 projects downward (its length in the up-down direction) is slightly less than the distance in the up-down direction from the top plate of the roller holder 18 to the holder opening edge 1182. The length that the spring holding portion 222 projects upward (its length in the up-down direction) is slightly less than the distance in the up-down direction from the bottom plate of the roller holder 18 to the holder opening edge 1182. Therefore, the spring holding portions 221, 222 and the roller springs 186, 187 do not interfere with the sensor holder 19, which is disposed inside the holder opening edge 1182.

The sensor holder 19 according to the present embodiment is provided inside the holder opening edge 1182 toward the rear (the upper left in FIG. 36) from the release rod 17.

The operating modes of the movable mechanism 102 will be explained in detail with reference to FIGS. 36, 37, and 40 to 45. First, the operating mode of the movable mechanism 102 in a case where the cover 6 is moved from the open position (refer to FIG. 2) to the closed position (refer to FIG. 1) by being closed downward will be explained.

As shown in FIGS. 40 and 41, when the cover 6 is in the open position, the release rod 17 is at the right end position of its range of movement, in the same manner as in the first embodiment. In a case where the cover 6 moves from the open position to the closed position, the lever depressing portion 61 (refer to FIG. 2) comes into contact with and depresses the third curved portion 264, the contact surface 265, and the second curved portion 263, in that order. Therefore, the lever 16 rotates downward around the lever shaft 161 (in the opposite direction from the rotation direction D5 in FIG. 40) against the urging force of the lever spring (not shown in the drawings). In accordance with the rotation of the lever 16, the release rod 17 moves to the left.

In the state in which the cover 6 is in the open position (refer to FIGS. 40 and 41), the roller holder 18 is held in the stand-by position, in the same manner as in the first embodiment. At this time, the rod projecting portion 177 of the release rod 17 is positioned farther to the right in the left-right direction than is the holder projecting portion 180.

In a case where the cover 6 is closed by the user, the release rod 17 moves to the left from the right end position, in the same manner as in the first embodiment. At this time, the rod projecting portion 177 moves to the left and passes behind the holder projecting portion 180. That is, the rod projecting portion 177 does not come into contact with the holder projecting portion 180. As shown in FIGS. 36, 42, and 43, as the release rod 17 moves to the left, the roller holder 18 rotates toward the rear against the urging force of the coil spring 185, in the same manner as in the first embodiment.

As shown in FIGS. 37, 44, and 45, when the release rod 17 moves to the left end position, the rear surface 1711 of the pressing portion 171 and the first projecting surface 1771 come into contact with the holder side pressed portion 184. In other words, the roller holder 18 moves to the printing position, in the same manner as in the first embodiment. At this time, the platen roller 15 presses against the thermal head 10 through the film tape 59 and the ink ribbon 60 that are positioned in the exposing portion 77. The movable feed roller 14 presses against the tape drive roller 46, into which the tape drive shaft 11 has been inserted. The shaft 141 and the shaft 151 are moved against the urging forces of the roller springs 186, 187, respectively (refer to FIG. 39), such that their positions in relation to the roller holder 18 change to positions that are in the centers of the shaft support hole 188 and the shaft support hole 189, respectively, in the front-rear direction (refer to FIG. 37).

In the state in which the cover 6 is in the open position, as shown in FIGS. 40 and 41, the sensor holder 19 is held in the separated position, in the same manner as in the first embodiment. In accordance with the movement of the release rod 17 to the left, the portions with which the holder guide portion 199 is engaged change from the first rod guide portion 1751 to the rod guide diagonal portion 1752 to the second rod guide portion 1753, in that order. As shown in FIGS. 37, 44, and 45, when the release rod 17 moves to the left end position, the sensor holder 19 moves to the identification position.

Thus the release rod 17 moves to the left in conjunction with the downward closing of the cover 6. In accordance with the movement of the release rod 17, the roller holder 18 moves to the printing position, and the sensor holder 19 moves to the identification position (refer to FIGS. 37, 44, and 45). The tape cassette 30 is thus firmly fixed inside the cassette mounting portion 8, creating a state in which stable and accurate printing is possible. The switch terminals 231 are pressed into contact with the arm indicator portion 800, creating a state in which the type of tape in the tape cassette 30 can be determined. Furthermore, the state in which the sensor protective plate 90 has moved into the arm accommodating portion 79 is maintained, so the upward movement of the tape cassette 30 is restricted by the sensor protective plate 90 (refer to FIG. 20).

Next, the operating mode of the movable mechanism 102 in a case where the cover 6 is moved from the closed position (refer to FIG. 1) to the open position (refer to FIG. 2) by being opened upward will be explained. When the cover 6 is opened upward from the closed position, the top surface of the projecting piece 63 pushes the lever tip portion 169 upward. The upwardly pushed lever 16 is urged by the lever spring (not shown in the drawings) to rotate upward. In accordance with the rotation of the lever 16, the release rod 17 moves to the right from the left end position (refer to FIG. 45).

When the release rod 17 moves to the right from the left end position (refer to FIG. 45), the sensor holder 19 moves toward the front from the identification position (refer to FIG. 45) and is held in the separated position (refer to FIG. 41). For its part, the roller holder 18 moves toward the front from the printing position and is held in the stand-by position (refer to FIG. 41) when the release rod 17 moves to the right from the left end position (refer to FIG. 45). In a case where the release rod 17 moves from the left end position (refer to FIG. 45) to the right end position (refer to FIG. 41), the rod projecting portion 177 moves to the right behind the holder projecting portion 180. That is, the rod projecting portion 177 does not come into contact with the holder projecting portion 180.

Thus the release rod 17 moves to the right in conjunction with the upward opening of the cover 6. In accordance with the movement of the release rod 17, the roller holder 18 moves to the stand-by position, and the sensor holder 19 moves to the separated position (refer to FIGS. 40 and 41). This causes the movable feed roller 14, the platen roller 15, the sensor protective plate 90, the latching piece 192, and the switch terminals 231 to retract to below the plate 13, so these members are unlikely to interfere with the tape cassette 30 that is being one of mounted in and removed from the cassette mounting portion 8. In other words, the printer 1 is in a state in which the tape cassette 30 can be freely mounted in and removed from the cassette mounting portion 8.

Next, an operating mode of the movable mechanism 102 will be explained in which, in a case where the platen roller 15 and the thermal head 10 are adhering to one another, for example, the adhesion between the platen roller 15 and thermal head 10 is released. In the explanation that follows, the tape cassette 30, which is depicted by broken lines in FIGS. 45 and 47, will be explained as not being mounted in the cassette mounting portion 8.

For example, in a case where the cover 6 is kept in the closed state for a long time, without the tape cassette 30 being mounted in the cassette mounting portion 8, it may happen that the platen roller 15 and the thermal head 10 adhere to one another, such that the platen roller 15 is mistakenly fixed in the printing position. In a case where the platen roller 15 is mistakenly fixed in the printing position, the movable feed roller 14 and the platen roller 15 would interfere with the tape cassette 30 if an attempt were made to mount the tape cassette 30 in the cassette mounting portion 8, so the tape cassette 30 cannot be mounted in the cassette mounting portion 8.

In the present embodiment, when the cover 6 is opened upward from the state in which it is in the closed position (refer to FIGS. 44 and 45), the release rod 17 moves to the right from the left end position (refer to FIG. 45) in accordance with the upward rotation of the lever 16. However, in a case where the platen roller 15 is adhering to the thermal head 10, it is possible that the roller holder 18 will not rotate toward the front, even though the coil spring 185 is applying its urging force to the roller holder 18 in the direction from the printing position toward the stand-by position.

When the release rod 17 moves to the right, the pressing portion 171 of the release rod 17 is separated from the holder side pressed portion 184. At this time, the pressing of the rear surface 1711 and the first projecting surface 1771 against the holder side pressed portion 184 is released. Therefore, the roller holder 18 is rotated slightly toward the front by the urging forces of the roller springs 186, 187 (refer to FIG. 39). Specifically, the roller holder 18 rotates toward the front only by the distance that is necessary in order for the positions of the shafts 141, 151 (refer to FIG. 36) to change from the state of respectively being in the centers of the shaft support holes 188, 189 in the front-rear direction (refer to FIG. 37) to positions where the shafts 141, 151 come into contact with the rear ends of the shaft support holes 188, 189, respectively. In other words, the roller holder 18 moves to the contact position where the platen roller 15 comes into contact with the thermal head 10 (refer to FIG. 47). The roller holder 18 can also be moved toward the front from the contact position by the urging force of the coil spring 185.

However, in a case where the platen roller 15 is adhering to the thermal head 10, the movement of the roller holder 18 toward the front from the contact position is inhibited. In a state such as this, when the release rod 17 moves farther to the right, the rod projecting portion 177 comes into contact with the holder projecting portion 180, as shown in FIGS. 46 and 47. More specifically, the third projecting surface 1773 comes into contact with the holder projecting surface 1801. Both the third projecting surface 1773 and the holder projecting surface 1801 are slanted from the left front toward the right rear. Therefore, a force toward the front is applied to the holder projecting surface 1801 by the moving of the release rod 17 to the right. The roller holder 18 is rotated toward the front by the force toward the front, and the platen roller 15 is pulled away from the thermal head 10. The roller holder 18 is then moved to the stand-by position (refer to FIG. 41) by the urging force of the coil spring 185.

As explained above, in the printer according to the third embodiment, in a case where the platen roller 15 and the thermal head 10 are adhering to one another, for example, the third projecting surface 1773 comes into contact with the holder projecting surface 1801 as the release rod 17 moves from the left end position to the right end position, pressing against the roller holder 18. The state in which the roller holder 18 is mistakenly fixed in the contact position is thus released. Then the coil spring 185 moves the roller holder 18 to the stand-by position and holds it there. In other words, it is not necessary to form a groove for the release rod 17 to move the roller holder 18, as in the known printer.

It is therefore not necessary to ensure a distance in the left-right direction in which the groove would be disposed, and the position where the third projecting surface 1773 and the holder projecting surface 1801 come into contact can be placed close to the platen roller 15. In other words, the position where the third projecting surface 1773 and the holder projecting surface 1801 come into contact can be placed far away from the holder shaft 181. The third projecting surface 1773 and the holder projecting surface 1801 can come into contact in a position that is far from the holder shaft 181, and the roller holder 18 can be released from its mistakenly fixed state. Therefore, the force that is required in order to release the roller holder 18 from its fixed state is less than would be required in a case where the third projecting surface 1773 and the holder projecting surface 1801 come into contact in a position that is close to the holder shaft 181. This makes it possible to prevent the movement of the release rod 17 from becoming slower.

Moreover, in a case where the roller holder 18 is in the stand-by position (refer to FIG. 41) without being fixed in the contact position, the third projecting surface 1773 and the holder projecting surface 1801 do not come into contact. Therefore, the movement of the release rod 17 does not become slower.

In a case where the release rod 17 has moved to the left end position, the first to the third projecting surfaces 1771, 1772, 1773 are to the left of the holder projecting portion 180 (refer to FIGS. 44 and 45). In a case where the release rod 17 has moved to the right end position, the first to the third projecting surfaces 1771, 1772, 1773 are to the right of the holder projecting portion 180 (refer to FIGS. 40 and 41). In other words, the holder projecting surface 1801 is provided within the range of movement that is necessary in order to rotate the roller holder 18 such that the first to the second projecting surfaces 1771, 1772 come into contact with and separate from the holder side pressed portion 184. A position that is within the range of movement of the first to the second projecting surfaces 1771, 1772 is a position that is close to the platen roller 15. Therefore, the third projecting surface 1773 and the holder projecting surface 1801 come into contact at a position that is far from the holder shaft 181. Accordingly, it is possible to reduce the force that is required for releasing the roller holder 18 from its mistakenly fixed state, and to prevent the movement of the release rod 17 from becoming slower.

Furthermore, the rod projecting portion 177 is provided with the first to the third projecting surfaces 1771, 1772, 1773. Therefore, the distance between the third projecting surface 1773 and the first and second projecting surfaces 1771, 1772 is shorter than it would be in a case where the third projecting surface 1773 and the first and second projecting surfaces 1771, 1772 are configured in separate members. That means that the position where the third projecting surface 1773 and the holder projecting surface 1801 come into contact can be placed close to the platen roller 15. In other words, the third projecting surface 1773 and the holder projecting surface 1801 come into contact at a position that is far from the holder shaft 181. Accordingly, it is possible to reduce the force that is required for releasing the roller holder 18 from its mistakenly fixed state, and to prevent the movement of the release rod 17 from becoming slower.

The holder side pressed portion 184 against which the release rod 17 presses is provided in a position that faces the platen roller 15. In other words, the holder side pressed portion 184 is provided in the vicinity of the platen roller 15. Therefore, the range of movement of the first and the second projecting surfaces 1771, 1772 is located in a position that is close to the platen roller 15. The third projecting surface 1773 and the holder projecting surface 1801 therefore come into contact at a position that is far from the holder shaft 181. Accordingly, it is possible to reduce the force that is required for releasing the roller holder 18 from its mistakenly fixed state, and to prevent the movement of the release rod 17 from becoming slower.

The holder side pressed portion 184 is also positioned between the platen roller 15 and the sensor holder 19. That is, the holder side pressed portion 184 is provided in a position that is farther away from the holder shaft 181 than is the sensor holder 19. It is therefore possible to make the force that is required for releasing the roller holder 18 from its mistakenly fixed state smaller, and to prevent the movement of the release rod 17 from becoming slower, than would be possible in a case where the holder side pressed portion 184 is provided in a position that is closer to the holder shaft 181 than is the sensor holder 19.

A printer and a tape cassette according to a fourth embodiment will be explained with reference to FIGS. 48 to 57. In FIGS. 48 to 57, the same reference numerals are used for the structural elements that are the same as in the printer 1 and the tape cassette 30 according to the first or third embodiment. Hereinafter, explanations of the structural elements that are the same as in the first embodiment will be omitted, and only the points that are different from the first embodiment will be explained.

Figure 48:
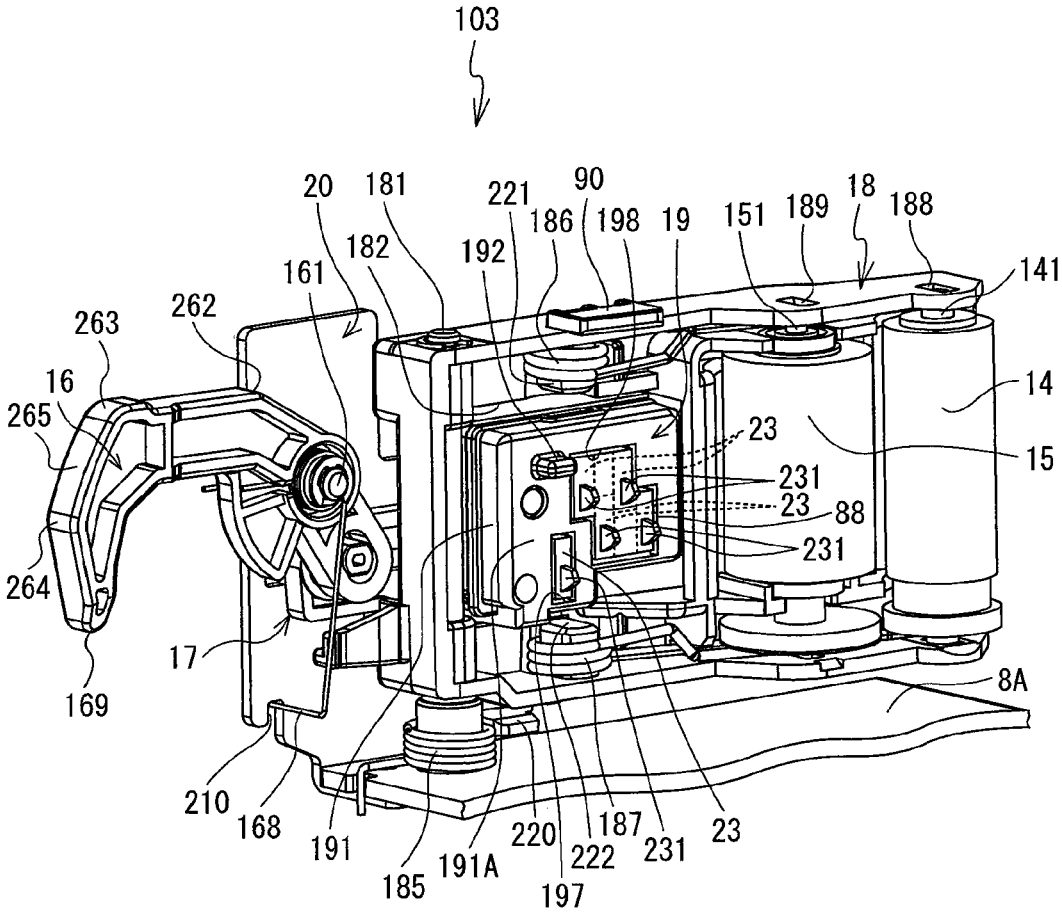
FIG. 48 is an oblique view of a movable mechanism 103 as seen obliquely from the rear in a state in which the cover 6 is closed.
Figure 49:
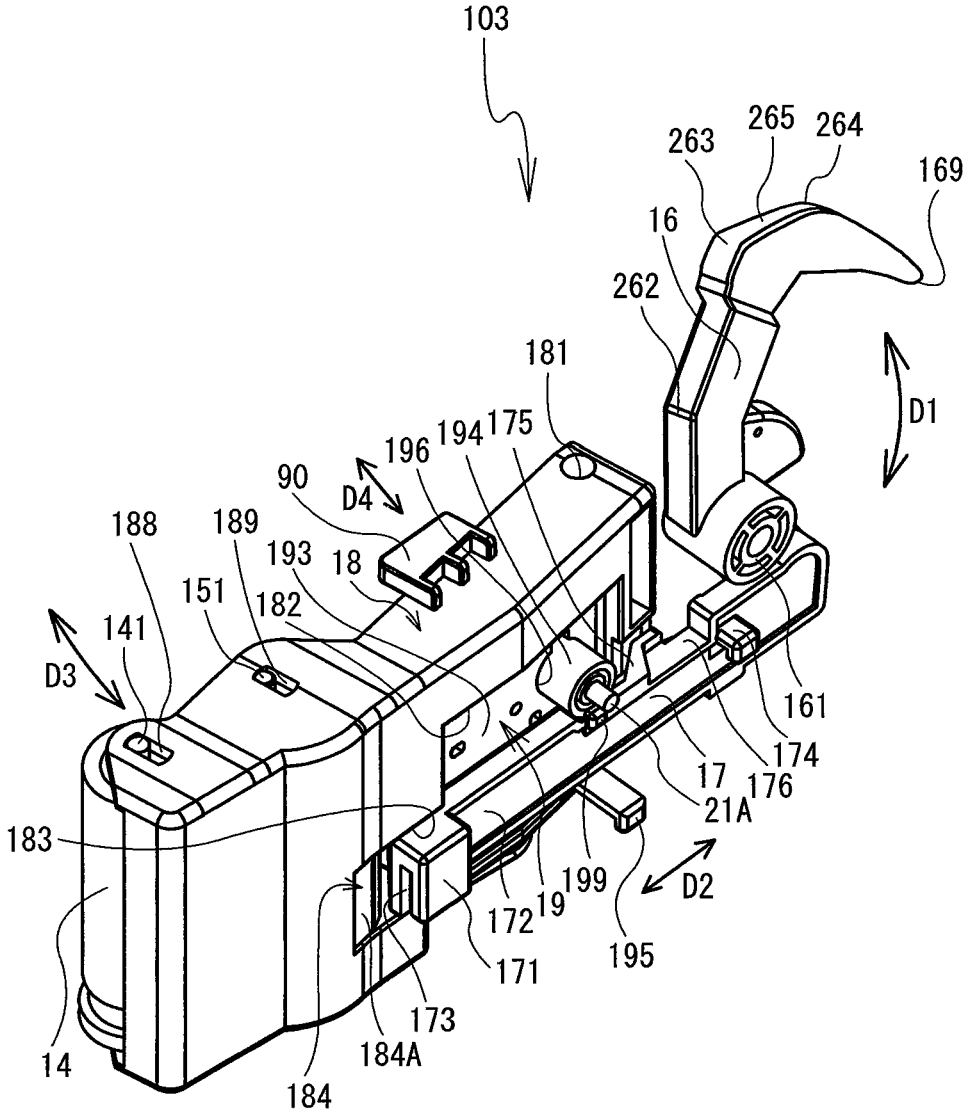
FIG. 49 is an oblique view of the movable mechanism 103 from which the wall 20 has been removed, as seen obliquely from the front in a state in which the cover 6 is open.
Figure 50:
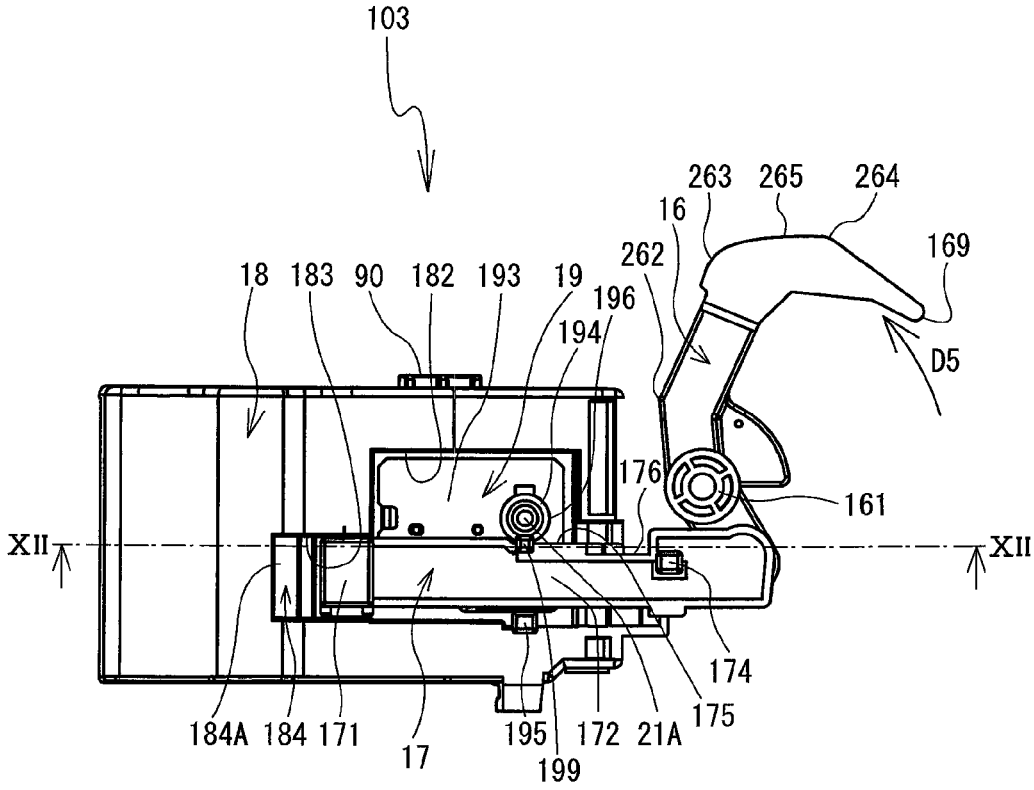
FIG. 50 is a front view of the movable mechanism 103 that is shown in FIG. 49.
Figure 51:
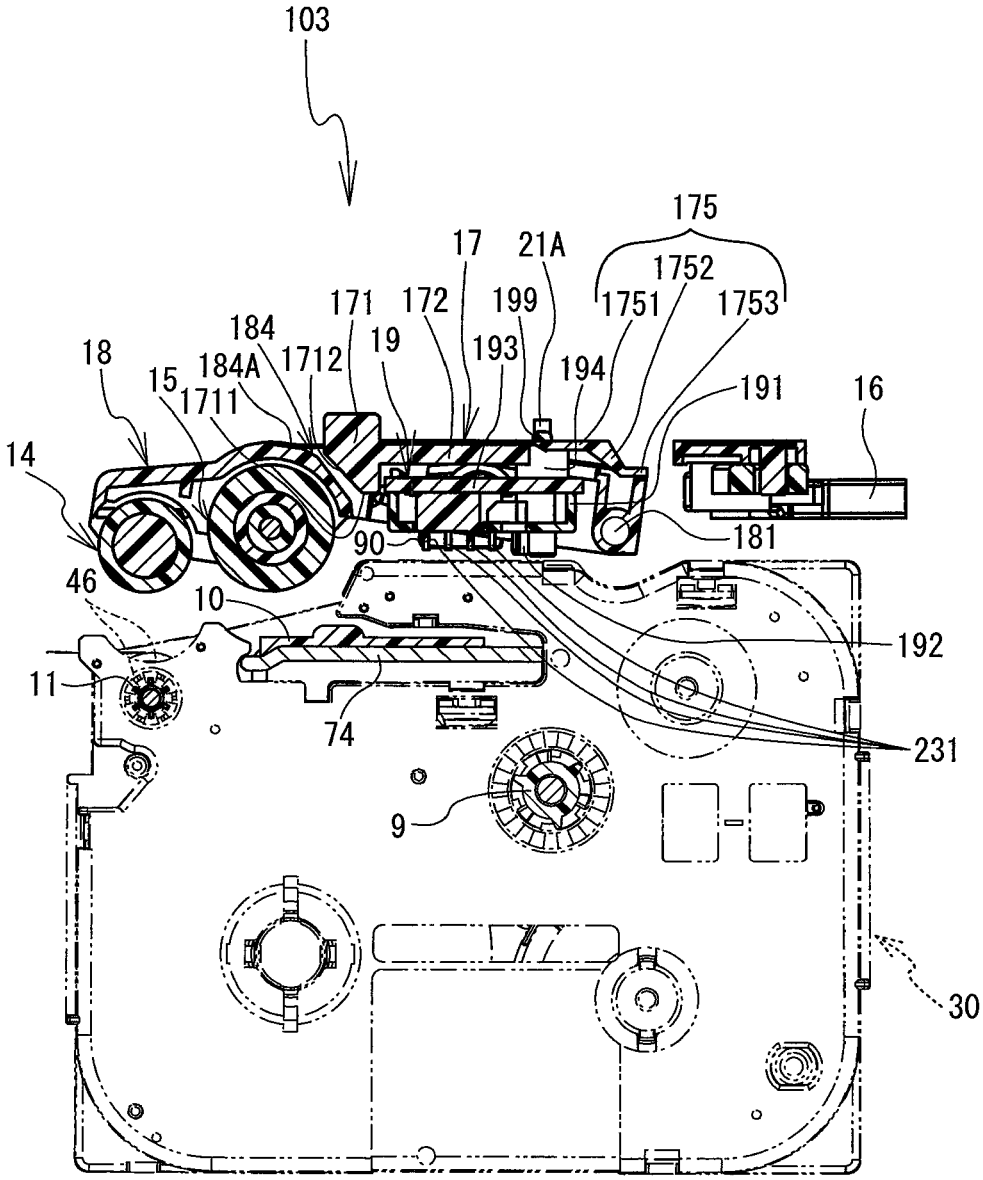
FIG. 51 is a sectional view in the direction of the broken line XII-XII in FIG. 50, and a bottom plan view that shows the tape cassette 30, the tape drive shaft 11, and the head holder 74.
Figure 52:
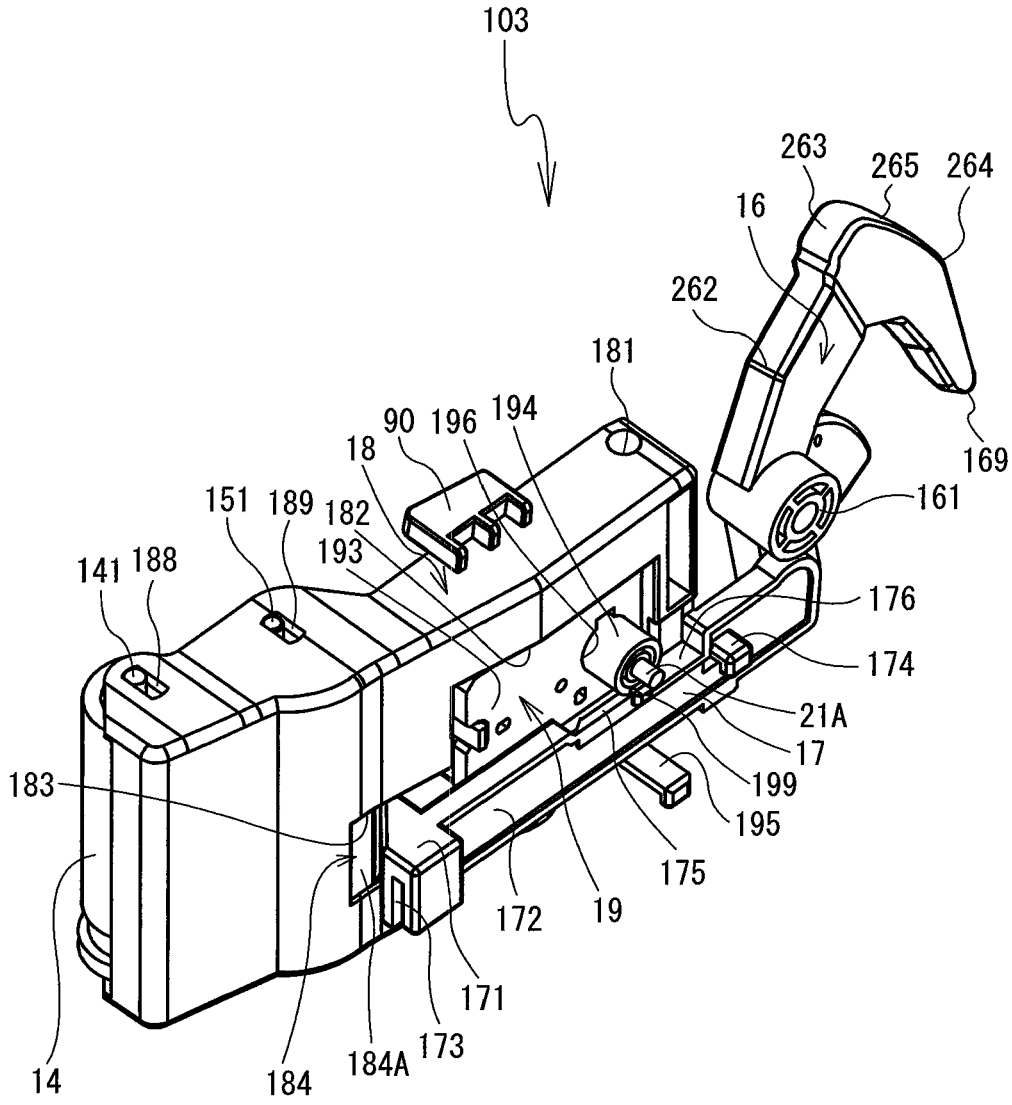
FIG. 52 is an oblique view of the movable mechanism 103 from which the wall 20 has been removed, as seen obliquely from the front in a state in which the cover 6 is in the process of being opened/closed.
Figure 53:
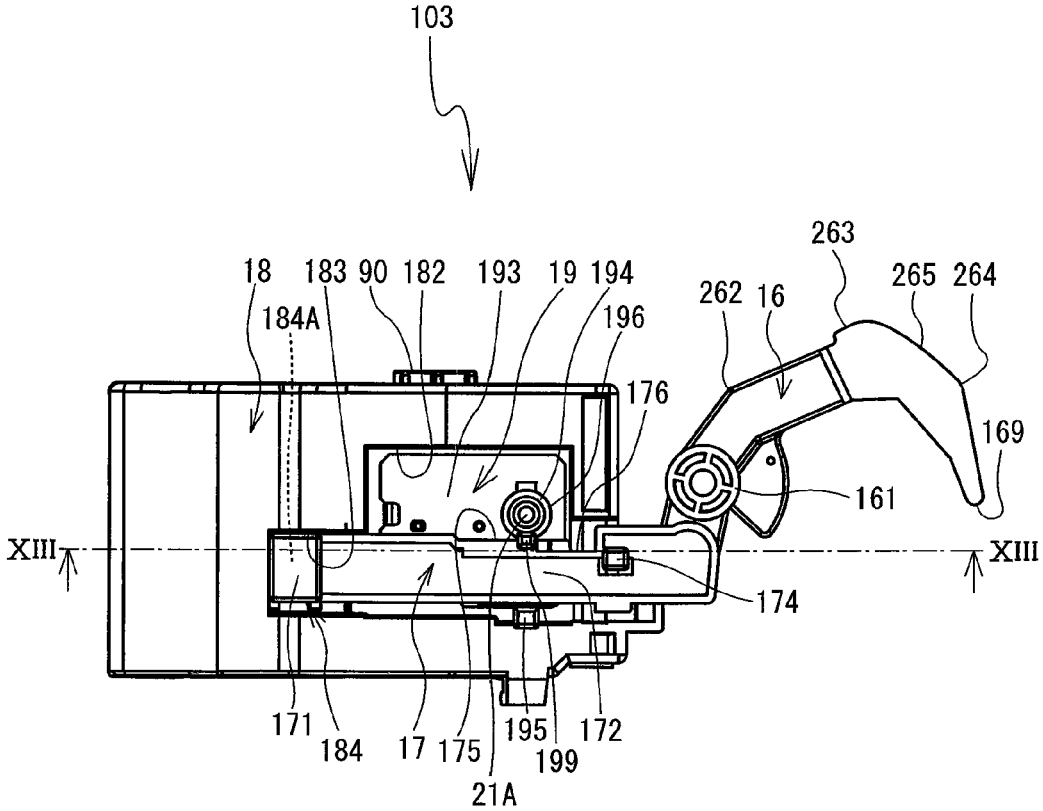
FIG. 53 is a front view of the movable mechanism 103 that is shown in FIG. 52.
Figure 54:
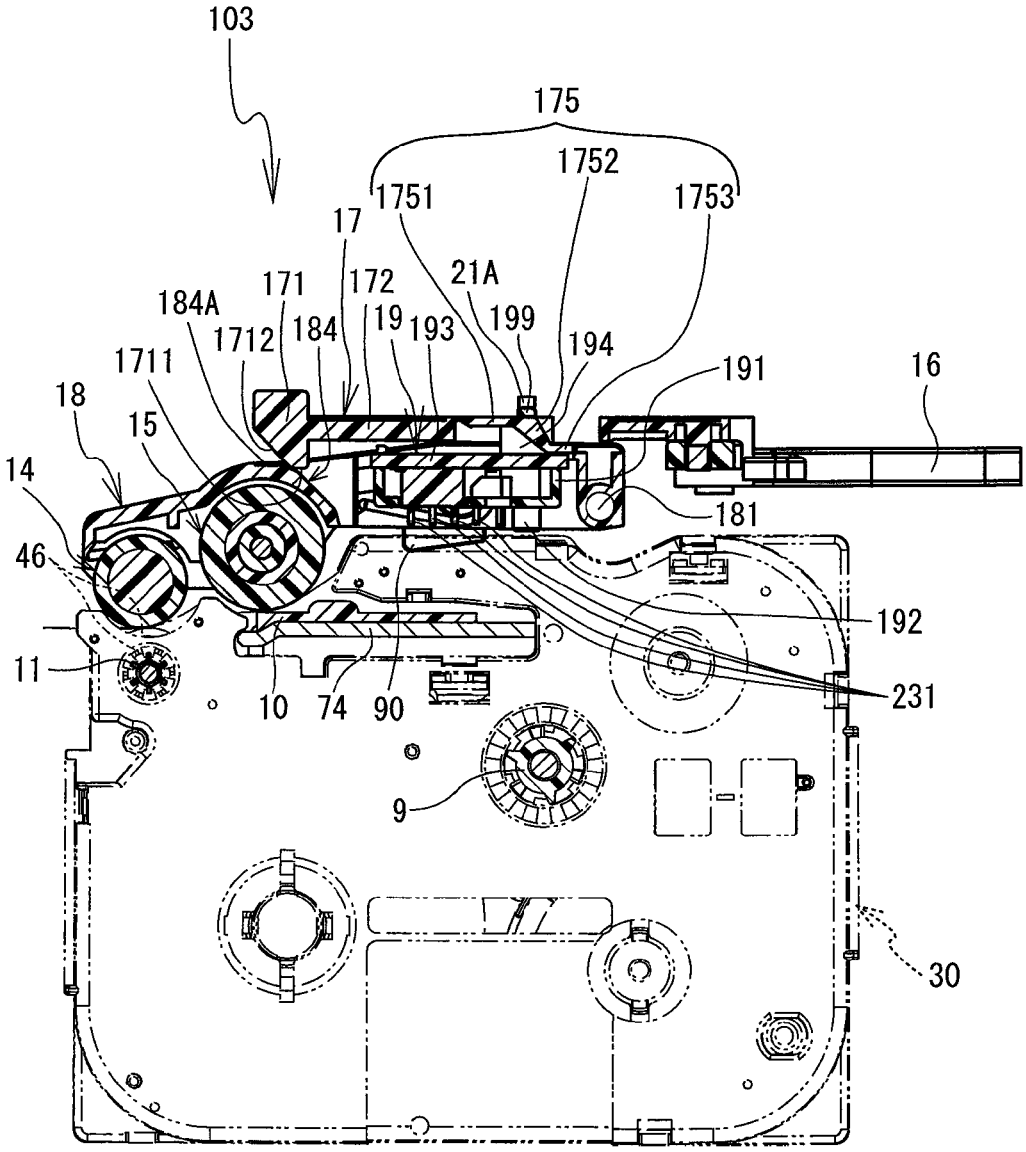
FIG. 54 is a sectional view in the direction of the broken line XIII-XIII in FIG. 53, and a bottom plan view that shows the tape cassette 30, the tape drive shaft 11, and the head holder 74.
Figure 55:
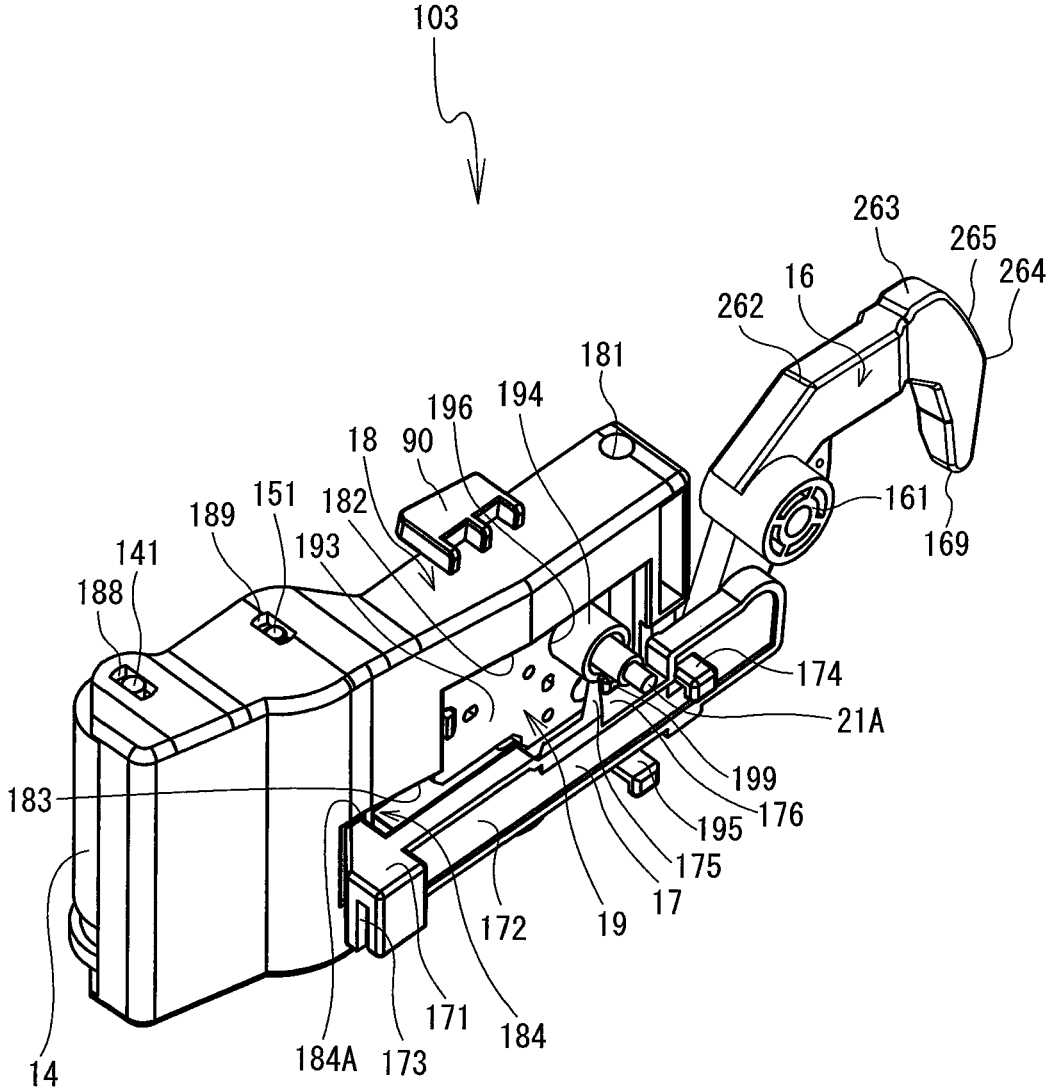
FIG. 55 is an oblique view of the movable mechanism 103 from which the wall 20 has been removed, as seen obliquely from the front in a state in which the cover 6 is closed.
Figure 56:
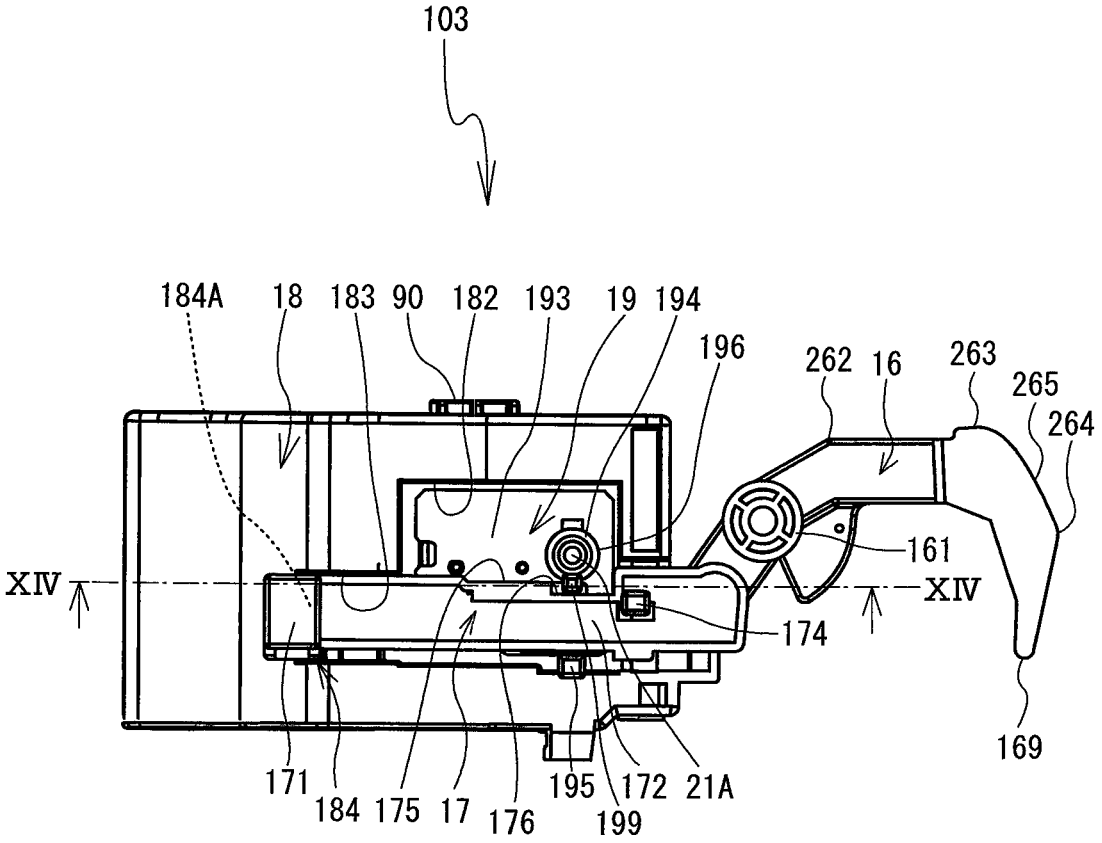
FIG. 56 is a front view of the movable mechanism 103 that is shown in FIG. 55.
Figure 57:
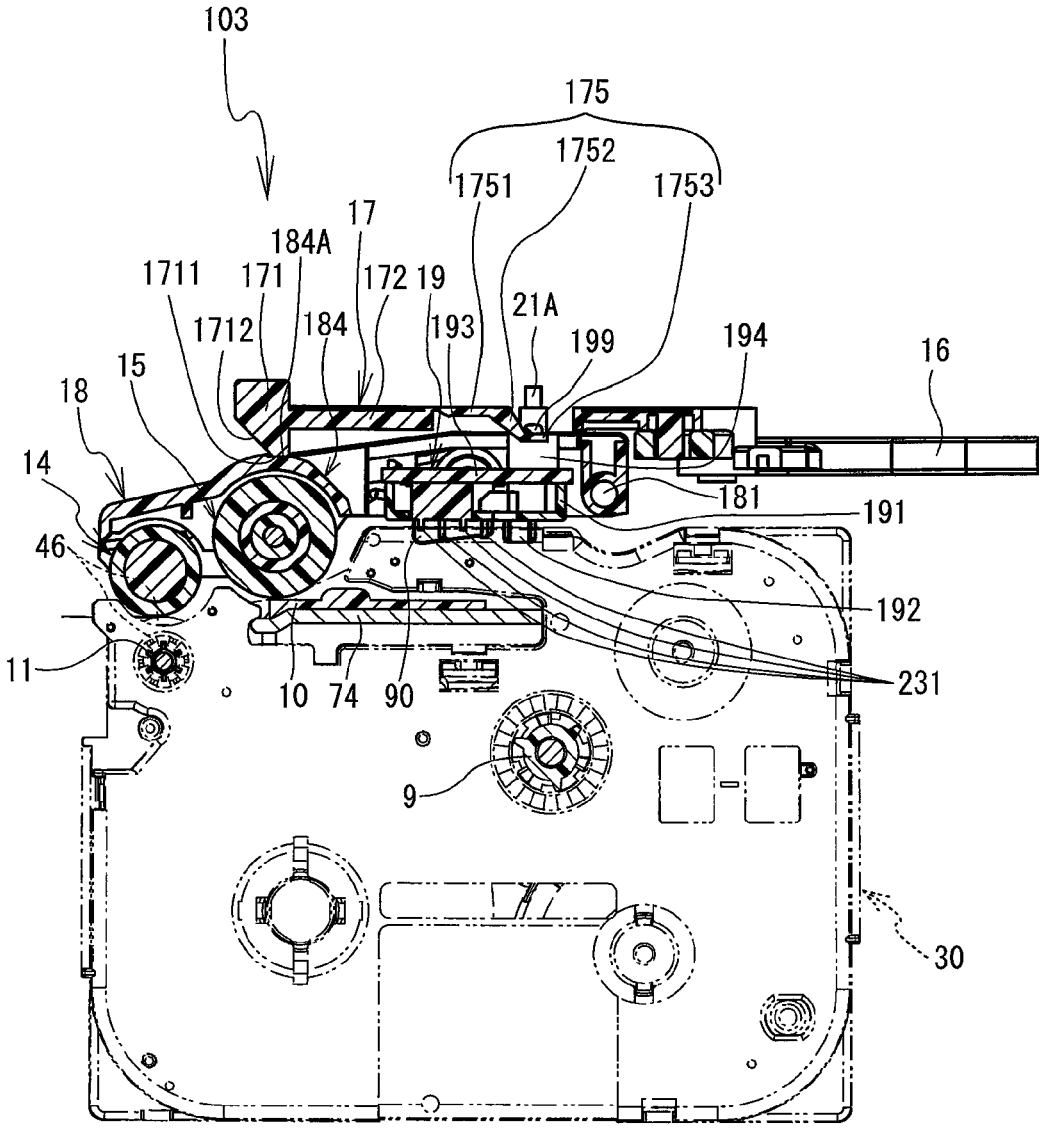
FIG. 57 is a sectional view in the direction of the broken line XIV-XIV in FIG. 56, and a bottom plan view that shows the tape cassette 30, the tape drive shaft 11, and the head holder 74.

In the present embodiment, the right side, the left side, the front side and the rear side of FIG. 48 correspond to the left side, the right side, the rear side, and the front side, respectively, of a movable mechanism 103. FIGS. 49 to 57 are drawings that respectively correspond to FIGS. 6, 14, 15, 17 to 19, and 21 to 23 in the first embodiment. FIGS. 49 to 51 show a state in which the cover 6 is open (that is, a state in which the roller holder 18 is in the stand-by position and the sensor holder 19 is in the separated position). FIGS. 52 to 54 show a state in which the cover 6 is in the process of being closed (that is, a state in which the roller holder 18 is in the contact position and the sensor holder 19 is in the separated position). FIGS. 48 and 55 to 57 show a state in which the cover 6 is closed (that is, a state in which the roller holder 18 is in the printing position and the sensor holder 19 is in the identification position).

The printer according to the present embodiment is provided with the movable mechanism 103, hereinafter described, instead of the movable mechanism 100 in the first embodiment.

On the lever 16 according to the present embodiment, a coil portion of a coil spring 168 is mounted on the lever shaft 161. Two arm portions are provided that extend radially outward from the coil portion of the coil spring 168. One of the arms portions is affixed to the lever 16, and the other arm portion is affixed to a spring holding portion 210 (refer to FIG. 48). The spring holding portion 210 is a notch that is provided in the wall 20 and into which the arm portion of the coil spring 168 is latched. The coil spring 168 is constantly elastically urged such that it causes the lever 16 to rotate upward (counterclockwise in FIG. 49). The elastic energy that is accumulated in the coil spring 168 (that is, the force that urges upward) increases as the lever 16 rotates farther downward (clockwise in FIG. 49).

In the same manner as in the third embodiment, the shaft 141 of the movable feed roller 14 is rotatably supported by the shaft support holes 188 of the roller holder 18. The shaft 151 of the platen roller 15 is rotatably supported by the shaft support holes 189 of the roller holder 18. The coil portion of the coil spring 185 is fitted onto the bottom of the holder shaft 181. The two arm portions of the coil spring 185 are affixed to the spring holding portion 220 and a bottom plate 8A, respectively. The coil spring 185 is constantly elastically urged such that it causes the roller holder 18 to rotate toward the front (the lower right in FIG. 49). The elastic energy that is accumulated in the coil spring 185 (that is, the force that urges toward the front) increases as the roller holder 18 rotates farther toward the rear (the upper left in FIG. 49).

In the same manner as in the third embodiment, the spring holding portions 221, 222 and the roller springs 186, 187 are provided on the inner surfaces of the roller holder 18. The roller springs 186, 187 constantly elastically urge the shafts 141, 151 at a specified pressure, such that they cause the movable feed roller 14 and the platen roller 15 to move toward the rear (the upper left in FIG. 49).

The operating modes of the movable mechanism 103 will be explained in detail with reference to FIGS. 48 to 57. First, the operating mode of the movable mechanism 103 in a case where the cover 6 is moved from the open position (refer to FIG. 2) to the closed position (refer to FIG. 1) by being closed downward will be explained.

As shown in FIGS. 49 to 51, when the cover 6 is in the open position, the release rod 17 is at the right end position of its range of movement, in the same manner as in the first embodiment. At this time, the sensor holder 19 is held in the separated position (refer to FIG. 51), and the roller holder 18 is held in the stand-by position (refer to FIG. 51). In a case where the cover 6 is closed by the user, the release rod 17 moves to the left from the right end position, in the same manner as in the first embodiment. In accordance with the moving of the release rod 17 to the left, the roller holder 18 rotates toward the rear against the urging force of the coil spring 185, in the same manner as in the first embodiment.

As shown in FIGS. 52 to 54, when the release rod 17 reaches the first position (refer to FIG. 54), the roller holder 18 moves to the contact position, in the same manner as in the first embodiment. When the cover 6 is moved farther toward the closed position from a state in which the cover 6 is in the process of being closed (refer to FIGS. 52 to 54), the release rod 17 moves farther to the left from the first position. When the cover 6 reaches the closed position, the release rod 17 moves to the second position (refer to FIG. 57), which is the right end position of its range of movement, in the same manner as in the first embodiment.

As shown in FIGS. 48 and 55 to 57, when the release rod 17 reaches the second position (refer to FIG. 57), the roller holder 18 moves to the printing position. At this time, the rear surface 1711 of the pressing portion 171 comes into contact with a position fixing portion 184A. The position fixing portion 184A is a front edge portion of the holder side pressed portion 184, extending parallel to the rear surface 1711, and it fixes the release rod 17 in the second position by coming into contact with the rear surface 1711.

As the cover 6 thus approaches the closed position, the pressure with which the platen roller 15 presses against the thermal head 10 and the pressure with which the movable feed roller 14 presses against the tape drive roller 46 gradually increase. In turn, the elastic energy that is accumulated in the roller springs 186, 187 (that is, the elastic energy that is generated in a state in which the platen roller 15 is pressed against the thermal head 10 at a specified pressure and the movable feed roller 14 is pressed against the tape drive roller 46 at a specified pressure) gradually increases.

In the state in which the roller holder 18 has moved to the printing position (refer to FIG. 57), the shafts 141, 151, in accordance with the contraction of the roller springs 186, 187, move to the centers of the shaft support holes 188, 189, respectively, in the front-rear direction. At this time, the elastic energy that is accumulated in the roller springs 186, 187 increases.

Furthermore, when the release rod 17 moves farther to the left than the first position (refer to FIG. 54), the sensor holder 19 moves toward the rear, in the same manner as in the first embodiment. When the release rod 17 moves still farther to the left and reaches the second position (refer to FIG. 57), the sensor holder 19 moves to the identification position.

Thus the release rod 17 moves to the left in conjunction with the downward closing of the cover 6. In accordance with the movement of the release rod 17, the roller holder 18 moves to the printing position, and the sensor holder 19 moves to the identification position (refer to FIGS. 48 and 55 to 57). This fixes the tape cassette 30 firmly in the cassette mounting portion 8 and creates a state in which stable and accurate printing can be performed. The switch terminals 231 are pressed against the arm indicator portion 800, creating a state in which the type of tape in the tape cassette 30 can be determined. Furthermore, the sensor protective plate 90 is maintained in a state of having moved into the arm accommodating portion 79, so upward movement of the tape cassette 30 is restricted by the sensor protective plate 90 (refer to FIG. 20).

Next, the operating mode of the movable mechanism 103 in a case where the cover 6 is moved from the closed position (refer to FIG. 1) to the open position (refer to FIG. 2) by being opened upward will be explained. This operating mode is similar to the case where the cover 6 is closed in the downward direction, but the order of the operations of the roller holder 18 and the sensor holder 19 is reversed.

In the state in which the cover 6 is in the closed position (refer to FIGS. 48 and 55 to 57), when the cover 6 is opened upward from the closed position, the top surface of the projecting piece 63 pushes the lever tip portion 169 upward, in the same manner as in the first embodiment, although this is not shown in the drawings. In conjunction with the rotation of the upwardly pushed lever 16, the contact between the position fixing portion 184A and the rear surface 1711 is released by the moving of the release rod 17 to the right from the second position (refer to FIG. 57) by a specified amount, with the fixing of the roller holder 18 in the printing position being released in turn.

In a case where the fixing of the roller holder 18 in the printing position is released, the elastic energy that has been accumulated in the roller springs 186, 187 is released, so the movable feed roller 14 and the platen roller 15 are pushed toward the rear by the roller springs 186, 187. At this time, the movable feed roller 14 and the platen roller 15 are subject to repelling forces from the tape drive roller 46 and the thermal head 10, respectively. The roller holder 18 is moved by the repelling forces toward the front from the printing position (refer to FIG. 57) to the contact position (refer to FIG. 54).

At this time, the release rod 17 is moved from the second position (refer to FIG. 57) to the first position (refer to FIG. 54) by the pressing of the holder side pressed portion 184 on the slanting surface 1712. In conjunction with the moving of the release rod 17, the holder guide portion 199 slides along the rod guide diagonal portion 1752 from the second rod guide portion 1753 to the first rod guide portion 1751. Thus the sensor holder 19 moves toward the front from the identification position (refer to FIG. 57) to the separated position (refer to FIG. 54).

In the present embodiment, in a case where the fixing of the roller holder 18 in the printing position is released, the magnitude of the pressure (that is, the repelling forces) that the roller springs 186, 187 apply is regulated such that the elastic energy that is required in order for the release rod 17 to move from the second position (refer to FIG. 57) to the first position (refer to FIG. 54) is accumulated in the roller springs 186, 187. Furthermore, the position, the length, the angle, and the like of the rod guide diagonal portion 1752 are regulated such that the elastic energy that is released by the roller springs 186, 187 slides the holder guide portion 199 from the second rod guide portion 1753 to the first rod guide portion 1751.

As described previously, the coil spring 185 (refer to FIG. 48) that urges the roller holder 18 toward the front is provided on the roller holder 18. Therefore, the release rod 17 that has moved from the second position (refer to FIG. 57) to the first position (refer to FIG. 54) is pressed by the roller holder 18, which is slid toward the front by the urging force of the coil spring 185 (refer to FIG. 48), such that the release rod 17 moves farther to the right than the first position (refer to FIG. 54). Note that the roller holder 18 is moved to the stand-by position (refer to FIG. 51) and held there by the urging force of the coil spring 185 (refer to FIG. 48).

The lever 16 is also provided with the coil spring 168 (refer to FIG. 48) that urges the lever 16 upward. Therefore, the release rod 17 that has moved to a position where it is separated from the roller holder 18 moves to the right end position (refer to FIG. 51) of its range of movement in conjunction with the moving of the lever 16 upward by the urging force of the coil spring 168 (refer to FIG. 48). Note that the lever 16 is rotated upward until the third curved portion 264 is at its highest position (refer to FIG. 50) and is held there by the urging force of the coil spring 168 (refer to FIG. 48).

Thus, when the cover 6 is opened, the fixing of the release rod 17 at the second position (refer to FIG. 57) is released, the roller holder 18 moves to the stand-by position, and the sensor holder 19 moves to the separated position (refer to FIGS. 49 to 51). Therefore, as described previously, the printer 1 enters the printer 1 is in a state in which the tape cassette 30 can be freely mounted in and removed from the cassette mounting portion 8.

As explained above, in the printer 1 according to the present embodiment, the roller holder 18 is provided with the roller springs 186, 187, which, in a case where the roller holder 18 has rotated to the printing position (refer to FIG. 57), press the platen roller 15 against the thermal head 10 at a specified pressure. In a case where the fixing of the release rod 17 at the second position (refer to FIG. 57) is released, the roller holder 18 is rotated from the printing position (refer to FIG. 57) to the contact position (refer to FIG. 54) by the releasing of the elastic energy that is accumulated in the roller springs 186, 187. In conjunction with this, the release rod 17 moves from the second position (refer to FIG. 57) to the first position (refer to FIG. 54), and the sensor holder 19 moves from the identification position (refer to FIG. 57) to the separated position (refer to FIG. 54).

In other words, simply releasing the fixing of the release rod 17 at the second position (refer to FIG. 57) causes the switch terminals 231 of the mechanical sensors 23 to retract to a position where they are separated from the arm indicator portion 800 of the tape cassette 30. It is therefore possible to inhibit the mechanical sensors 23 from interfering with the tape cassette 30 that is being one of mounted in and removed from the cassette mounting portion 8 and, in turn, to inhibit the occurrence of damage to and failure of the mechanical sensors 23. Moreover, the elastic energy that is accumulated in the roller springs 186, 187 generates mechanical actions that move the roller holder 18 and the sensor holder 19, respectively, making it possible to retract the mechanical sensors 23 accurately.

The lever 16 also moves the release rod 17 in accordance with the opening and closing operations of the cover 6. In conjunction with the movement of the release rod 17, the roller holder 18 rotates, and the sensor holder 19 moves. When the cover 6 is opened, the printer is put into a state in which the tape cassette 30 can be mounted in and removed from the cassette mounting portion 8. When the cover 6 is closed, the printer is put into a state in which the printing can be performed by the thermal head 10. Therefore, simply by opening and closing the cover 6, the user is able to put the printer 1 into a state to be optimally used in accordance with whether the cover 6 is open or closed, and the operability of the printer 1 can be improved.

Moreover, simply by opening the cover 6, the user is able to release the release rod 17 from its fixed position and thereby to cause the mechanical sensors 23 to retract. In a case where the cover 6 has been opened, it is possible for the urging force of the coil spring 185 to cause the roller holder 18 to retract to the stand-by position (refer to FIG. 54). In a case where the cover 6 has been opened, it is possible for the urging force of the coil spring 168 to reliably return the lever 16 to its initial position. It is therefore possible to operate the lever 16 smoothly in conjunction with the opening and closing operations of the cover 6.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer, comprising:

a cassette mounting portion, into which is mounted and from which is removed a tape cassette in an up-down direction, the tape cassette including a box-shaped cassette case, a tape, and an indicator portion, the cassette case being provided with a top surface, a bottom surface, a front surface and a pair of side surfaces, the tape being a printing medium that is contained in the cassette case, and the indicator portion being provided on the front surface and indicating a type of the tape;

a printing head that performs printing on the tape in a case where the tape cassette has been mounted in the cassette mounting portion;

a platen roller that faces the printing head and that can be pressed against the printing head through the tape;

a roller holder that supports the platen roller and that can rotate, around a holder shaft that is parallel to the up-down direction, between a first position that is a position where the platen roller is pressed against the printing head and a second position that is a position where the platen roller is separated from the printing head;

a sensor that detects the type of the tape that the indicator portion indicates;

a sensor holder that holds the sensor between the holder shaft and the platen roller and that can move between a third position that is a position where the sensor is close to the indicator portion and a fourth position that is a position where the sensor is separated from the indicator portion; and a protective portion that is provided on the roller holder and is provided above the sensor, that, in a case where the roller holder rotates to the second position, moves to a position where it is separated from the tape cassette that is mounted in the cassette mounting portion, and that, in a case where the roller holder rotates to the first position, moves to a position where it will come into contact from below with the tape cassette that is mounted in the cassette mounting portion, wherein the roller holder, in a case where the sensor holder moves to the third position, rotates to the first position before the sensor moves close to the indicator portion, and in a case where the sensor holder moves to the fourth position, rotates to the second position after the sensor has separated from the indicator portion.

2. The printer according to claim 1, wherein:

the platen roller faces the printing head in a direction that is parallel to a front-rear direction of the tape cassette that is mounted in the cassette mounting portion, is provided in front of the printing head, and faces the front surface of the tape cassette, and the protective portion is a plate-shaped member that extends toward the printing head from the roller holder and that is provided in a position that is higher than the front surface of the tape cassette that is mounted in the cassette mounting portion.

3. The printer according to claim 1, further comprising:

a head holder that supports the printing head in a position that faces the platen roller, wherein the cassette mounting portion includes an arm accommodating portion that, in a case where the tape cassette has been mounted, accommodates an arm portion that includes at least a portion of the front surface, the arm accommodating portion is a space that is formed between the head holder and the roller holder, a length of the arm accommodating portion in a front-rear direction of the tape cassette is not less than a length of the arm portion in the front-rear direction when the roller holder is in the first position and when the roller holder is in the second position, and a distance between the protective portion and the head holder in the front-rear direction is not less than the length of the arm portion in the front-rear direction when the roller holder is in the second position, and is less than the length of the arm portion in the front-rear direction i when the roller holder is in the first position.

4. The printer according to claim 1, further comprising:

a rod portion that can move in a state in which the rod portion is coupled with the roller holder and with the sensor holder, wherein the rod portion moves the roller holder toward the first position and moves the sensor holder toward the third position in accordance with the moving of the rod portion in a first direction, and the rod portion moves the roller holder toward the second position and moves the sensor holder toward the fourth position in accordance with the moving of the rod portion in a second direction that is different from the first direction.

5. The printer according to claim 1, wherein:

the sensor is a mechanical sensor that has a switch terminal that can advance and retract, and the printer further comprises a determination unit that determines the type of the tape based on advancing and retracting of the switch terminal in the mechanical sensor.

6. The printer according to claim 5, wherein:

the indicator portion includes a plurality of indicators that are arranged in a pattern in accordance with the type of the tape, each of the plurality of indicators being one of an aperture and a planar portion, the sensor holder holds a plurality of the sensors, the switch terminal of each of the plurality of sensors moves close to corresponding one of the plurality of the indicators in a case where the sensor holder moves to the third position, and the switch terminal of each of the plurality of sensors is one of retracted and maintained in an advanced state, the switch terminal being maintained in the advanced state in a case where the switch terminal has moved close to the aperture such that the switch terminal is inserted into the hole, and the switch terminal being retracted in a case where the switch terminal has moved close to the planar portion such that the switch terminal is pressed against the planar portion.

7. The printer according to claim 1, further comprising:

a first releasing portion that is provided in the sensor holder and that moves the roller holder from the first position toward the second position in conjunction with the moving of the sensor holder from the third position to the fourth position.

8. The printer according to claim 7, wherein:

the first releasing portion is provided in a location that is farther from the holder shaft than is a center of the sensor holder.

9. The printer according to claim 7, wherein:

the roller holder is provided, between the holder shaft and the platen roller, with an opening edge that forms a through opening that extends in a direction from the second position toward the first position, the sensor holder is provided to an inner side of the opening edge, and the first releasing portion protrudes from the sensor holder, and in a case where the platen roller is fixed in the first position, the first releasing portion releases the fixing of the platen roller in the first position by pressing the opening edge in a direction from the first position toward the second position in conjunction with the moving of the sensor holder from the third position to the fourth position.

10. The printer according to claim 1, further comprising:

an urging member that urges the roller holder and causes the roller holder to move from the first position to the second position;

a rod portion that, while moving in a first direction, presses against a wall portion that is provided in the roller holder, and that, while moving in a second direction that is different from the first direction, separates from the wall portion;

a first working surface that is provided on the rod portion and that, by pressing against the wall portion in conjunction with the moving of the rod portion in the first direction, causes the roller holder to move from the second position to the first position against an urging force of the urging member;

a second working surface that is provided on the rod portion and that, when the rod portion moves in the second direction in a case where the roller holder is in the first position, moves along a path that brings the second working surface into contact with the roller holder; and a surface portion that is provided in the roller holder, that is subject to contact by the second working surface that moves along the path, and that causes the roller holder to move from the first position toward the second position, in accordance with a pressing force that is applied to the surface portion by the second working surface in conjunction with the moving of the rod portion in the second direction.

11. The printer according to claim 10, wherein:

the first working surface and the second working surface, in a case where the rod portion moves in the first direction and the roller holder is in the first position, are located farther from the holder shaft than is the surface portion, and the first working surface and the second working surface, in a case where the rod portion moves in the second direction and the roller holder is in the second position, are located closer to the holder shaft than is the surface portion.

12. The printer according to claim 10, wherein:

the roller holder is provided, between the holder shaft and the platen roller, with an opening edge that forms a through opening that extends in a direction from the second position toward the first position, the surface portion is provided in a first projecting portion that projects toward the rod portion from at least one of an upper edge and a lower edge of the opening edge, and the second working surface is provided in a second projecting portion that projects from the rod portion toward the at least one of the upper edge and the lower edge on which the first projecting portion is provided.

13. The printer according to claim 12, wherein:

the first working surface is provided in the second projecting portion.

14. The printer according to claim 10, wherein:

the wall portion is positioned opposite the platen roller and between the sensor holder and the platen roller.

15. The printer according to claim 1, further comprising:

an elastic portion that is provided in the roller holder and that elastically urges the platen roller toward the printing head;

a rod portion that can move in a state in which the rod portion is coupled with the roller holder and with the sensor holder; and a holding portion that can hold the rod portion in a specified position, wherein the roller holder, in a case where the roller holder is in the first position, presses the platen roller into contact with the printing head at a specified pressure, the roller holder can rotate to a fifth position, where the roller holder causes the platen roller to be in contact with the printing head at a pressure that is less than the specified pressure, the elastic portion, in a case where the roller holder is in the first position, presses the platen roller against the printing head at the specified pressure, the rod portion can move among a first rod position, where the rod portion causes the roller holder to move to the first position and causes the sensor holder to move to the third position, a second rod position, where the rod portion causes the roller holder to move to the fifth position and causes the sensor holder to move to the fourth position, and a third rod position, where the rod portion causes the roller holder to move to the second position and causes the sensor holder to move to the fourth position, the holding portion, in a case where the rod portion has moved to the first rod position, holds the rod portion in the first rod position, such that the roller holder is fixed in the first position and the sensor holder is fixed in the third position, the elastic portion, in a case where the rod portion is being held by the holding portion, accumulates elastic energy that is generated in a state in which the platen roller is being pressed against the printing head at the specified pressure and that causes the roller holder to rotate from the first position to the fifth position, and in a case where the holding of the rod portion by the holding portion is released, releases the accumulated elastic energy and apply the accumulated elastic energy to the roller holder, and the roller holder, in a case where the accumulated elastic energy has been released and applied by the elastic portions, causes the rod portion to move from the first rod position to the second rod position as the roller holder rotates from the first position to the fifth position.

16. The printer according to claim 15, wherein:

the rod portion includes a roller pressing portion and a sensor guide portion, the roller pressing portion being a slanting surface that faces the roller holder and the sensor guide portion having a specified cam shape, the roller holder includes a rod pressed portion that is a surface that contacts the roller pressing portion in a case where the rod portion is in one of the second rod position and the first rod position, the sensor holder includes an engaging portion that engages with the sensor guide portion and moves along the specified cam shape in conjunction with the moving of the rod portion, the sensor guide portion includes a first holding cam, a second holding cam, and a moving cam, the first holding cam being engaged by the engaging portion and holding the sensor holder in the third position in a case where the rod portion is in the first rod position, the second holding cam being engaged by the engaging portion and holding the sensor holder in the fourth position in a case where the rod portion is in the second rod position, and the moving cam being provided between and continuous with the first holding cam and the second holding cam and being engaged by the engaging portion in conjunction with the moving of the rod portion between the first rod position and the second rod position, the roller holder is rotated from the fifth position to the first position by the pressing of the roller pressing portion against the rod pressed portion in conjunction with the moving of the rod portion from the second rod position to the first rod position, and the roller holder is rotated from the first position to the fifth position by the pressing of the rod pressed portion against the roller pressing portion in conjunction with the moving of the rod portion from the first rod position to the second rod position, and the sensor holder is moved from the fourth position to the third position by a sliding of the engaging portion along the moving cam from the second holding cam toward the first holding cam in conjunction with the moving of the rod portion from the second rod position to the first rod position, and the sensor holder is moved from the third position to the fourth position by a sliding of the engaging portion along the moving cam from the first holding cam toward the second holding cam, in conjunction with the moving of the rod portion from the first rod position to the second rod position.

17. The printer according to claim 15, further comprising:

a cover that opens and closes the cassette mounting portion; and a lever that can move in a state of being coupled with the rod portion, that moves the rod portion to the first rod position, the second rod position, and the third rod position, in that order, as the lever moves in one direction in conjunction with an opening operation of the cover, and that moves the rod portion to the third rod position, the second rod position, and the first rod position, in that order, as the lever rotates in another direction that is opposite from the one direction in conjunction with a closing operation of the cover.

18. The printer according to claim 17, further comprising:

a first urging portion that applies an urging force to the roller holder in such a direction that the platen roller is separated from the printing head, wherein the roller holder, in a case where the holding of the rod portion by the holding portion has been released, is rotated from the first position to the fifth position by the elastic energy, after which the roller holder is rotated from the fifth position to the second position by the urging force that is applied by the first urging portion.

19. The printer according to claim 17, further comprising:

a second urging portion that urges the lever in the one direction.

20. The printer according to claim 17, further comprising:

a second releasing portion that, in a case where the cassette mounting portion has been closed by the cover, moves the rod portion that is being held by the holding portion from the first rod position to the second rod position, by moving the lever by a specified amount in the one direction, in conjunction with the opening operation of the cover.

* * * * *